US012371907B2

(12) United States Patent
Mongelluzzo et al.

(10) Patent No.: US 12,371,907 B2
(45) **Date of Patent: *Jul. 29, 2025**

(54) DEBRIS EJECTOR FOR ROOF GUTTER SYSTEMS

(71) Applicant: Unclutter Gutter, LLP, East Quogue, NY (US)

(72) Inventors: Michael Mongelluzzo, East Quogue, NY (US); James Bergdoll, East Setauket, NY (US)

( * ) Notice: Subject to any disclaimer, the term of this patent is extended or adjusted under 35 U.S.C. 154(b) by 383 days.

This patent is subject to a terminal disclaimer.

(21) Appl. No.: 17/803,389

(22) Filed: Jun. 17, 2022

(65) Prior Publication Data

US 2023/0030131 A1 Feb. 2, 2023

Related U.S. Application Data

(63) Continuation-in-part of application No. 17/383,447, filed on Jul. 23, 2021, now abandoned.

(51) Int. Cl.
*E04D 13/076* (2006.01)
*E04D 13/03* (2006.01)

(52) U.S. Cl.
CPC ..... *E04D 13/076* (2013.01); *E04D 13/03* (2013.01)

(58) Field of Classification Search
CPC ..... E04D 13/076; E04D 13/04; E04D 13/064; F21W 2121/004; F21W 2121/00; F21V 33/006; F21V 21/08; F21V 21/008; F21S 4/10; F21S 4/28
USPC ..... 52/12
See application file for complete search history.

(56) References Cited

U.S. PATENT DOCUMENTS 3,599,916 A * 8/1971 Szabo ..... F21S 4/10 24/339
5,566,058 A * 10/1996 Protz, Jr. ..... F21V 21/088 362/396
5,607,230 A * 3/1997 Protz, Jr. ..... F21V 21/088 362/396
2013/0148366 A1* 6/2013 Adams, IV ..... F21V 21/088 362/396
2016/0341377 A1* 11/2016 Eddins ..... F21V 21/005

* cited by examiner

*Primary Examiner* — Kyle J. Walraed-Sullivan

(57) ABSTRACT

An apparatus for attachment to a gutter system that includes a mounting assembly and a light fixture. The mounting assembly including a light mount and capable of being fixedly attached to a gutter. The light fixture including at least one section for receiving the light mount.

7 Claims, 58 Drawing Sheets

DEBRIS EJECTOR FOR ROOF GUTTER SYSTEMS

BACKGROUND

In a downpour, a clogged roof gutter can send a cascade of water down the side of a house, making canyons of flowerbeds and saturating a home's foundation. Clean gutters protect your siding and landscape plantings and prevent thousands of dollars of damage to a home's foundation. Therefore, it is in a homeowner's best interest to clean gutters of leaves and debris to help prevent damage and to head off expensive water damage repairs to a home.

Gutters should be cleaned at least once a year—twice a year if you have overhanging trees and more often if big storms are regular occurrence in the area of the home. The typical way to clean gutters is time-consuming and potentially dangerous as it entails donning proper cloths and gloves, climbing a ladder with a small plastic scoop in hand and clearing and removing leaves and debris. Afterwards, the gutters and downspouts should be flushed with a garden hose. If climbing ladders is not a task a homeowner can handle, a professional can be hired to do the job at a large expense.

A homeowner can slow clogging by installing gutter covers in the form of mesh screens, clip-on grates, or porous foam. However, these gutter covers also need maintenance, which is also time-consuming and potentially dangerous, at regular intervals to keep them clear.

SUMMARY

The disclosed technology is a debris ejector for roof gutters that is designed in such a way that any debris caught in a water flow descending from a peaked or slanted roof can be directed over and then ejected from the debris ejector while the water flow is directed into the roof's gutter system. This saves time, money and avoids the use of a ladder.

In one implementation, an apparatus for ejecting debris from a roof can comprise an ejector assembly, the ejector assembly including a nose section and a rail section, the nose section including a first wall, the rail section including a second wall, the first wall and the second wall forming a water funnel. In some implementations, the first wall and the second wall can be connected through a chamfered cross-member.

In some implementations, the apparatus can further comprise a finger section, wherein the finger section is capable of receiving a water flow from a roof, the finger section including speed bumps for slowing a speed of the water flow.

In some implementations, the apparatus can further comprise a filter section, wherein the filter section is capable of receiving a water flow from the finger section, the filter section including a plurality of diverters configured to break water tension and further slow the speed of the water flow as the water flow flows over the plurality of diverters, the plurality of diverters being spaced apart from one another in such a way that a portion of the water flow is capable of draining into a gutter system from the filter section. In some implementations, the plurality of diverters can include teardrop diverters and wedge diverters. In some implementations, a configuration of the teardrop diverters and the wedge diverters can create gaps between the teardrop diverters and the wedge diverters increasing in size from top to bottom thereby creating a venturi effect as water is drained into the gutter system.

In some implementations the nose section can be capable of receiving a portion of the water flow from the filter section, the nose section include a flat section, the flat section capable of increasing a speed of the water flow so that, if any debris is caught in the water flow, the debris can be ejected from the ejector assembly. In some implementations, the nose section includes a bullnose, the bullnose capable of receiving a water flow from the flat section, the bullnose allowing the water flow to flow over the bullnose and into the water funnel. In some implementations, the water funnel is capable of receiving a water flow from the bullnose, wherein the water flow directed into the water funnel is emptied into the gutter system.

In some implementations, the apparatus can further comprise the finger section can include a plurality of fingers along a back edge of the screen section, the plurality of fingers being flexible and allowing the plurality of fingers to conform a roof surface.

In some implementations, the apparatus can further comprise a mounting assembly, the mounting assembly can include a hinge that pivotally connects the mounting assembly to the ejector assembly allowing the ejector assembly to move between a first position and a second position. In some implementations, the mounting assembly can be fixedly attached to a gutter.

In some implementations, the apparatus can further comprise a mounting assembly, the mounting assembly being part of the rail section. In some implementations, the mounting assembly can be attached to the gutter system.

In some implementations, the apparatus can further comprise a flat section, wherein the flat section is capable of receiving a water flow from the finger section, the flat section is capable of receiving roofing shingles. In some implementations, the nose section can be capable of receiving a portion of the water flow from the filter section, the nose section include a flat section, the flat section capable of increasing a speed of the water flow so that, if any debris is caught in the water flow, the debris can be ejected from the ejector assembly. In some implementations, the nose section can include a bullnose, the bullnose capable of receiving a water flow from the flat section, the bullnose allowing the water flow to flow over the bullnose and into the water funnel. In some implementations the water funnel can be capable of receiving a water flow from the bullnose, wherein the water flow directed into the water funnel is emptied into the gutter system.

In some implementations, a pole apparatus can comprise a rod; a pivot mechanism; pivot pin; and a pivot hook, the pivot hook including detents. In some implementations, a pole apparatus can comprise a rod; a pivot mechanism; a pivot pin; a pivot hook; and a smartphone attachment mechanism.

In some implementations, the ejector assembly can include a light mount. The light mount capable of receiving a light fixture. In some implementations, the light mount can include a tee section and the at least one section can be a tee receiver guide. In some implementations, the light fixture can include a light strip having a lens and LED lights. In some implementations, the lens can be clear or colored and the LED can be a white light or capable of changing colors. In some implementations, the light fixture can be powered and controlled using one or more of the following: an AC plug, a light switch, a timer/photo-sensor, a timer/photo-sensor/wireless sensor, a cellphone app, a wireless remote controller, a battery, and a solar panel. In some implementations, the light fixture can include an LED strip and an LED sleeve wherein the LED strip is inserted into the LED sleeve and attached to the light mount.

The advantages of the disclosed technology include: less cleaning of a home's gutter system, better water flow and less blockages for the gutter system, less opportunity for mold and mildew to grow, less chance of combustible material to accumulate in the gutter system and less chances for pest, e.g., insects, small animals or birds to nest within the gutter system. Additionally, with the use of the smartphone attachment mechanism or camera attachment mechanism, a home owner can visually verify the health of the gutter system in an easy and safe manner.

DETAILED DESCRIPTION OF THE INVENTION

Figure 1:
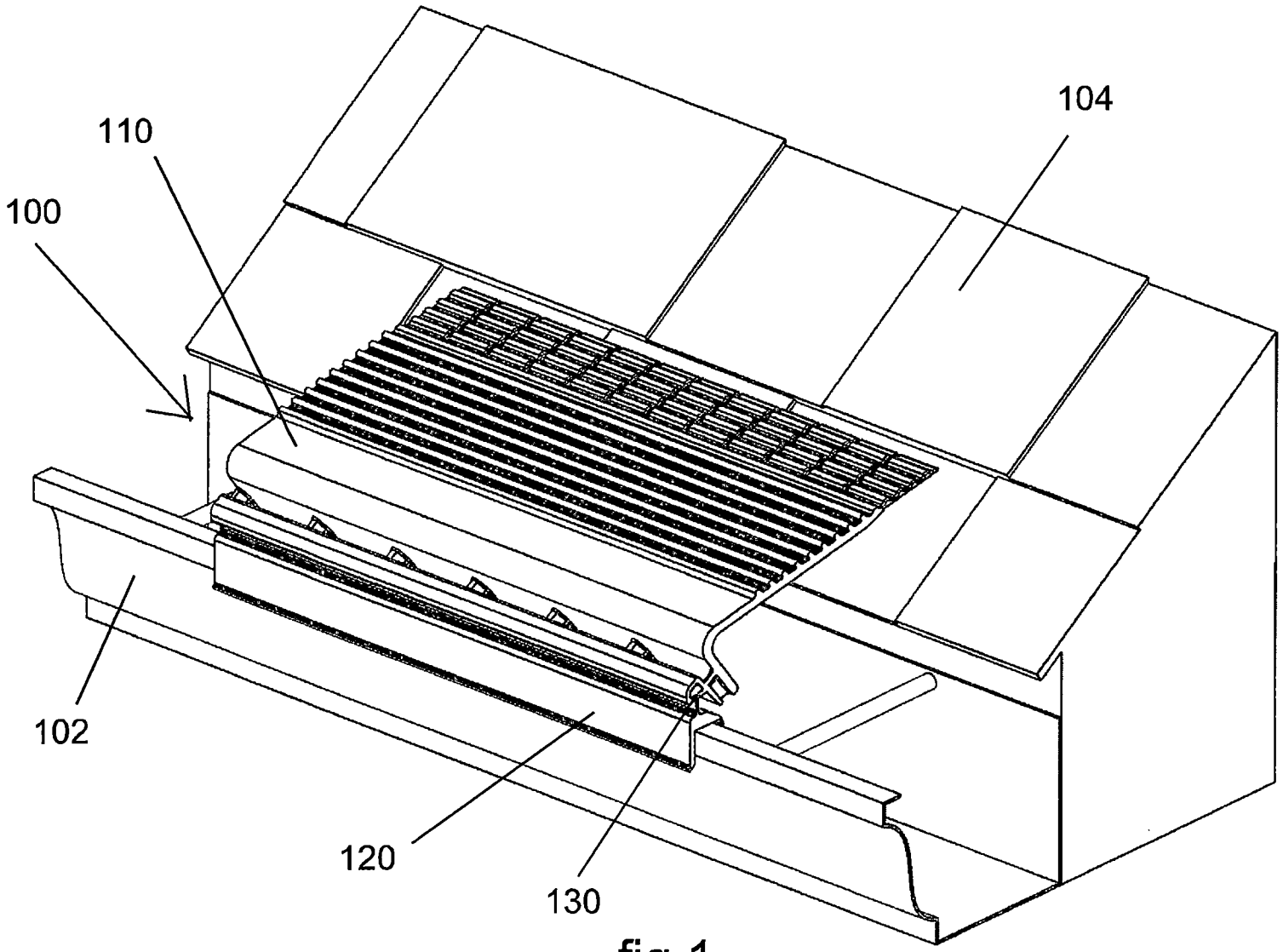
FIG. 1 is a perspective view of a debris ejector of the disclosed technology in a horizontal position of the disclosed technology.
Figure 2:
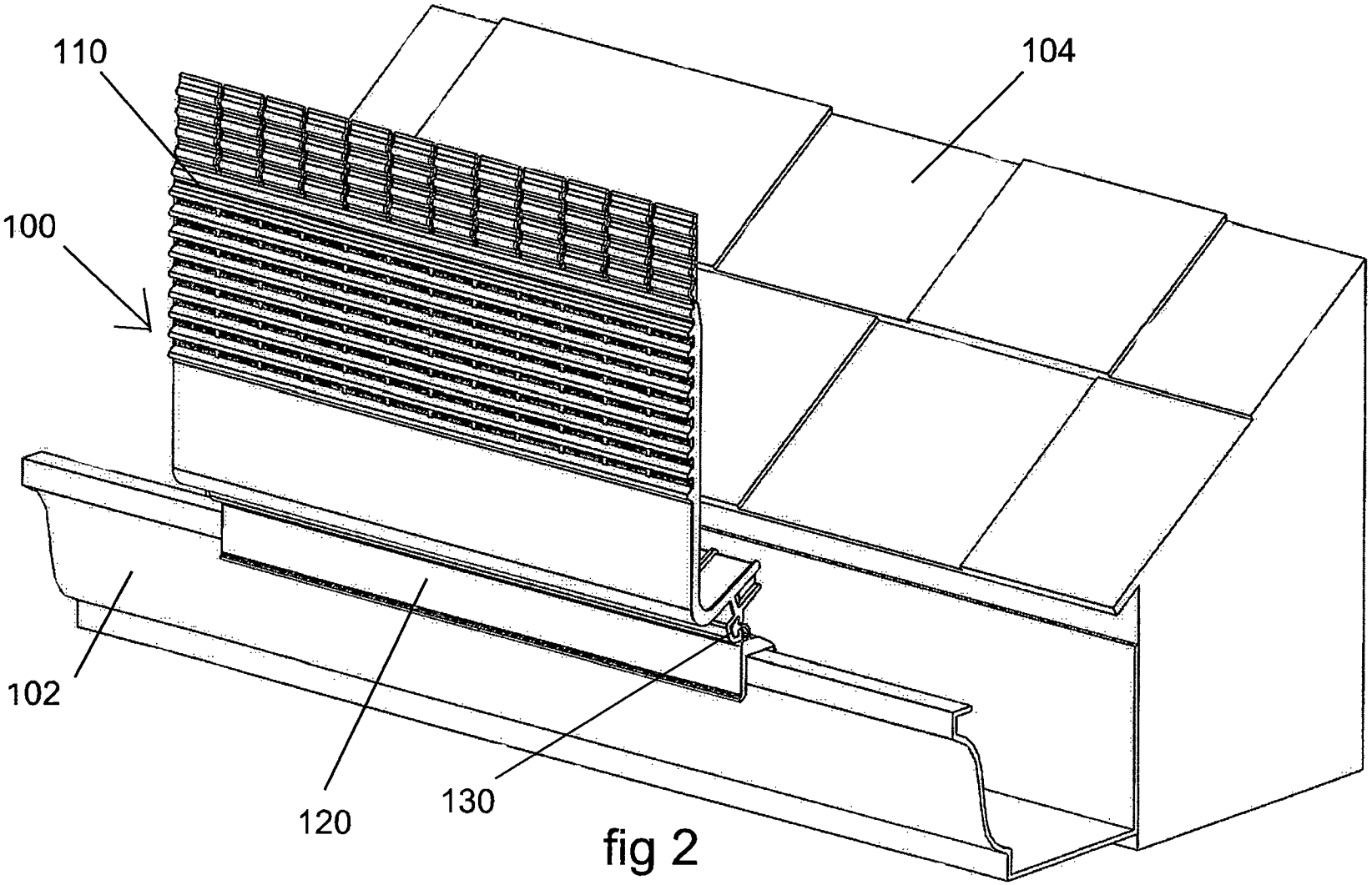
FIG. 2 is a perspective view of a debris ejector of the disclosed technology in a vertical position of the disclosed technology.
Figure 3:
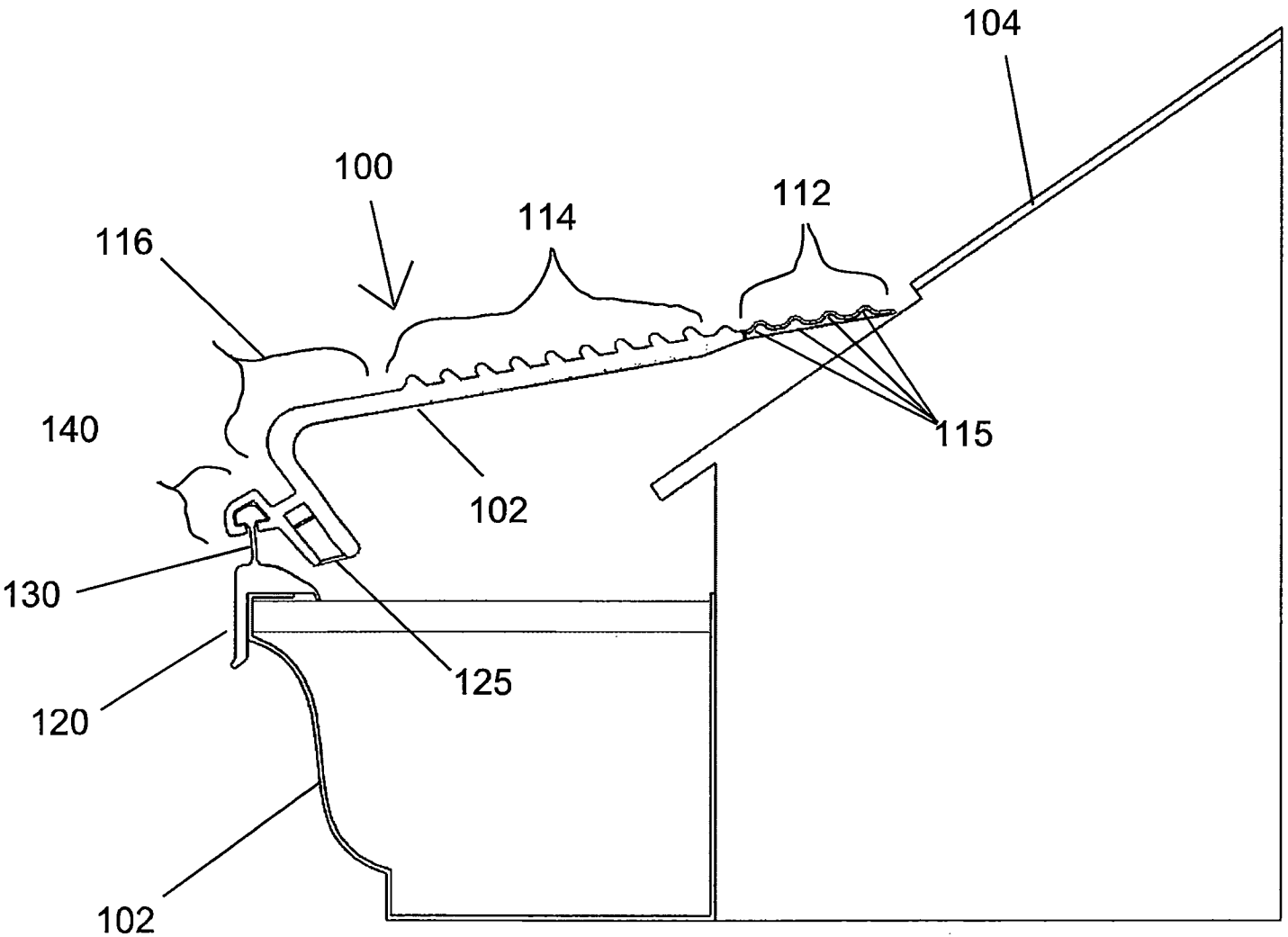
FIG. 3 is a side view of a debris ejector of the disclosed technology.
Figure 4:
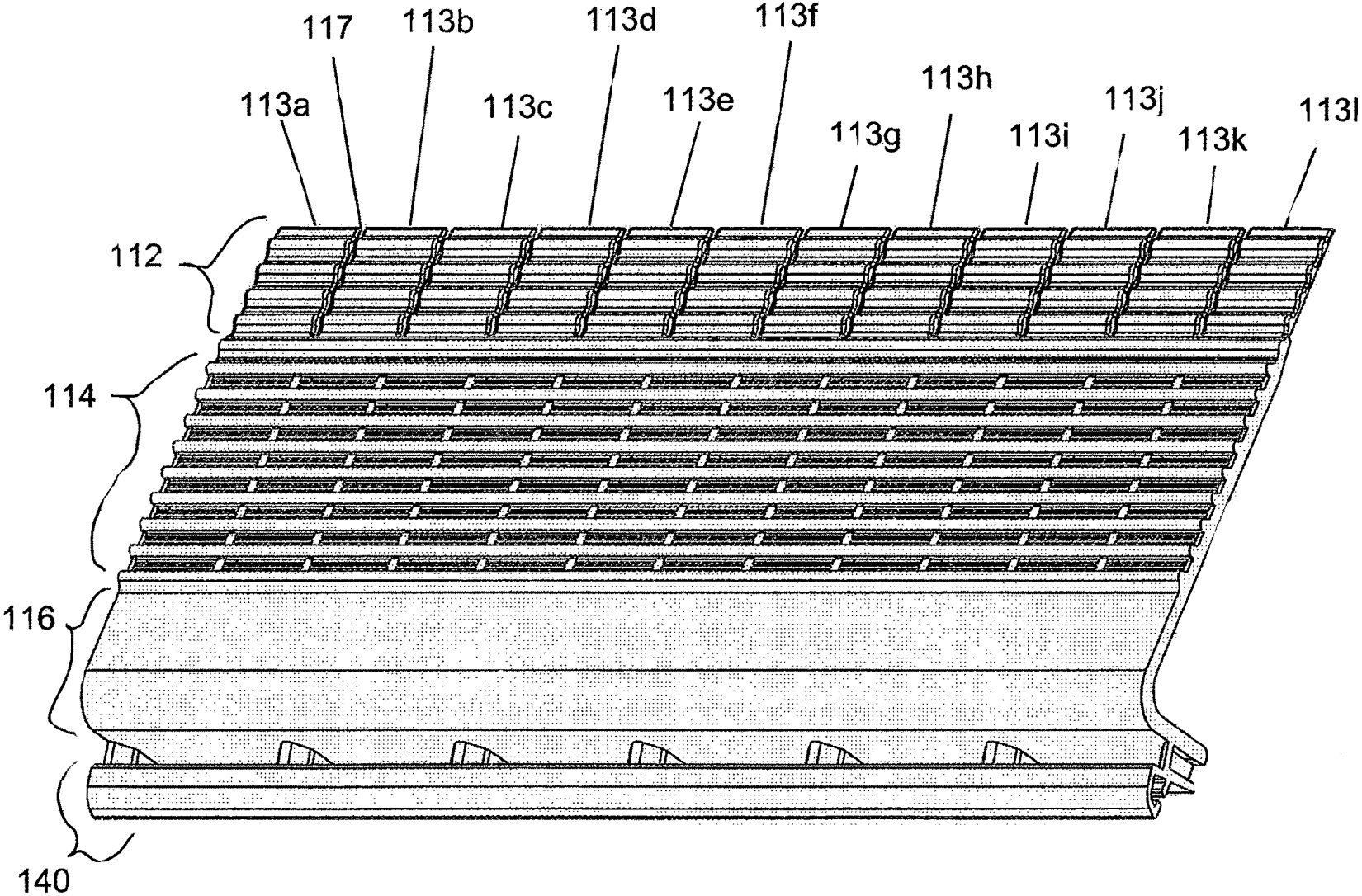
FIG. 4 is a perspective view of an ejector assembly of the disclosed technology.
Figure 5:
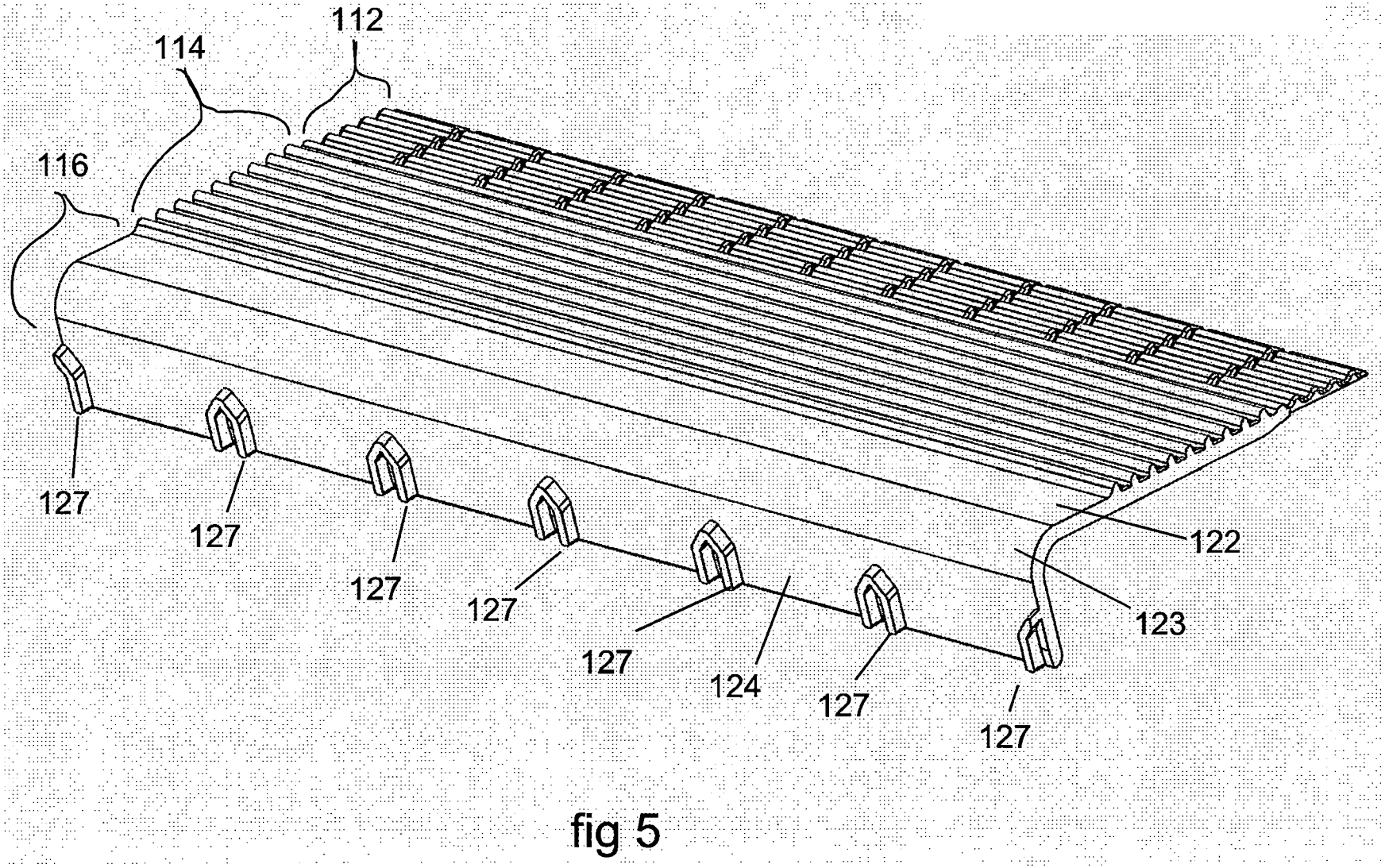
FIG. 5 is a perspective view of an ejector assembly of the disclosed technology without a rail assembly.
Figure 6:
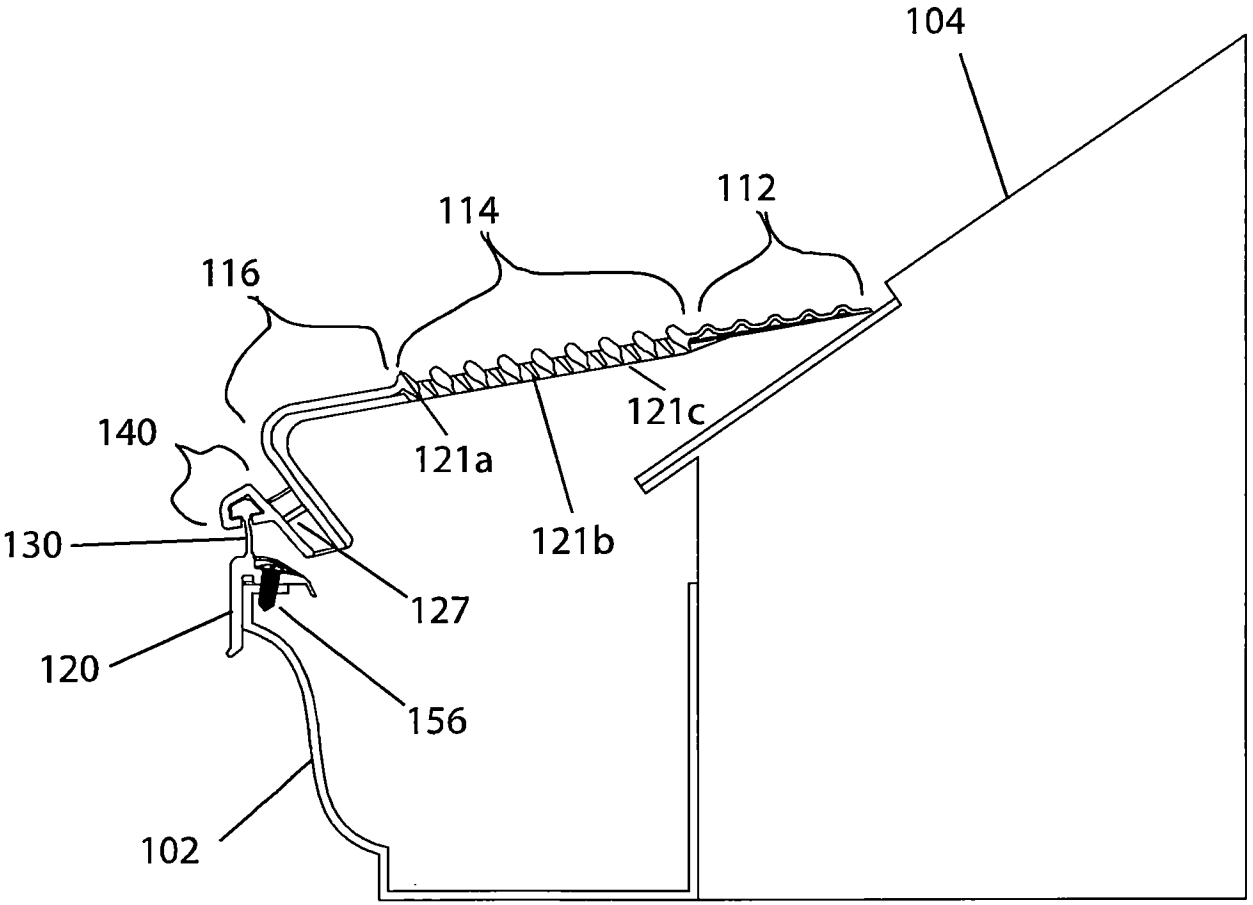
FIG. 6 is a side, cross-sectional view of a debris ejector of the disclosed technology.
Figure 7:
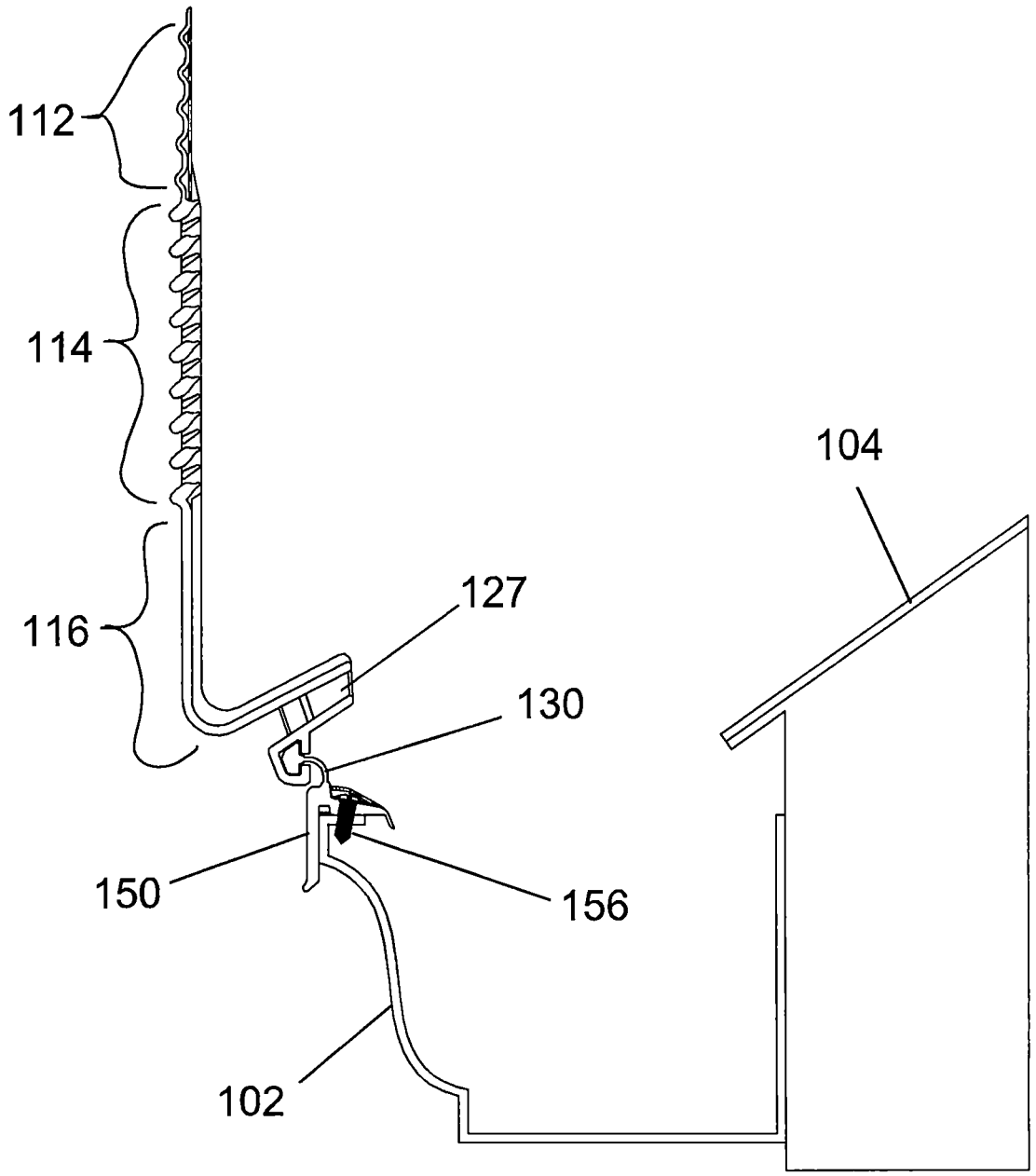
FIG. 7 is a side, cross-sectional view of a debris ejector of the disclosed technology in a vertical position.
Figure 8:
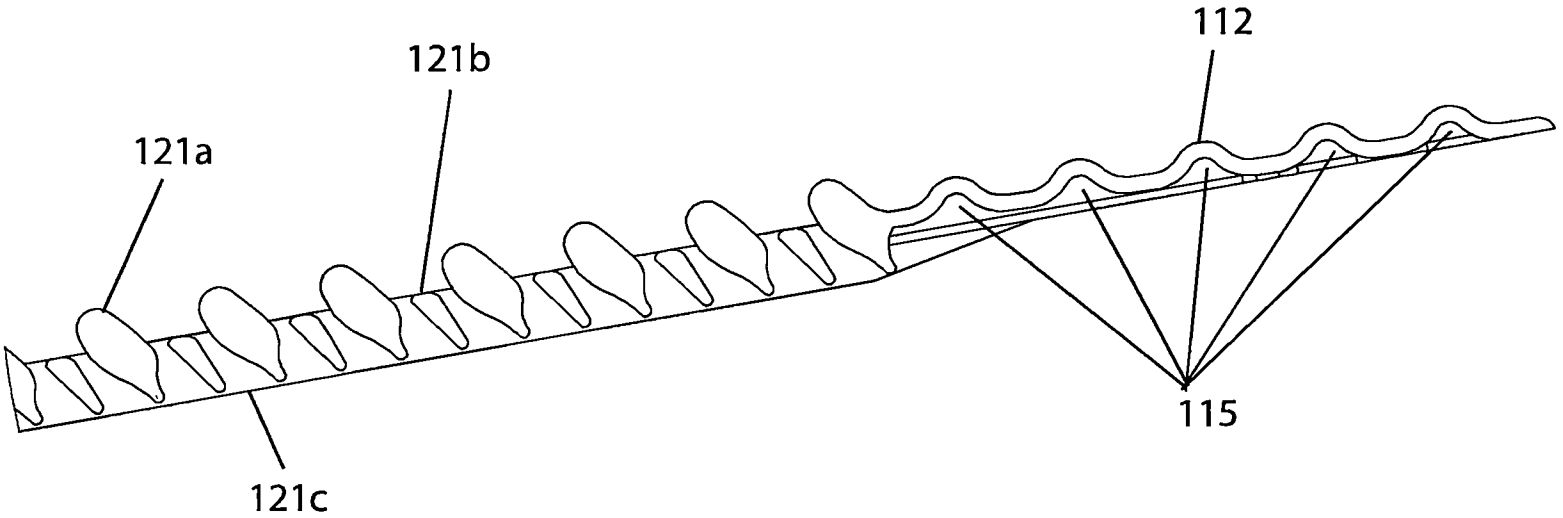
FIG. 8 is a side, cross-sectional view of a finger section and a filter section of the disclosed technology.
Figure 9:
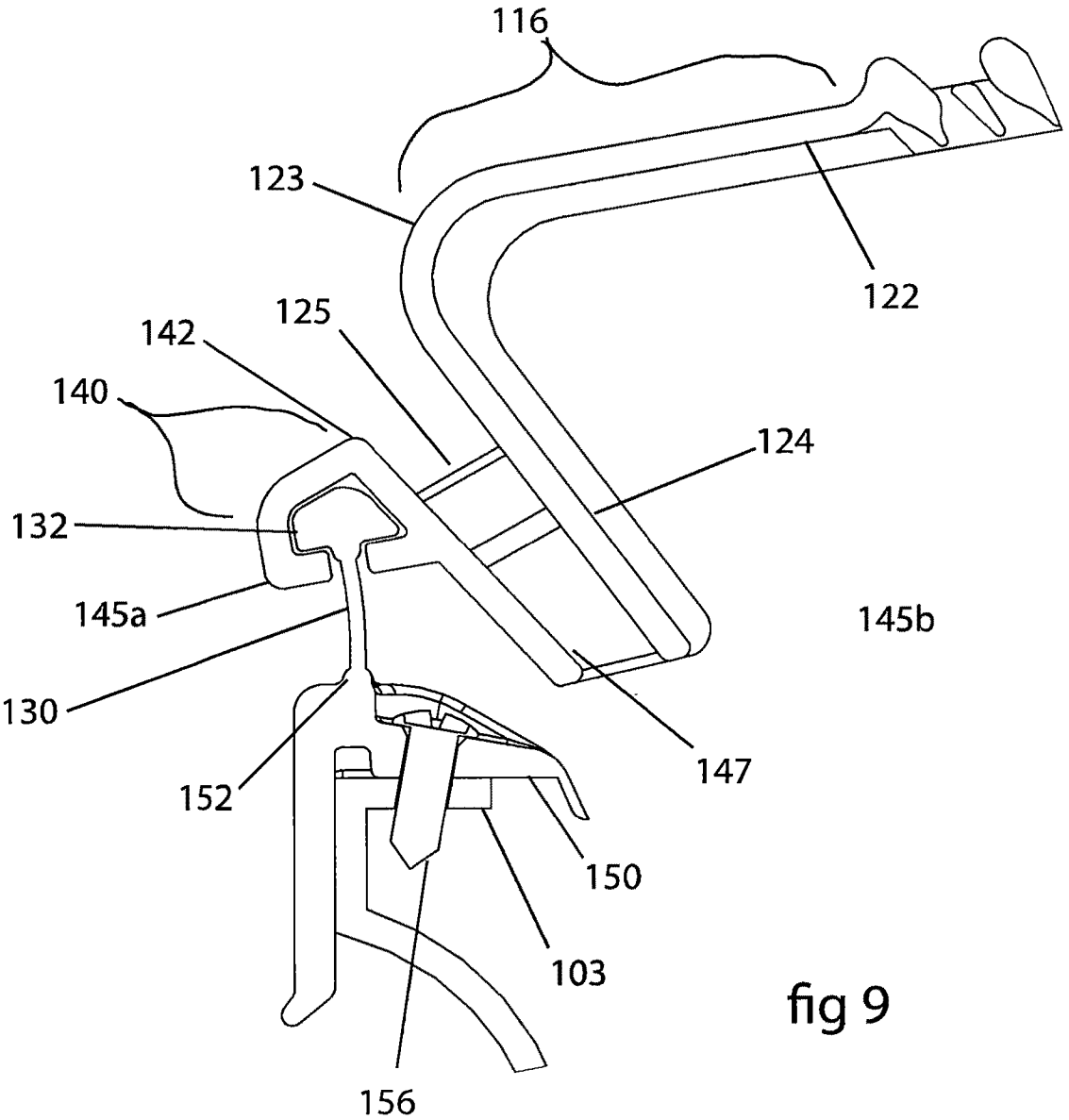
FIG. 9 is a side, cross-sectional view of a nose section, a rail section and mounting assembly of the disclosed technology.
Figure 10:
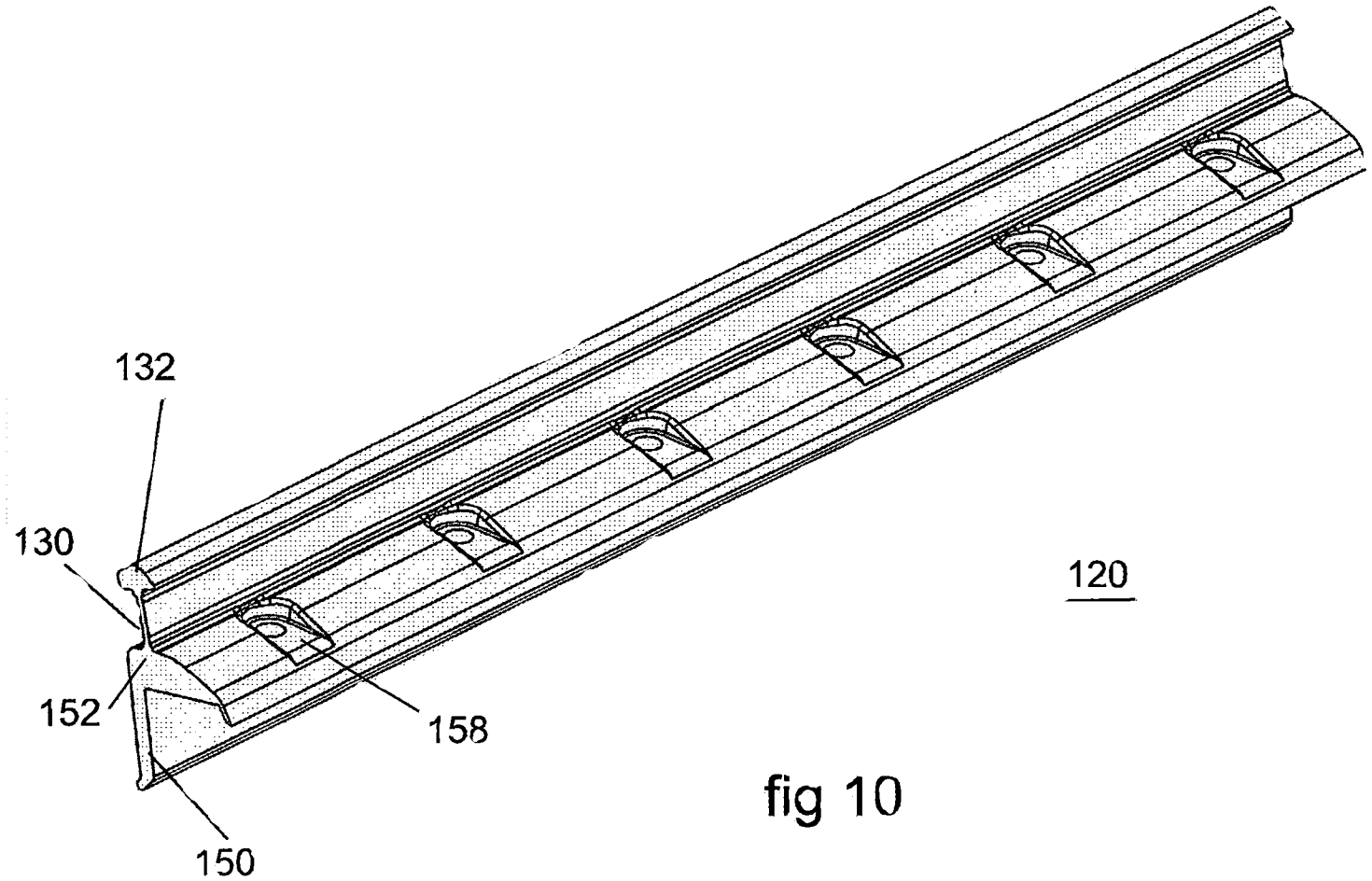
FIG. 10 is a perspective view of a mounting assembly of the disclosed technology.
Figure 11:
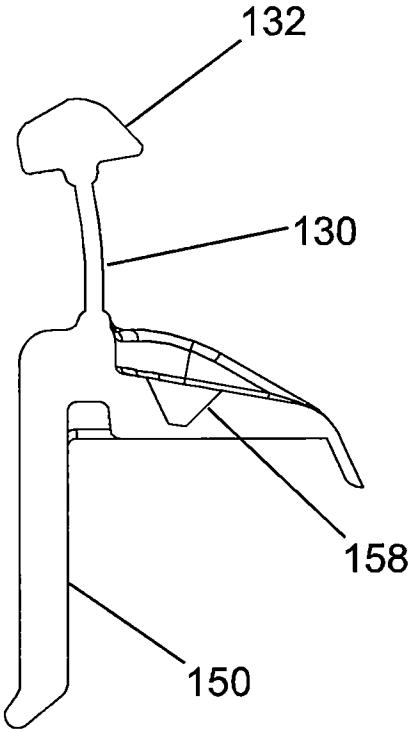
FIG. 11 is a side, cross-sectional view of a mounting assembly of the disclosed technology.

The disclosed technology relates to a debris ejector for a roof gutter system. Specifically, the debris ejector is designed so that debris that normally collects in a gutter system can be passed over a surface of the debris ejector and be ejected from the roof.

As shown in FIGS. 1-11, a debris ejector 100 can be installed on a gutter 102 connected to a roof 104. The debris ejector 100 can include an ejector assembly 110 and a mounting assembly 120. The ejector assembly 110 and the mounting assembly 120 can be movably connected to each other with a hinge 130. The hinge 130 allows the debris ejector 100 to move from a first position, e.g., a horizontal position, shown in FIG. 1, to a second position, e.g., vertical position, shown in FIG. 2. The first position allows debris to be ejected from the ejector assembly 110 and the second position allows for a smartphone or camera to inspect the inside of the gutter, as will be described further below.

In some implementations, the ejector assembly 110 can be a single unit formed from an injection molding process using polymers, thermoplastics, thermosets, elastomers and combinations thereof, e.g., including but not limited to, polyester, polyphenylene, polypropylene, polystyrene and polyvinyl. In other implementations, the ejector assemblies can be made from malleable metallic materials and/or other plastic compositions and components. In some implementations, a slip agent can be adhered to a surface of the ejector assembly so that the surface can have low friction allowing debris to easily be blown from a surface of the assembly.

The ejector assembly 110 of the debris ejector 100 can include finger section 112, a filter section 114, a nose section 116 and a rail section 140.

In some implementations, the finger section 112 can include a plurality of self-adjusting fingers 113*a-l*. The plurality of self-adjusting fingers 113*a-l* are capable of resting on or in close proximity to the roof 104. In use, the self-adjusting fingers 113*a-l* allow water and debris to flow from a roof surface to the filter section 114. In some implementations, the self-adjusting fingers 113*a-l* can include speed bumps 115 for slowing water flow from the roof 104. These speed bumps can also act as rollers allowing wind to be blown under any debris that is collected on a top surface of the finger section 112. The self-adjusting fingers 112 can also have gaps 117 between each of the adjacent fingers so as to act as a prefilter for the water flow.

In some implementations, the filter section 114 can be laid out in a grid pattern with a top surface of the filter section 114 being substantially flat and rectangular but other configurations are contemplated. The grid pattern of the filter section 114 allows water to flow onto and through the filter section 114 and allows any debris within the water flow to slide across a top surface of the filter section 114.

In some implementations, the filter section 114 can include a plurality of water diverters 121*a*, 121*b*. The water diverters 121*a*, 121*b* can be formed in many shapes and configurations but in this implementation, the water diverters 121*a*, 121*b* are shaped as teardrop diverters 121*a* and wedge diverters 121*b*. The tear drop diverters 121*a* and wedge diverters 121*b* are shaped so as water flows over the filter section 114, the water diverters 121*a*, 121*b* can create surface tension thereby allowing the waterflow to slow while passing over the top surface of the filter section 114.

Water inlets 121*c* can be formed between the diverters 121*a*, 121*b*. These water inlets 121*c* can increase in size from top to bottom so as to create a venturi effect which acts like a vacuum and can pull water from the top surface of the filter section 114 and allows any debris within the water flow to slide across a top surface of the filter section 114 and be ejected. Additionally, the water diverters 121*a*, 121*b* and the water inlets 121*c* can be angled backwards to increase the venturi effect.

In some implementations, the nose section 116 can be formed as a flat surface 122 that extends from the filter section 114. The flat surface 116 can be used to increase water flow speed and propel debris from the ejector assembly 100. The nose section further includes a large surface tension bullnose 123 that transitions the flat surface to a bull-nose wall 124.

In some implementations, the rail section 140 can include a front ledge 142 and the front ledge can be positioned along the rail section 140 of the ejector assembly 100, but other configurations are contemplated. The front ledge 142, when actuated by a poling tool (described below) can act as a lever and allow the debris ejector 100 to be moved from the first position to the second position and vice versa. In use, a user can rotate the debris ejector 100 from the first position to a second position via a hinge 130.

The rail section 140 can also include a tee receiver guide 144 for receiving the hinge 130. That is, the tee receiver guide 144 can comprise fingers 145*a*, 145*b* for slidably receiving a tee section 132 of the hinge 130.

In some implementations, a rail wall 147 of the rail section and the bull-nose wall 124 of the nose section 116 can be connected by chamfered cross-members 127 allowing for a space between the rail wall 147 and the bull-nose wall 124 thereby forming a water funnel 125. The water funnel is capable of receiving water flow flowing over the bullnose 123 of the nose section 116. The water funnel 125 can be angled backwards so that water flowing over the nose section 116 can be directed into the gutter 102 and any debris from the water flow can be directed to the ground.

The mounting assembly 120 of the debris ejector 100 can include a gutter-mounting section 150 and a hinge-mounting section 152. The gutter-mounting section 150 can be an L-shaped mount for attaching to a gutter rail 103 of the gutter 102. The gutter-mounting section 150 can securely retain the debris ejector 100 to the gutter 102. e.g., with screws 156 positioned in screw location ribs 158, but other attachment mechanisms are contemplated, e.g., snap-on components. The hinge-mounting section 152 can project from the gutter-mounting section 430 at one end and cane be fixedly attached to the hinge 130 at the other end.

The hinge 130 can include a tee section 132. The hinge 130 can be constructed from a flexible material, e.g., a thermoplastic elastomer/rubber while the tee section 132 can be constructed from a solid material e.g., polymers, thermoplastics, thermosets and/or elastomers.

In some implementations, the gutter-mounting section 150, the hinge-mounting section 152, the hinge 130 and the tee section 132 can be integrally connected to one another through a co-extrusion process. For example, the gutter-mounting section 150, the hinge-mounting section 152, and the tee section 132 can be constructed from a solid material e.g., polymers, thermoplastics, thermosets, elastomers while the hinge 130 can be constructed from a flexible material, e.g., a thermoplastic elastomer/rubber. Other manufacturing processes are contemplated.

To assemble the debris ejector 100, the tee section 132 of the hinge 130 can be slidably received by the tee receiver guide 144. Once in place, the debris ejector 100 can be screwably mounted to the gutter 102. In some implementations, the ejector assembly 411 can be removed and replaced as needed.

Figure 12:
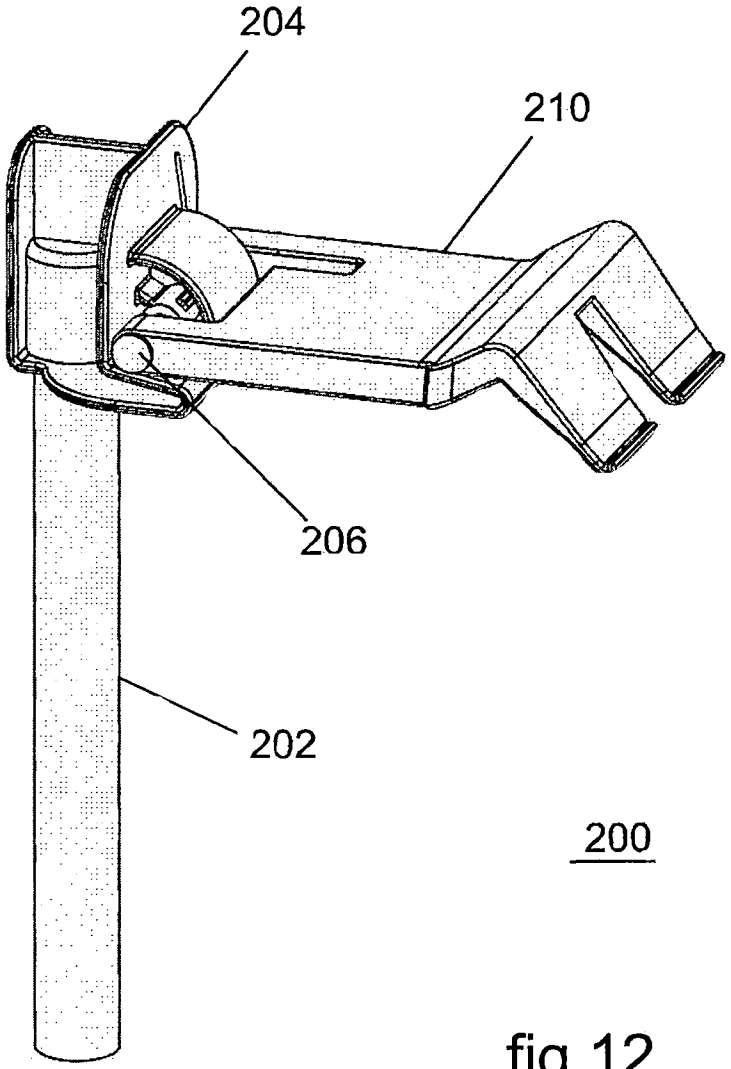
FIG. 12 is a perspective view of a poling device of the disclosed technology.
Figure 13:
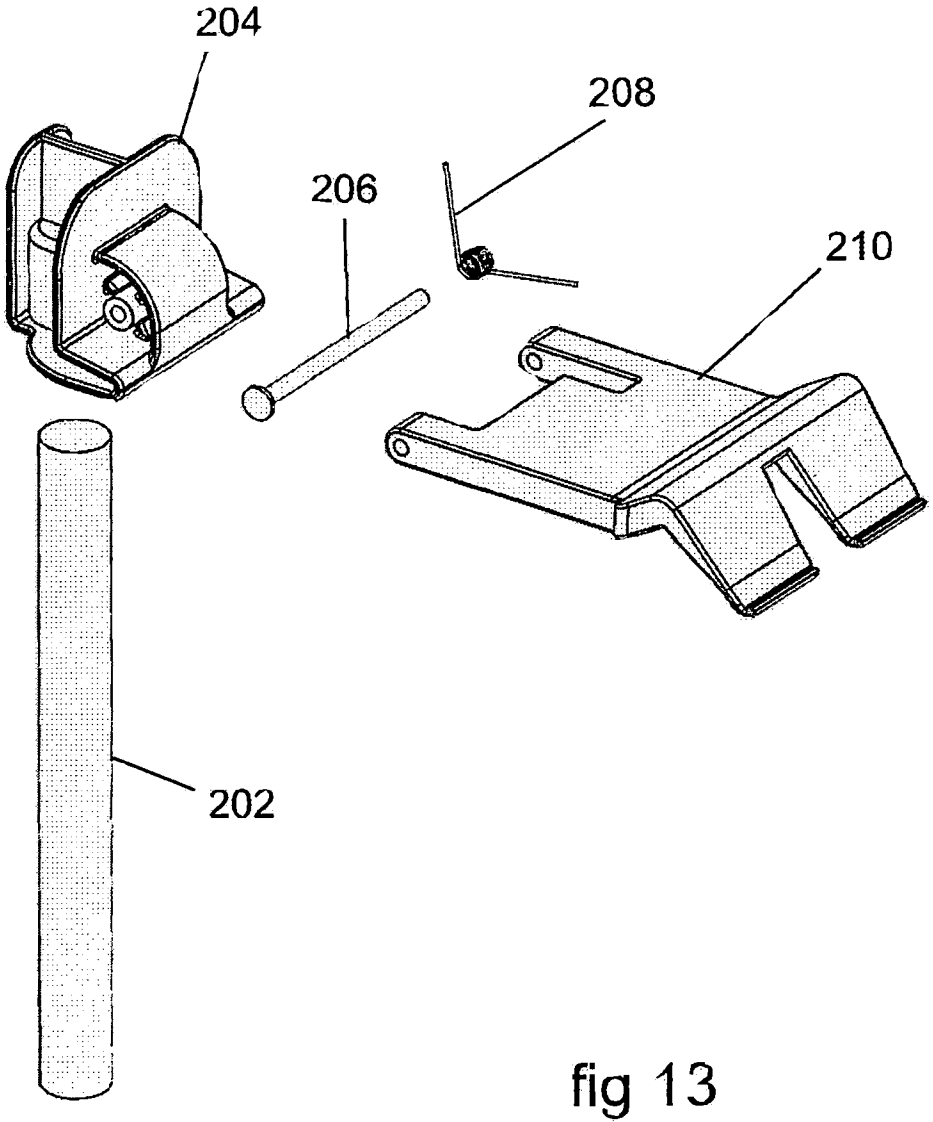
FIG. 13 is an exploded view of a poling device of the disclosed technology.
Figure 14:
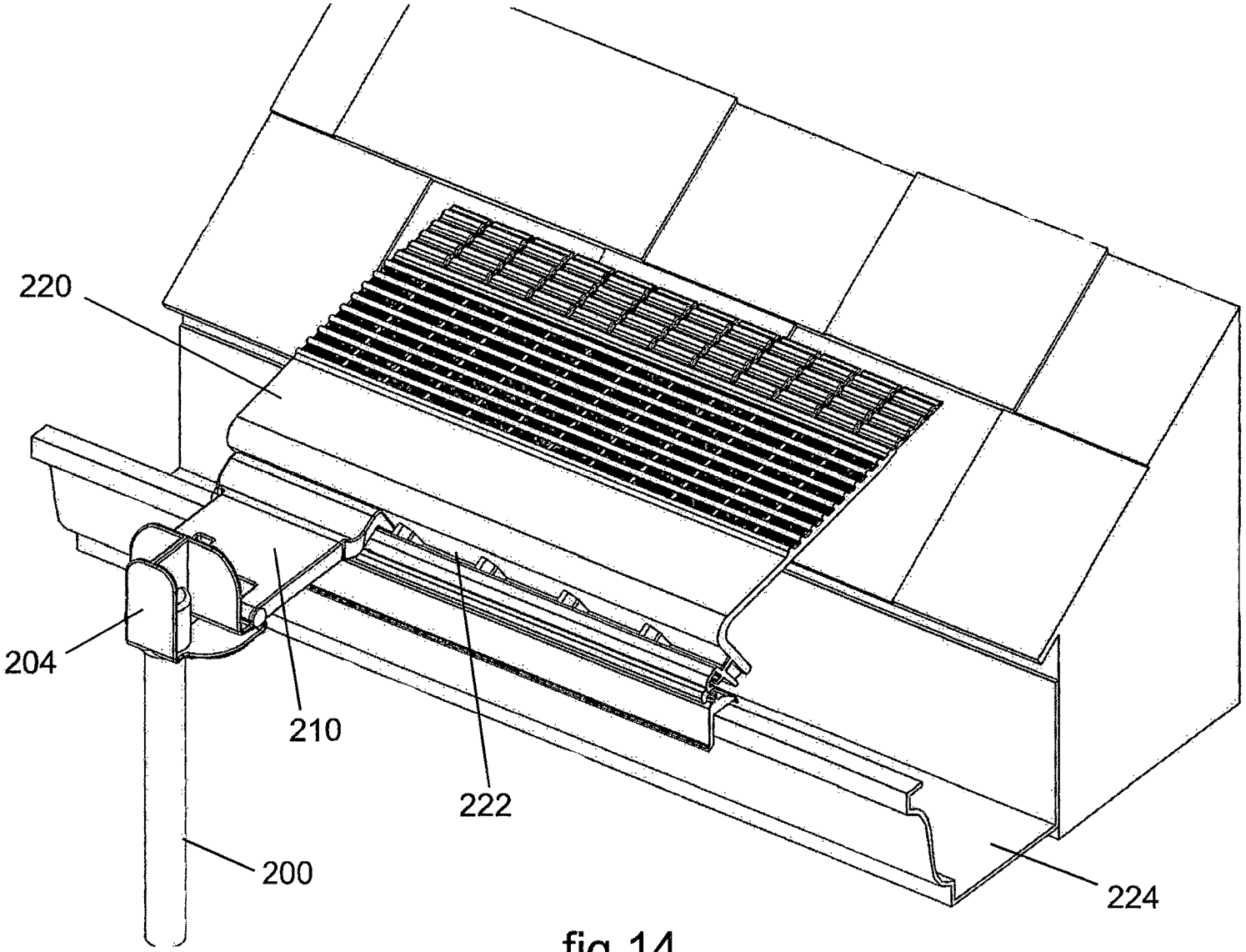
FIG. 14 is a perspective view of a poling device being used with a debris ejector.
Figure 15:
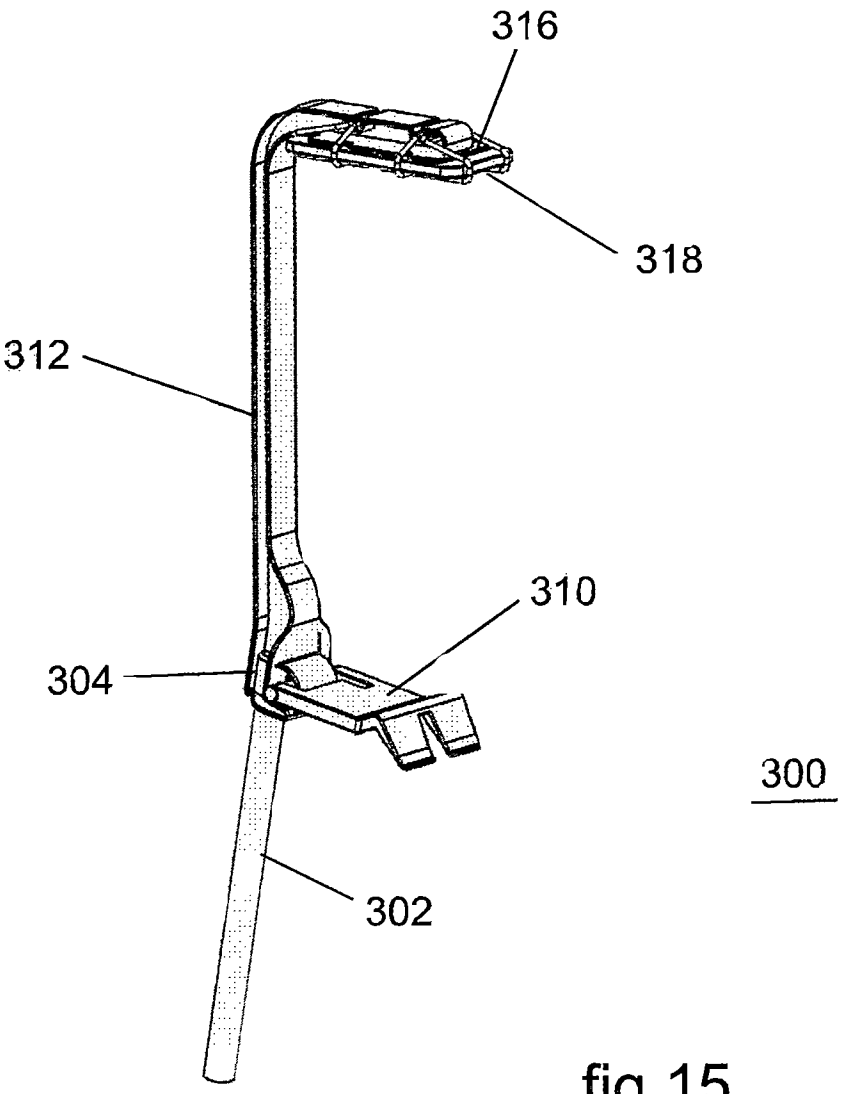
FIG. 15 is a perspective view of a poling device of the disclosed technology.

In some implementations, as shown in FIGS. 12-14, a poling tool 200 can used to rotate a debris ejector 220 from a gutter 224. The poling tool 200 can include a rod 202, a pivot mechanism 204, pivot pin 208 and a pivot hook 210. The pivot hook 210 can be moved between a first position and a second position. In use, the pivot hook 210 can be inserted into the water funnel 222 of the debris ejector 220. Once inserted, a user can apply downward pressure to the poling tool 200 so that the pivot hook is moved from the first position to the second position while allowing the debris ejector 220 to be rotated off the gutter 224 and into a vertical, cleaning position. Once the debris ejector 220 is placed in the vertical position most if not all of the debris will fall away from the debris ejector 220 and down to the ground. If some debris remains attached to the debris ejector 220, a stream of a garden hose can be directed at the debris ejector 220 for clearing any remaining debris. After the debris ejector 220 is cleaned out, the user can push the poling tool 200 in an upwards direction causing the debris ejector 220 to rotate back to a seated horizontal position.

In some implementations, as shown in FIGS. 15-21, a poling tool 300 can be used to rotate a debris ejector 320 from a gutter 324. The poling tool 300 can include a rod 302, a pivot mechanism 304, pivot pin 308, a pivot hook 310 and a smartphone attachment mechanism 312 (please note the smartphone attachment mechanism is capable of also attaching to a camera). The smart phone attachment mechanism 312 can include an L-shaped arm 313 that extends from the pivot mechanism 304. The smart phone attachment mechanism 312 can further include retention bands 314 and retention sockets for suspending a smartphone 318 from the L-shaped arm 313.

Figure 16:
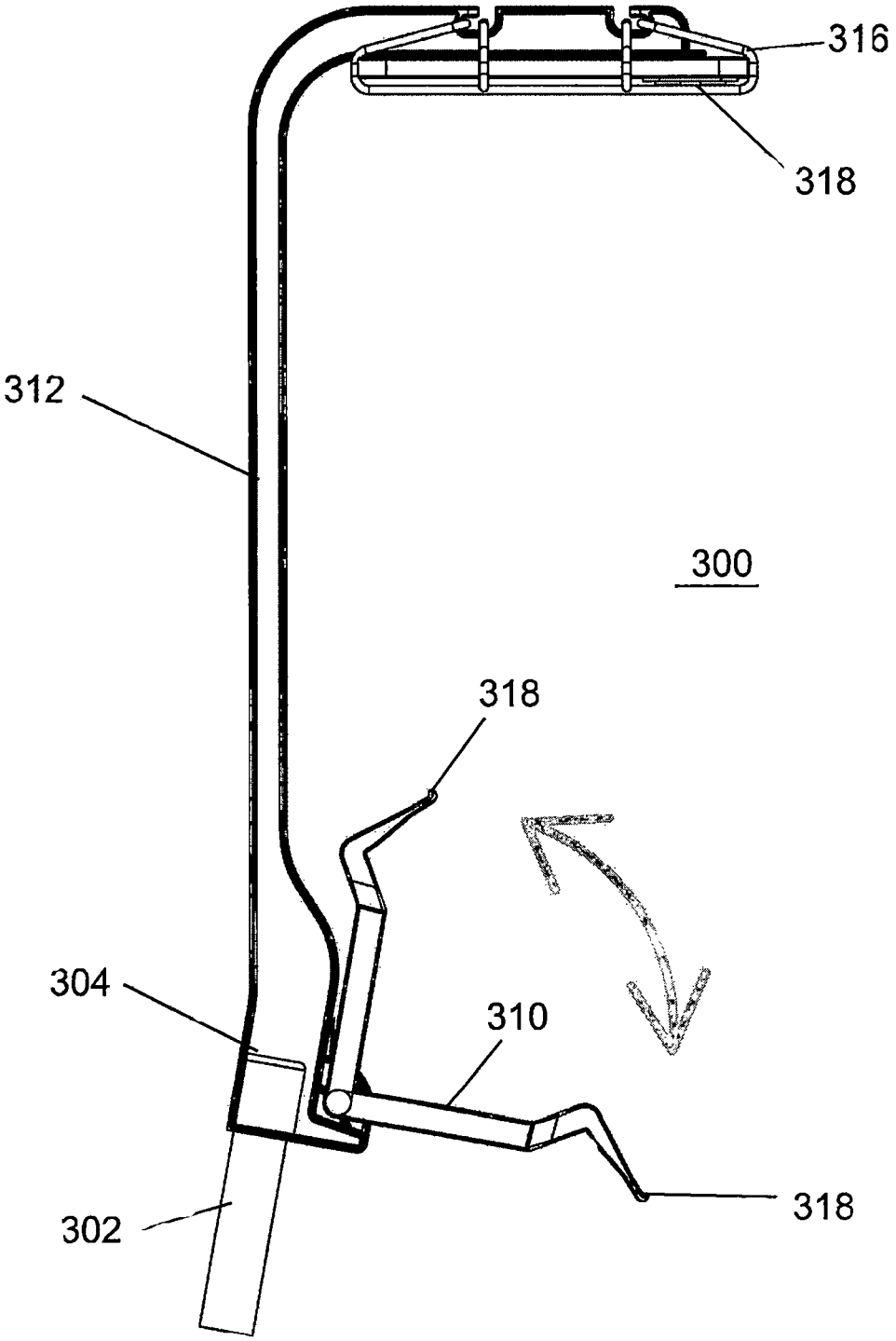
FIG. 16 is a side view of a poling device of the disclosed technology in open and closed positions.
Figure 17:
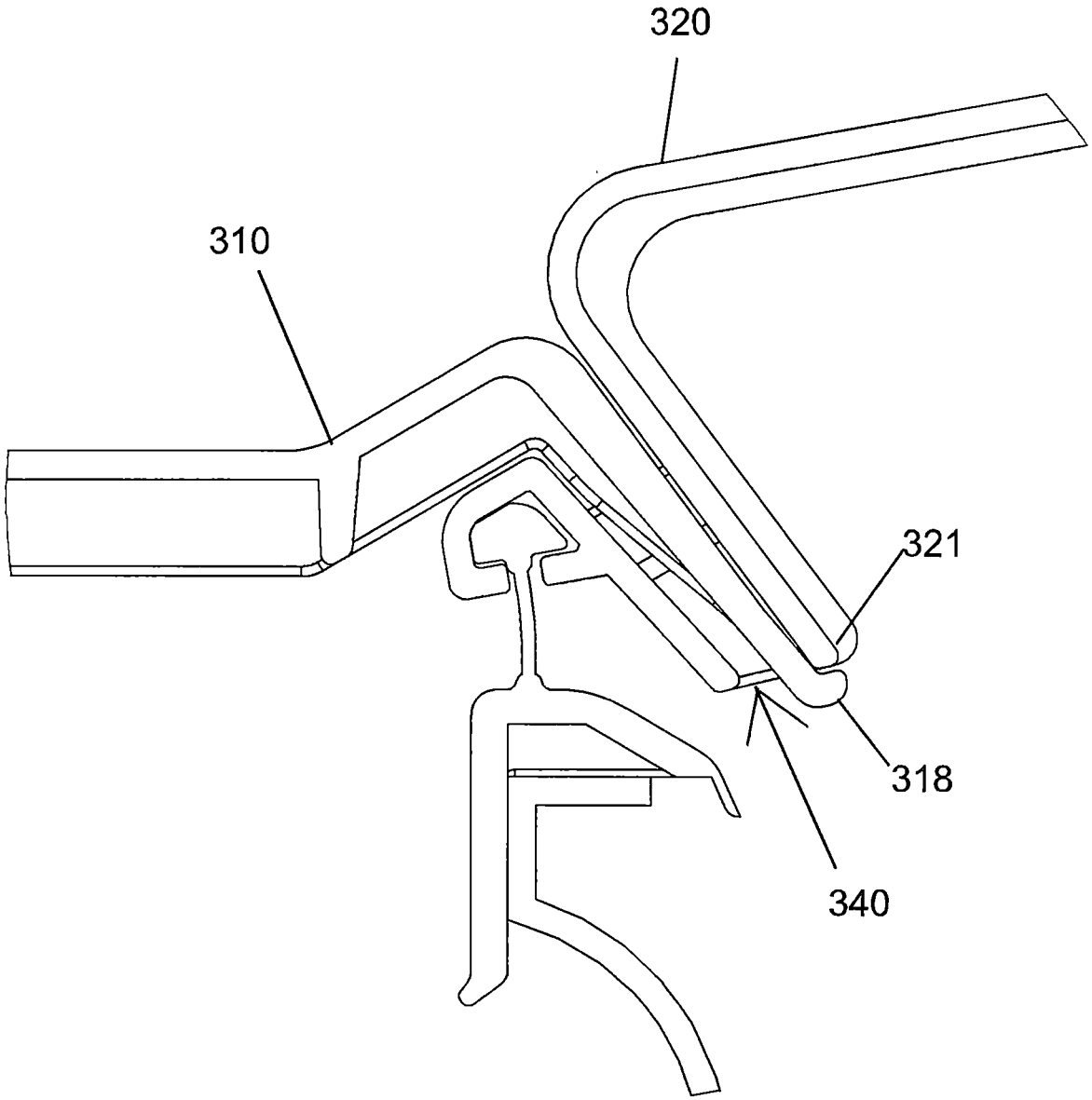
FIG. 17 is a side, cross-sectional view of a poling device being used with a debris ejector.
Figure 18:
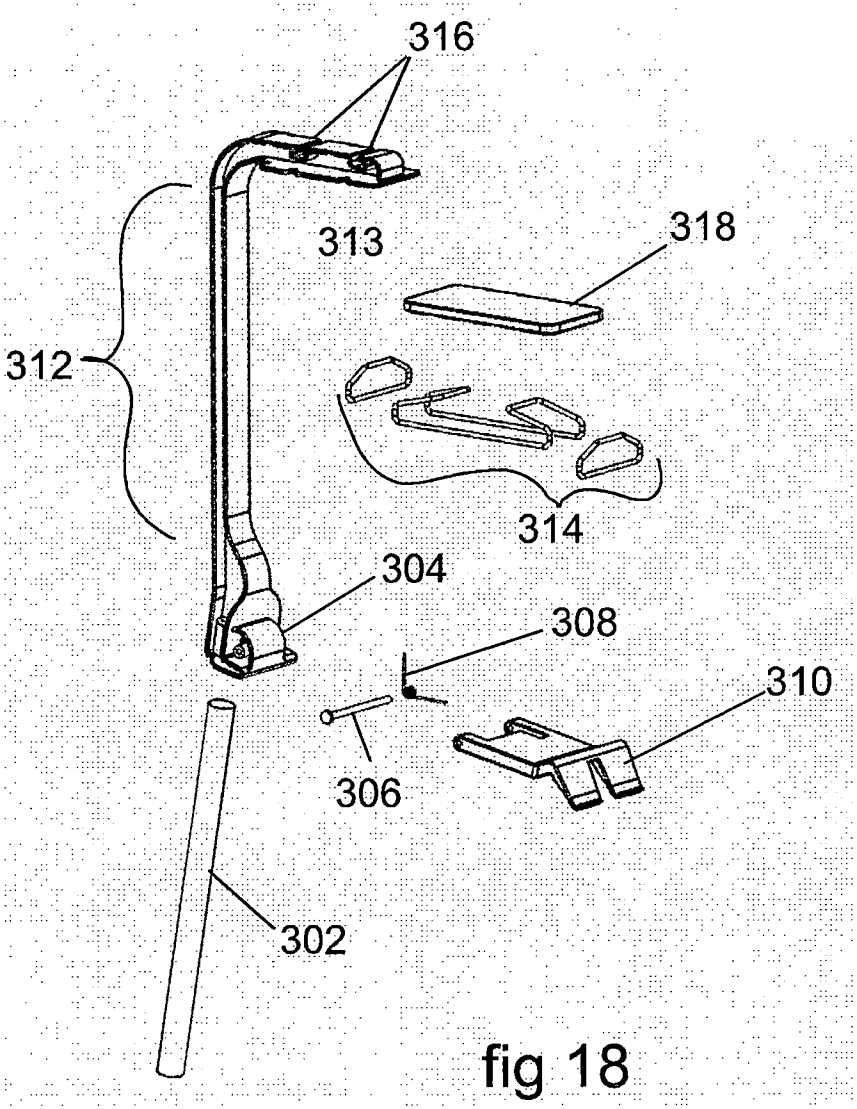
FIG. 18 is an exploded view of a poling device of the disclosed technology.
Figure 19:
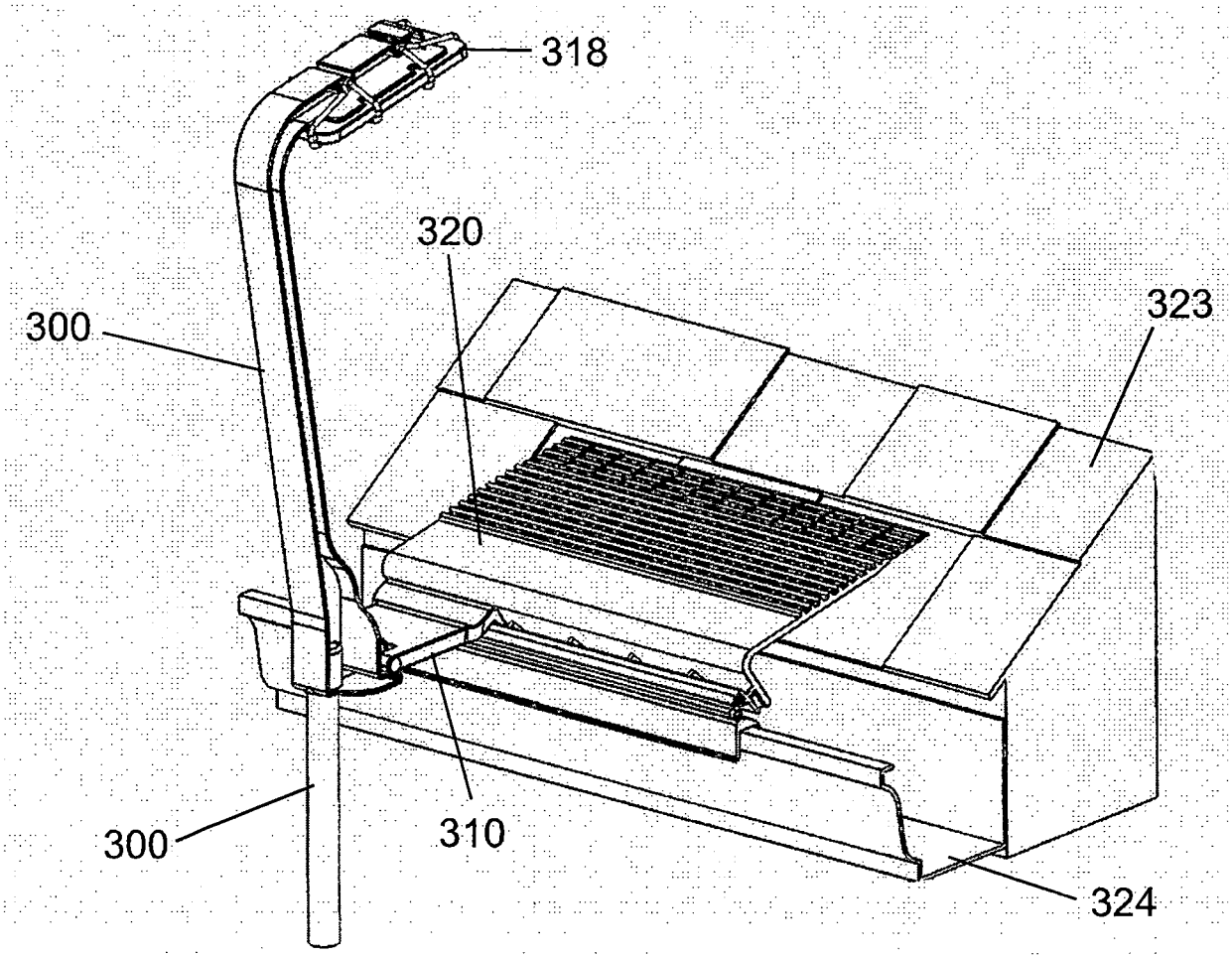
FIG. 19 is a perspective view of a poling device being used with a debris ejector.
Figure 20:
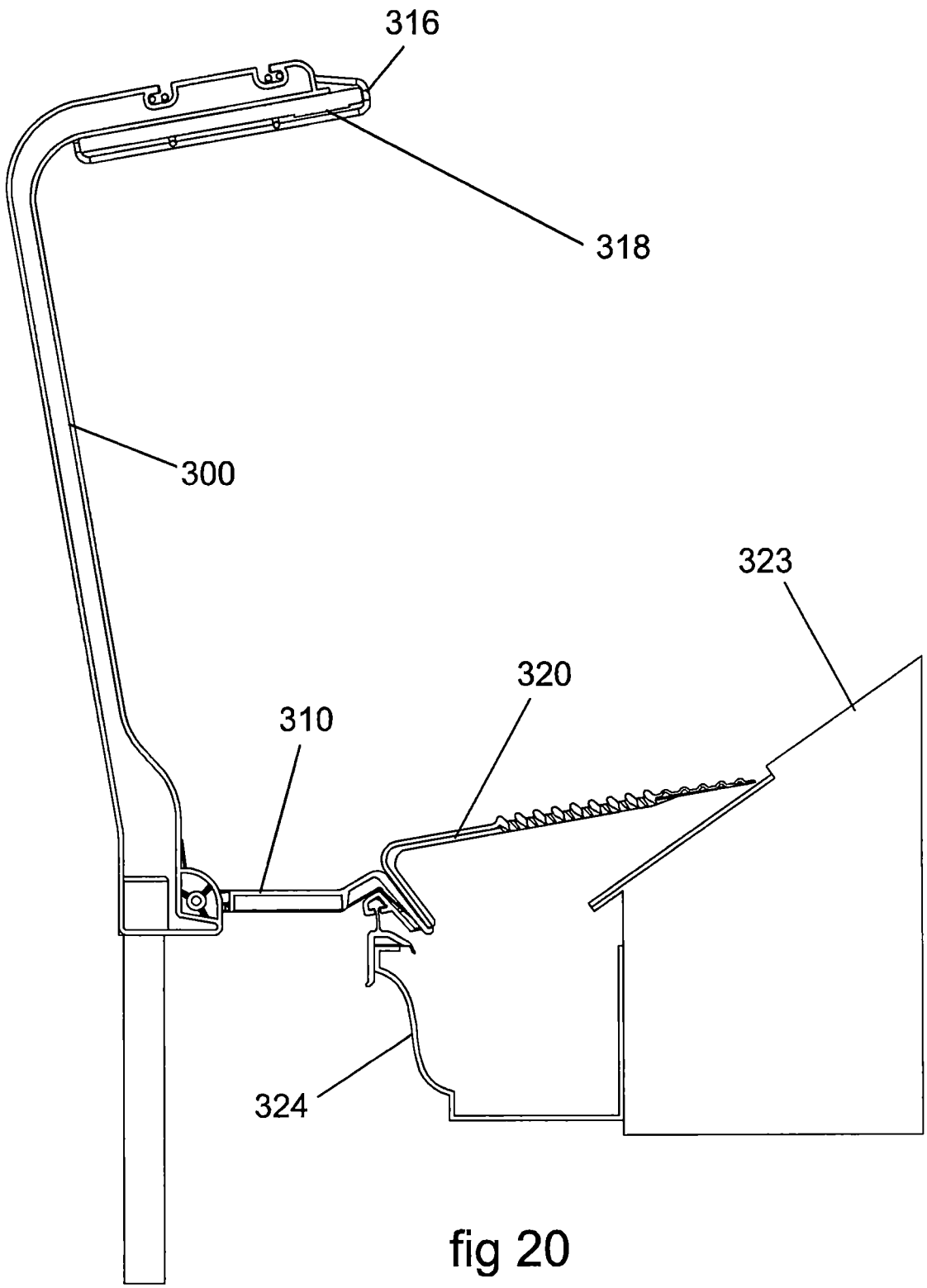
FIG. 20 is a side, cross-sectional view of a poling device being used with a debris ejector.

The pivot hook 310, as shown in FIG. 16 can pivot between a first position and a second position. In use, the pivot hook 310 is positioned to inside the water funnel 340. The pivot hook can include detents 318 that can engage a bottom portion of the bull-nose wall 321. Once inserted, a user can apply downward pressure to the poling tool 300 so that the pivot hook can pivot 90 degrees, and in turn, the debris ejector 320 can be rotated off the roof 323 and the gutter 324 and into a vertical, cleaning position. Once the debris ejector 320 is placed in the vertical position most if not all of the debris will fall away from the debris ejector 320 and down to the ground. If some debris remains attached the debris ejector 320, a stream of a garden hose can be directed at the debris ejector 320 for clearing any remaining debris. After the debris ejector 320 is cleaned out, the user can push the poling tool 300 in an upwards direction causing the debris ejector 320 to rotate back to a seated horizontal position.

Figure 21:
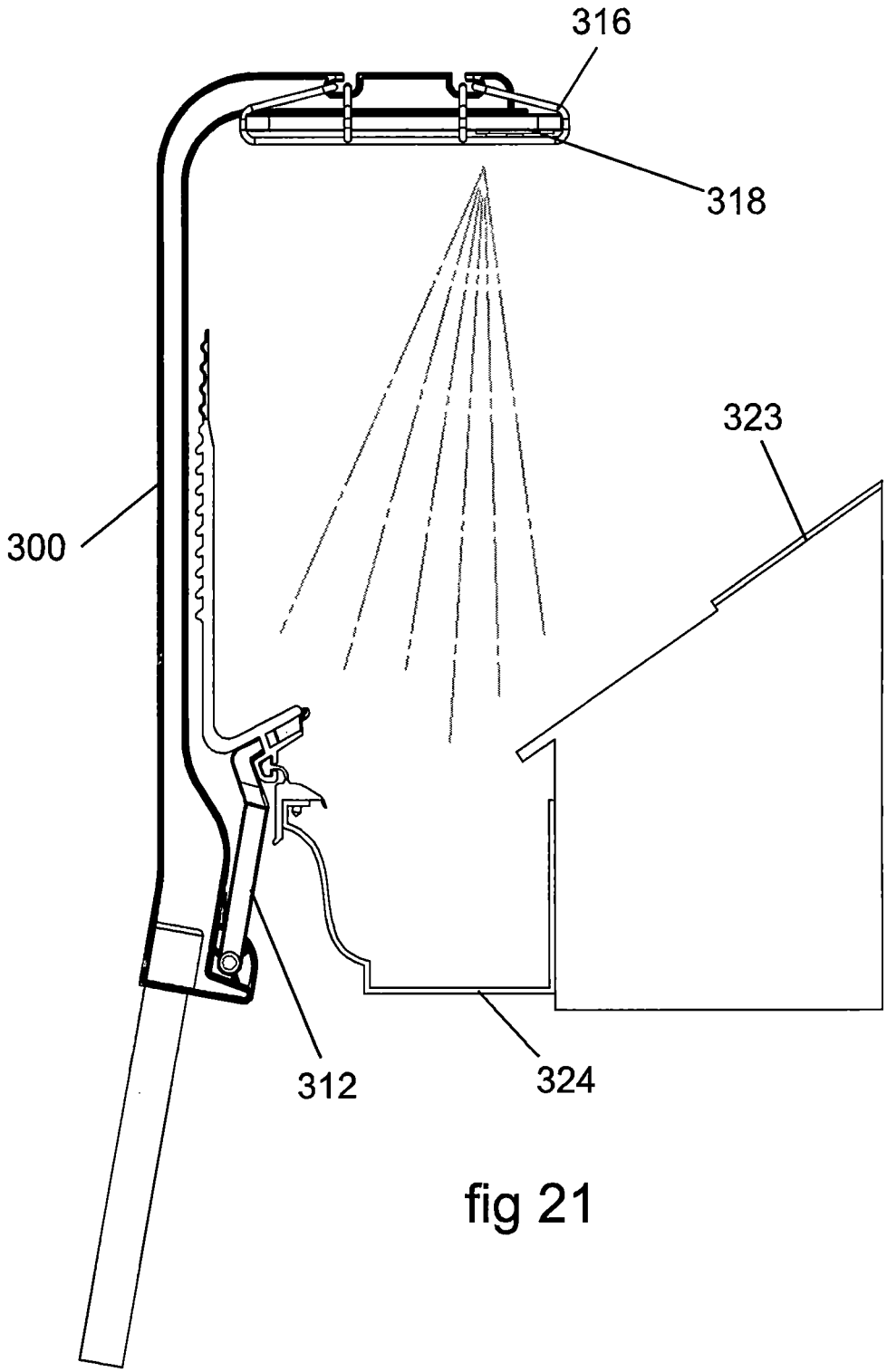
FIG. 21 is a side, cross-sectional view of a poling device being used with a debris ejector.

Additionally, as shown in FIG. 21, while the debris ejector 320 is placed in the vertical position, a light and camera on the smartphone 318 can be utilized to view the inside of the gutter 324 to ensure no debris is in the gutter 324.

In some implementations, the debris ejector 400 can be a single unit that does not hinge and can be formed from an injection molding process using polymers, thermoplastics, thermosets, elastomers and combinations thereof, e.g., including but not limited to, polyester, polyphenylene, polypropylene, polystyrene and polyvinyl. In other implementations, the ejector assemblies can be made from malleable metallic materials and/or other plastic compositions and components.

Figure 22:
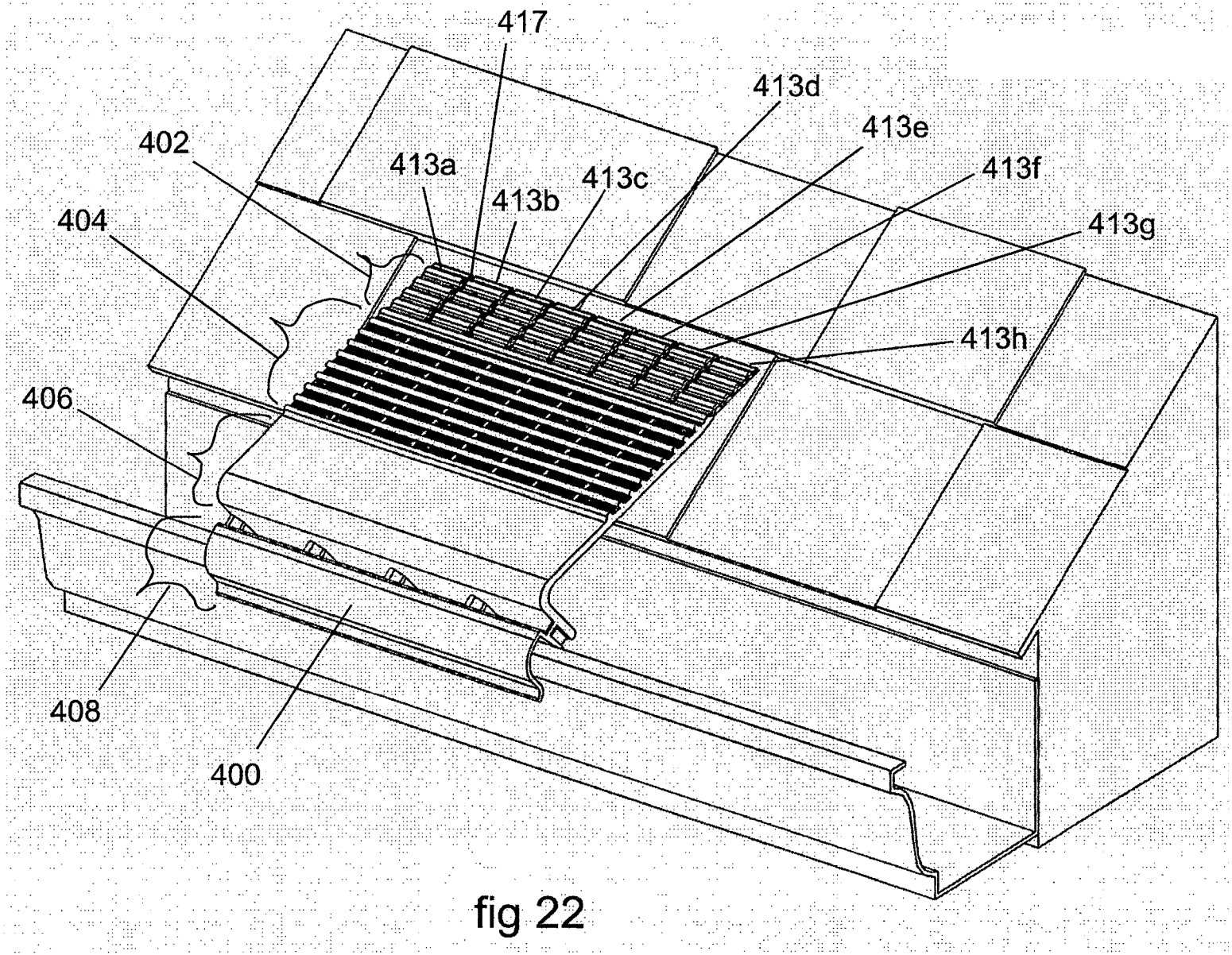
FIG. 22 is a perspective view of a debris ejector of the disclosed technology.
Figure 23:
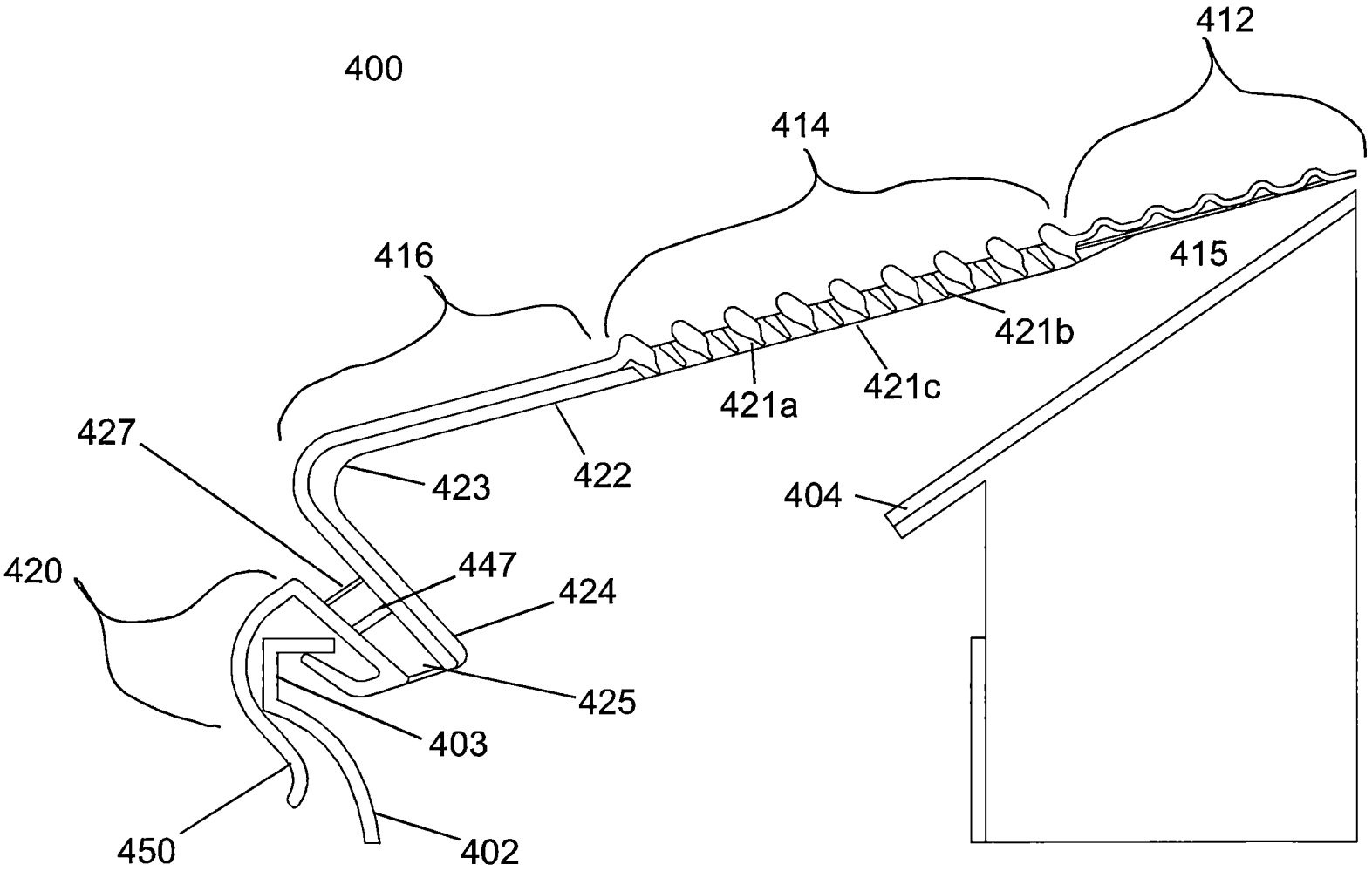
FIG. 23 is a side, cross-sectional view of a debris ejector of the disclosed technology.

As shown in FIGS. 22-23, a debris ejector 400 can include a finger section 412, a filter section 414, a nose section 416 and a mounting assembly 420.

In some implementations, the finger section 412 can include a plurality of self-adjusting fingers 413*a-h* are capable of resting on or in close proximity to the roof 404. In use, the self-adjusting fingers 413*a-l* allow water and debris to flow from a roof surface to the filter section 414. In some implementations, the self-adjusting fingers 413*a-l* can include pre-speed bumps 415 for slowing water flow from the roof 404. The self-adjusting fingers 412 can also have gaps 417 between each of the adjacent fingers so as to act as a prefilter.

In some implementations, the filter section 414 can include a water diverters 421*a*, 421*b*. The water diverters 421*a*, 421*b* can be formed in many shapes and configurations but in this implementation, the water diverters 421*a*, 421*b* are shaped as teardrop diverters 421*a* and wedge diverters 421*b*. The tear drop diverters 421*a* and wedge diverters 421*b* are shaped so as water flows over the filter section 414, the water diverters 421*a*, 421*b* can create surface tension thereby allowing the waterflow to slow while passing over the top surface of the filter section 414.

Water inlets 421*c* can be formed between the diverters 421*a*, 421*b*. These water inlets 421*c* can increase in size from top to bottom so as to create a venturi effect which acts like a vacuum and can pull water from the top surface of the filter section 414 and allows any debris within the water flow to slide across a top surface of the filter section 414 and be ejected. Additionally, the water diverters 421*a*, 421*b* and the water inlets 421*c* can be angled backwards to increase the venturi effect.

In some implementations, the nose section 416 can be formed as a flat surface 422 that extends from the filter section 414. The flat surface 416 can be used to increase water flow speed and propel debris from the ejector assembly 400. The nose section further includes a large surface tension bullnose 423 that transitions the flat surface to a bull-nose wall 424 of a water funnel 425.

The mounting assembly 420 of the debris ejector 400 can include a gutter-mounting section 450. The gutter-mounting section 450 can be a snap-on mount for attaching to a gutter rail 403 of the gutter 402. The gutter-mounting section 450 can securely retain the debris ejector 400 to the gutter 402. e.g., snap-on, but other attachment mechanisms are contemplated.

In some implementations, a mount wall 447 of the mounting assembly and the bull-nose wall 424 of the nose section 416 can be connected by chamfered cross-members 427 allowing space between the mount wall 447 and the bull-nose wall 424 so as to form a water funnel 425. The water funnel is capable of receiving water flow flowing over the bullnose 423 of the nose section 416. The water funnel 425 can be angled backwards so that water flowing over the nose section 416 can be directed into the gutter 402 and any debris from the water flow can be directed to the ground.

Figure 24:
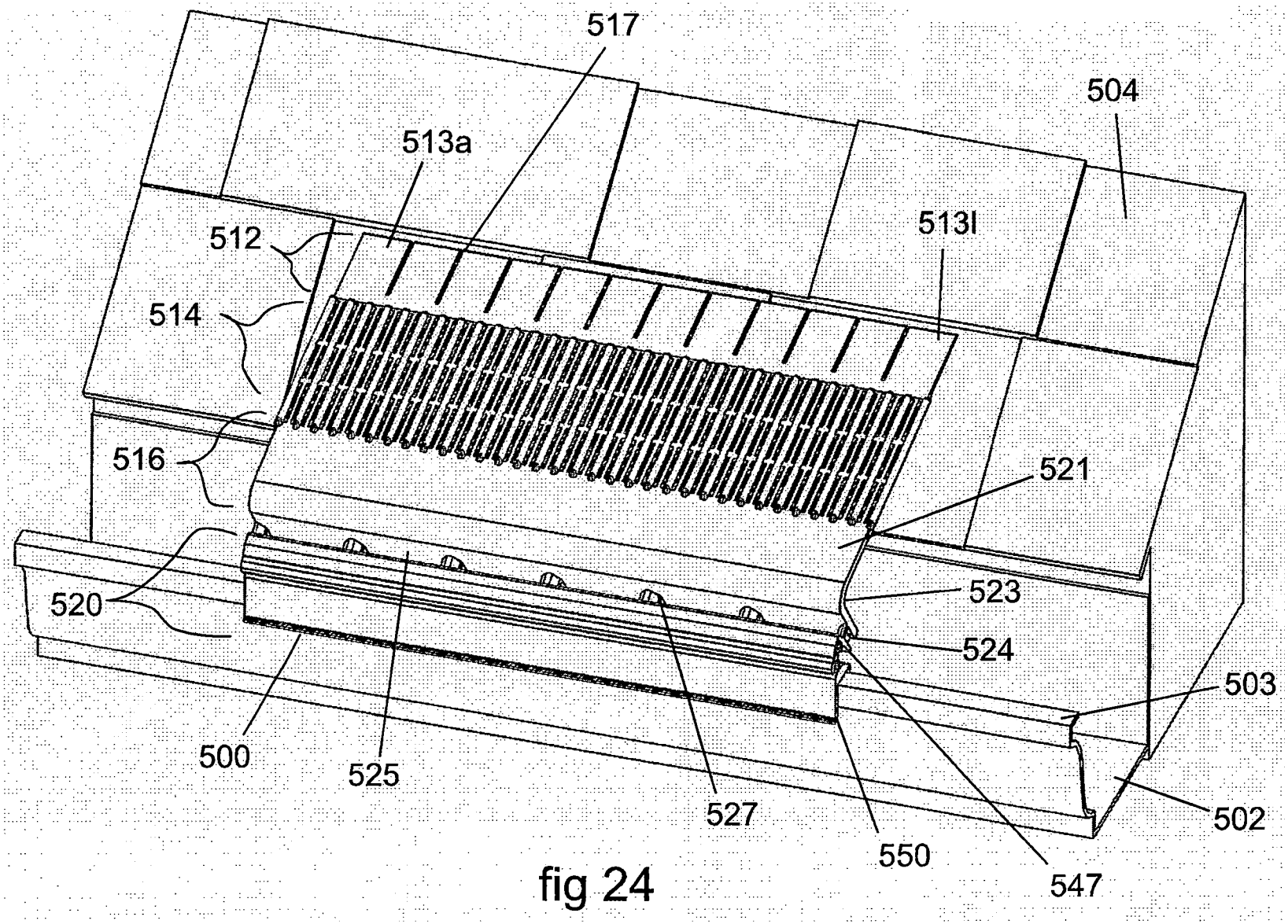
FIG. 24 is a perspective view of a debris ejector of the disclosed technology.
Figure 25:
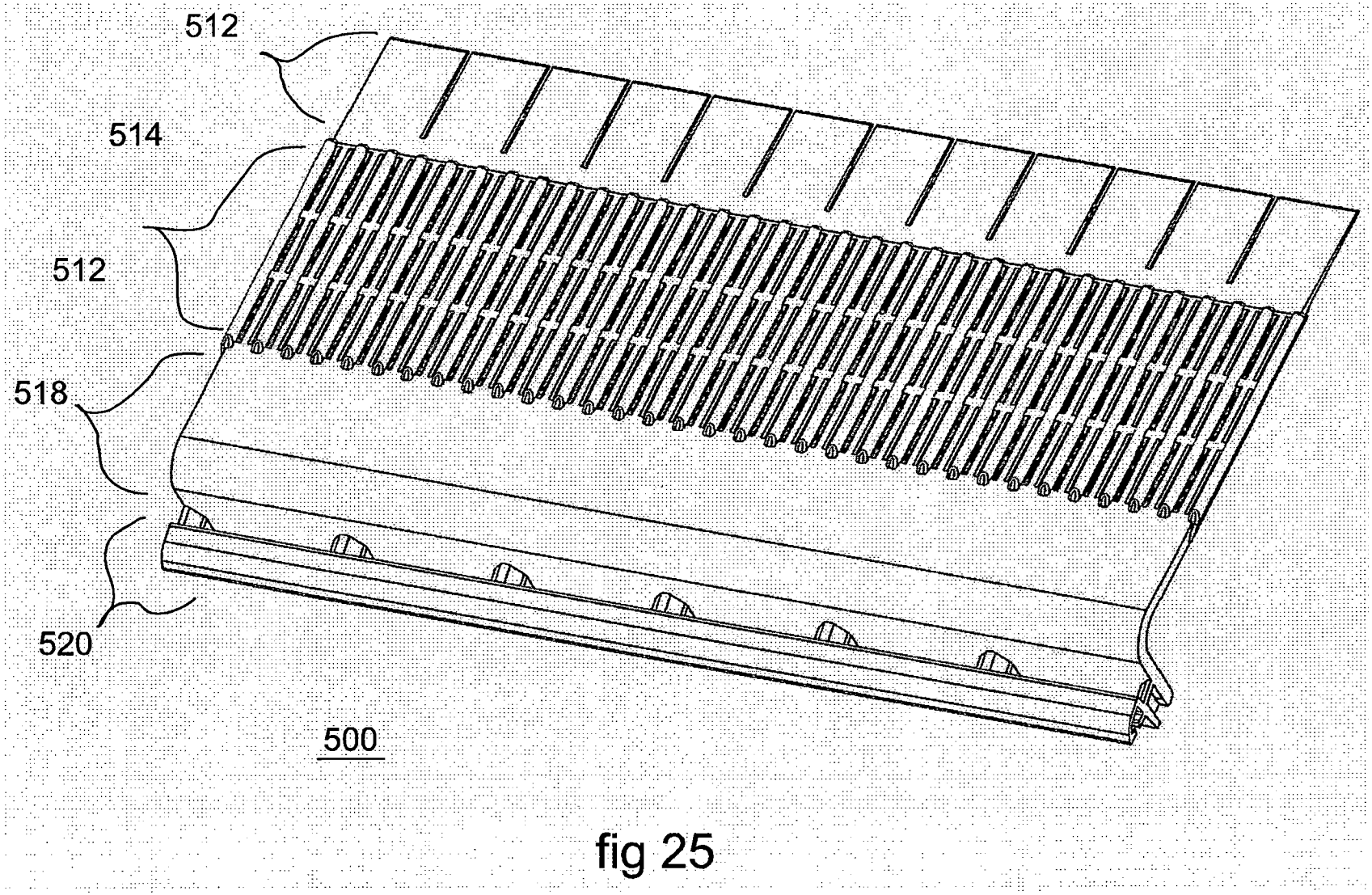
FIG. 25 is a perspective view of a debris ejector of the disclosed technology.
Figure 26:
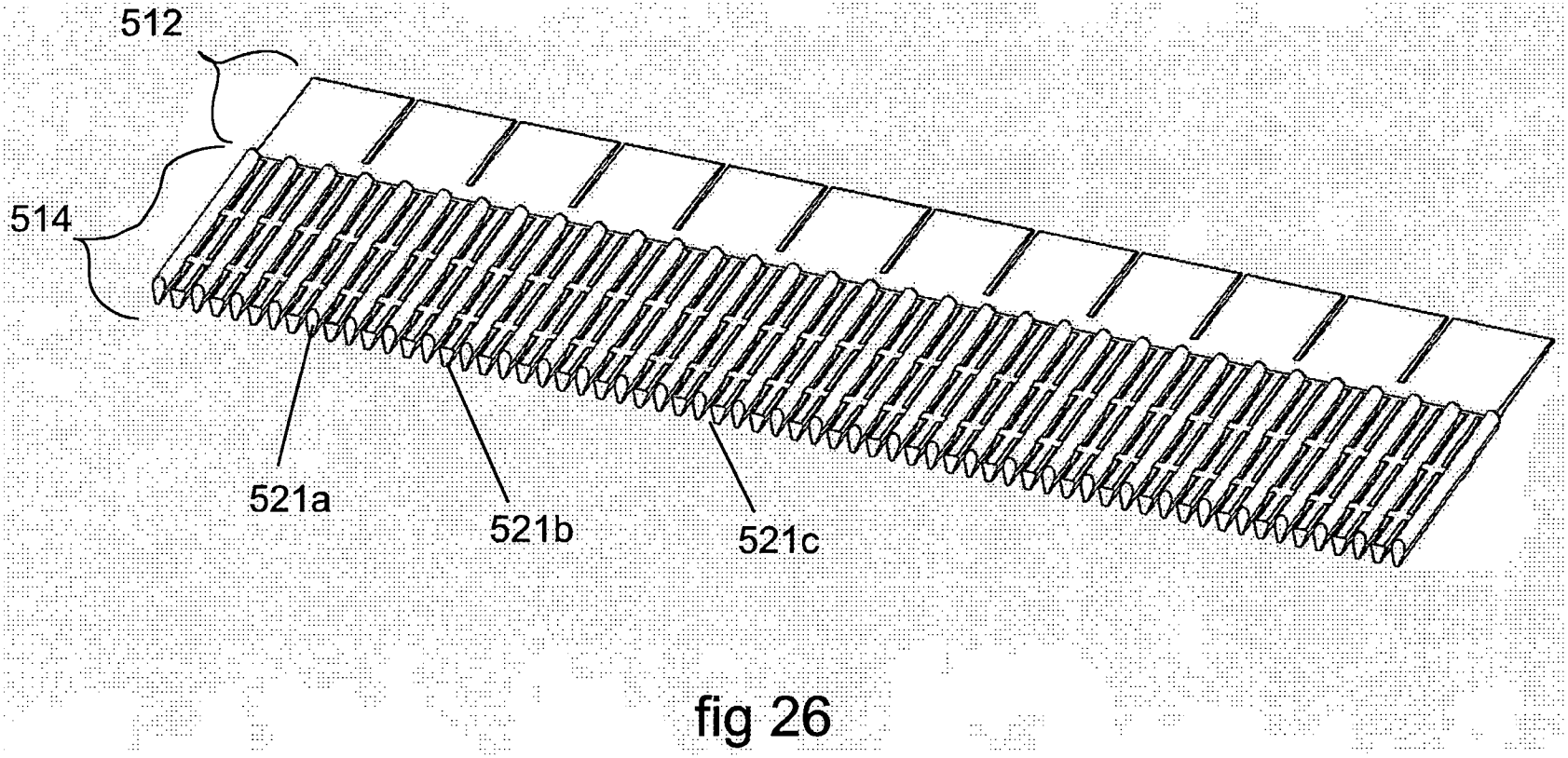
FIG. 26 is a cross-sectional view of a debris ejector of the disclosed technology.

As shown in FIGS. 24-26, a debris ejector 500 can include a finger section 512, a filter section 514, a nose section 516 and a mounting section 520.

In some implementations, the finger section 512 can include a plurality of self-adjusting fingers 513*a-l* are capable of resting on or in close proximity to the roof 504. In use, the self-adjusting fingers 513*a-l* allow water and debris to flow from a roof surface to the filter section 514. The self-adjusting fingers 512 can also have gaps 517 between each of the adjacent fingers so as to act as a prefilter.

In some implementations, the filter section 514 can include a water diverters 521*a*, 521*b*. The water diverters 521*a*, 521*b* can be formed in many shapes and configurations but in this implementation, the water diverters 521*a*, 521*b* are shaped as teardrop diverters 521*a* and wedge diverters 521*b*. The tear drop diverters 521*a* and wedge diverters 521*b* are shaped so as water flows over the filter section 514, the water diverters 521*a*, 521*b* can create surface tension thereby allowing the waterflow to slow while passing over the top surface of the filter section 514.

Water inlets 521*c* can be formed between the diverters 521*a*, 521*b*. These water inlets 521*c* can increase in size from top to bottom so as to create a venturi effect which acts like a vacuum and can pull water from the top surface of the filter section 514 and allows any debris within the water flow to slide across a top surface of the filter section 514 and be ejected.

In some implementations, the nose section 516 can be formed as a flat surface 522 that extends from the filter section 514. The flat surface 516 can be used to increase water flow speed and propel debris from the ejector assembly 500. The nose section further includes a large surface tension bullnose 523 that transitions the flat surface to a bull-nose wall 524 of a water funnel 525 that will be described more fully below.

The mounting assembly 520 of the debris ejector 400 can include a gutter-mounting section 550. The gutter-mounting section 550 can be a snap-on mount for attaching to a gutter rail 503 of the gutter 502. The gutter-mounting section 550 can securely retain the debris ejector 500 to the gutter 502. e.g., snap-on, but other attachment mechanisms are contemplated.

In some implementations, a mount wall 547 of the mounting assembly and the bull-nose wall 524 of the nose section 516 can be connected by chamfered cross-members 527 allowing space between the mount wall 547 and the bull-nose wall 524 so as to form a water funnel 525. The water funnel is capable of receiving water flow flowing over the bullnose 523 of the nose section 516. The water funnel 525 can be angled backwards so that water flowing over the nose section 516 can be directed into the gutter 502 and any debris from the water flow can be directed to the ground.

Figure 27:
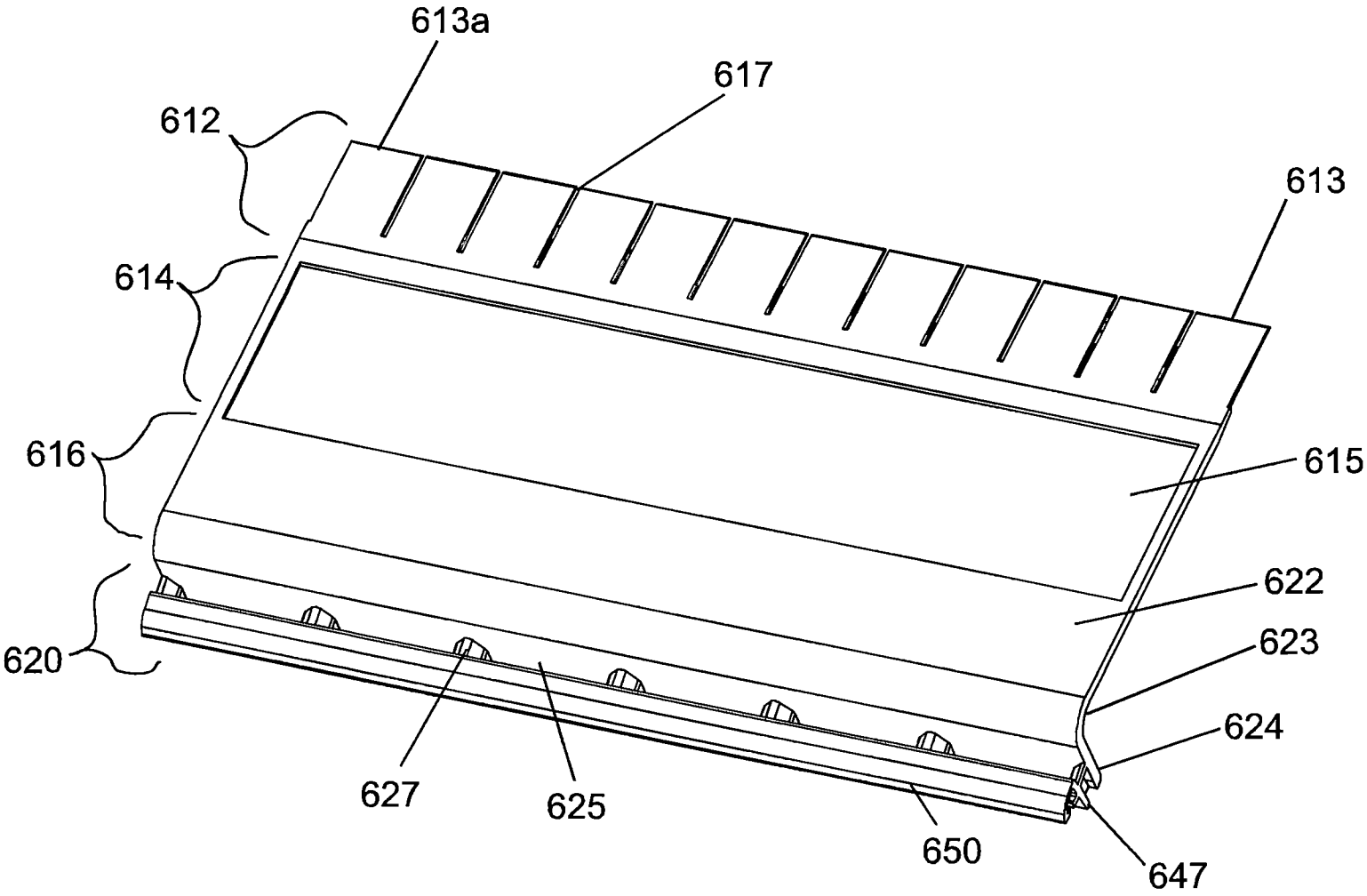
FIG. 27 is a perspective view of a debris ejector of the disclosed technology.

As shown in FIG. 27, a debris ejector 600 can include a finger section 612, a filter section 614, a nose section 616 and a mounting section 620.

In some implementations, the finger section 612 can include a plurality of self-adjusting fingers 613*a-l* are capable of resting on or in close proximity to the roof 604. In use, the self-adjusting fingers 613*a-l* allow water and debris to flow from a roof surface to the filter section 614. The self-adjusting fingers 612 can also have gaps 617 between each of the adjacent fingers so as to act as a prefilter.

In some implementations, the filter section 614 can include a micro mesh 615, e.g., a micro metal mesh so as water flows over the filter section 614, micro mesh can create surface tension thereby allowing the waterflow to slow while passing over the top surface of the filter section 614.

In some implementations, the nose section 616 can be formed as a flat surface 622 that extends from the filter section 614. The flat surface 622 can be used to increase water flow speed and propel debris from the ejector assembly 600. The nose section further includes a large surface tension bullnose 623 that transitions the flat surface to a bull-nose wall 624 of a water funnel 625 that will be described more fully below.

The mounting assembly 620 of the debris ejector 600 can include a gutter-mounting section 650. The gutter-mounting section 650 can be a snap-on mount for attaching to a gutter rail of the gutter. The gutter-mounting section 650 can securely retain the debris ejector 600 to the gutter, e.g., snap-on, but other attachment mechanisms are contemplated.

In some implementations, a mount wall 647 of the mounting assembly and the bull-nose wall 624 of the nose section 616 can be connected by chamfered cross-members 627 allowing space between the mount wall 647 and the bull-nose wall 624 so as to form a water funnel 625. The water funnel is capable of receiving water flow flowing over the bullnose 623 of the nose section 616. The water funnel 625 can be angled backwards so that water flowing over the nose section 616 can be directed into the gutter 602 and any debris from the water flow can be directed to the ground.

Figure 28:
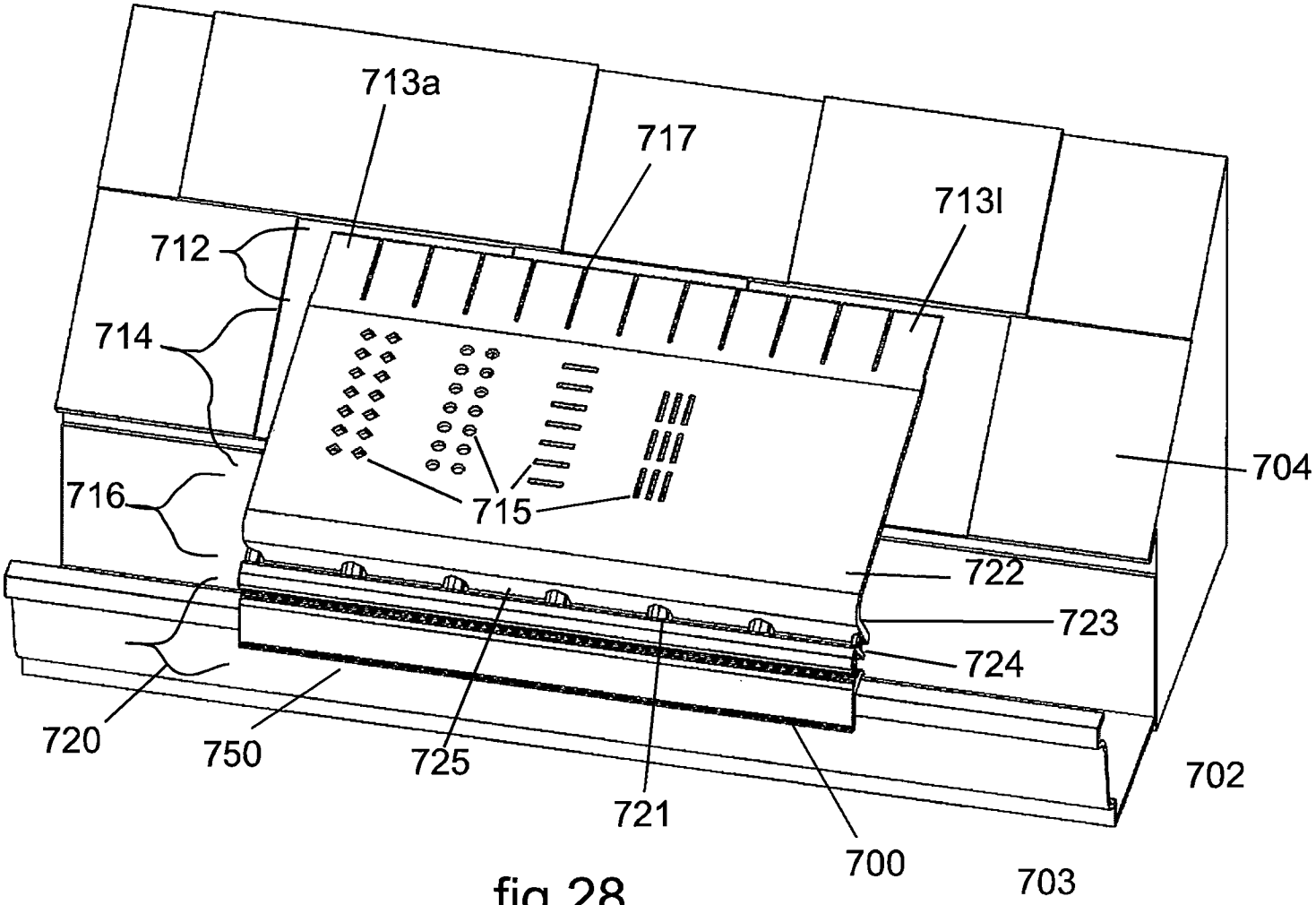
FIG. 28 is a perspective view of a debris ejector of the disclosed technology.

As shown in FIG. 28, a debris ejector 700 can include a finger section 712, a filter section 714, a nose section 716 and a mounting section 720.

In some implementations, the finger section 712 can include a plurality of self-adjusting fingers 713*a-l* are capable of resting on or in close proximity to the roof 704. In use, the self-adjusting fingers 713*a-l* allow water and debris to flow from a roof surface to the filter section 714. The self-adjusting fingers 712 can also have gaps 717 between each of the adjacent fingers so as to act as a prefilter.

In some implementations, the filter section 714 can include various holes and slot configurations 715, e.g., diamond, round, horizontal oblong and vertical oblong, so as water flows over the filter section 714, various holes and slot configurations can create surface tension thereby allowing the waterflow to slow while passing over the top surface of the filter section 714.

In some implementations, the nose section 716 can be formed as a flat surface 722 that extends from the filter section 714. The flat surface 716 can be used to increase water flow speed and propel debris from the ejector assembly 700. The nose section further includes a large surface tension bullnose 723 that transitions the flat surface to a bull-nose wall 724 of a water funnel 725 that will be described more fully below.

The mounting assembly 720 of the debris ejector 700 can include a gutter-mounting section 750. The gutter-mounting section 750 can be a snap-on mount for attaching to a gutter rail 703 of the gutter 702. The gutter-mounting section 750 can securely retain the debris ejector 700 to the gutter 702. e.g., snap-on, but other attachment mechanisms are contemplated.

In some implementations, a mount wall 747 of the mounting assembly and the bull-nose wall 724 of the nose section 716 can be connected by chamfered cross-members 727 allowing space between the mount wall 747 and the bull-nose wall 724 so as to form a water funnel 725. The water funnel is capable of receiving water flow flowing over the bullnose 723 of the nose section 716. The water funnel 725 can be angled backwards so that water flowing over the nose section 716 can be directed into the gutter 702 and any debris from the water flow can be directed to the ground.

Figure 29:
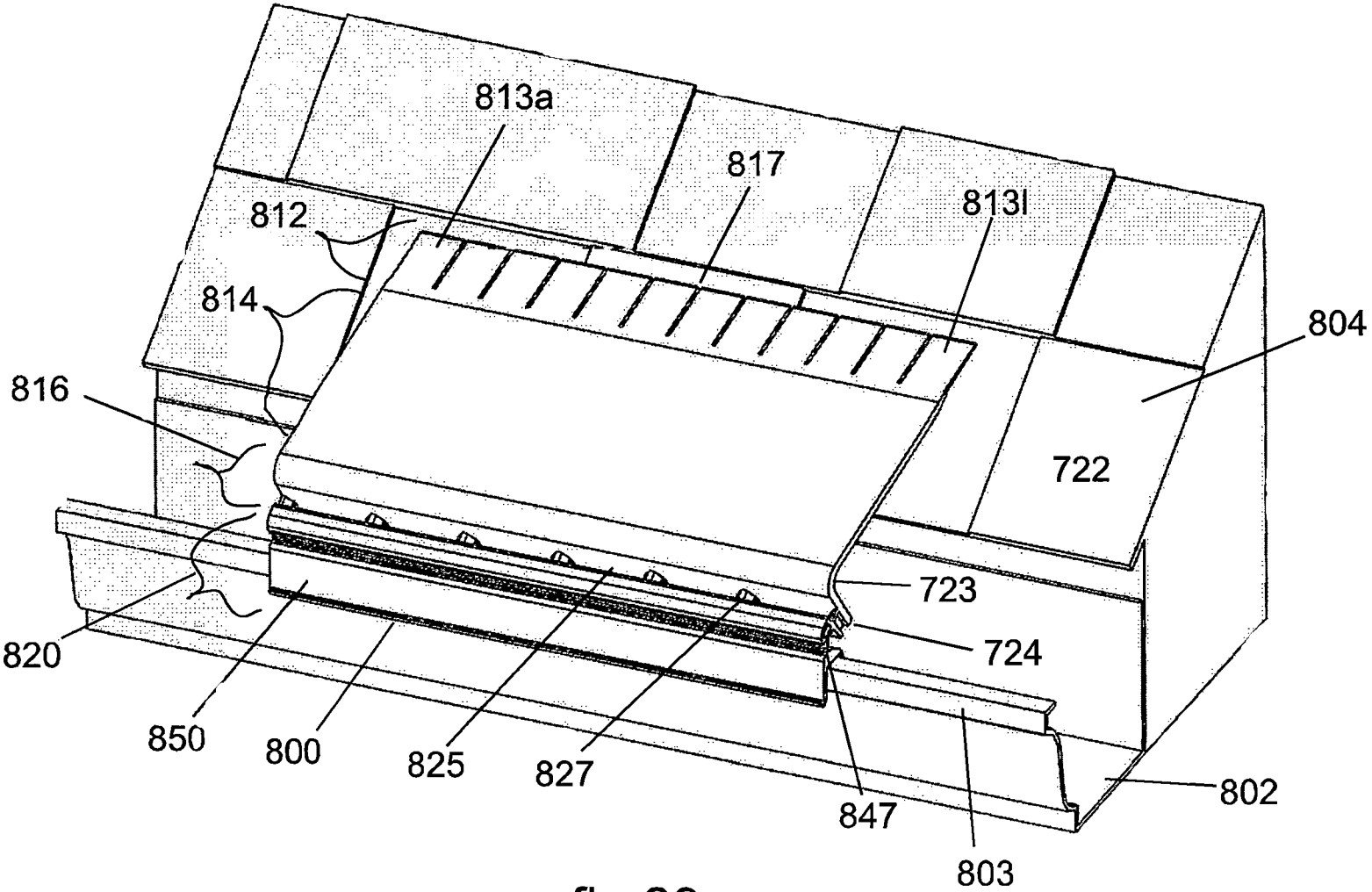
FIG. 29 is a perspective view of a debris ejector of the disclosed technology.
Figure 30:
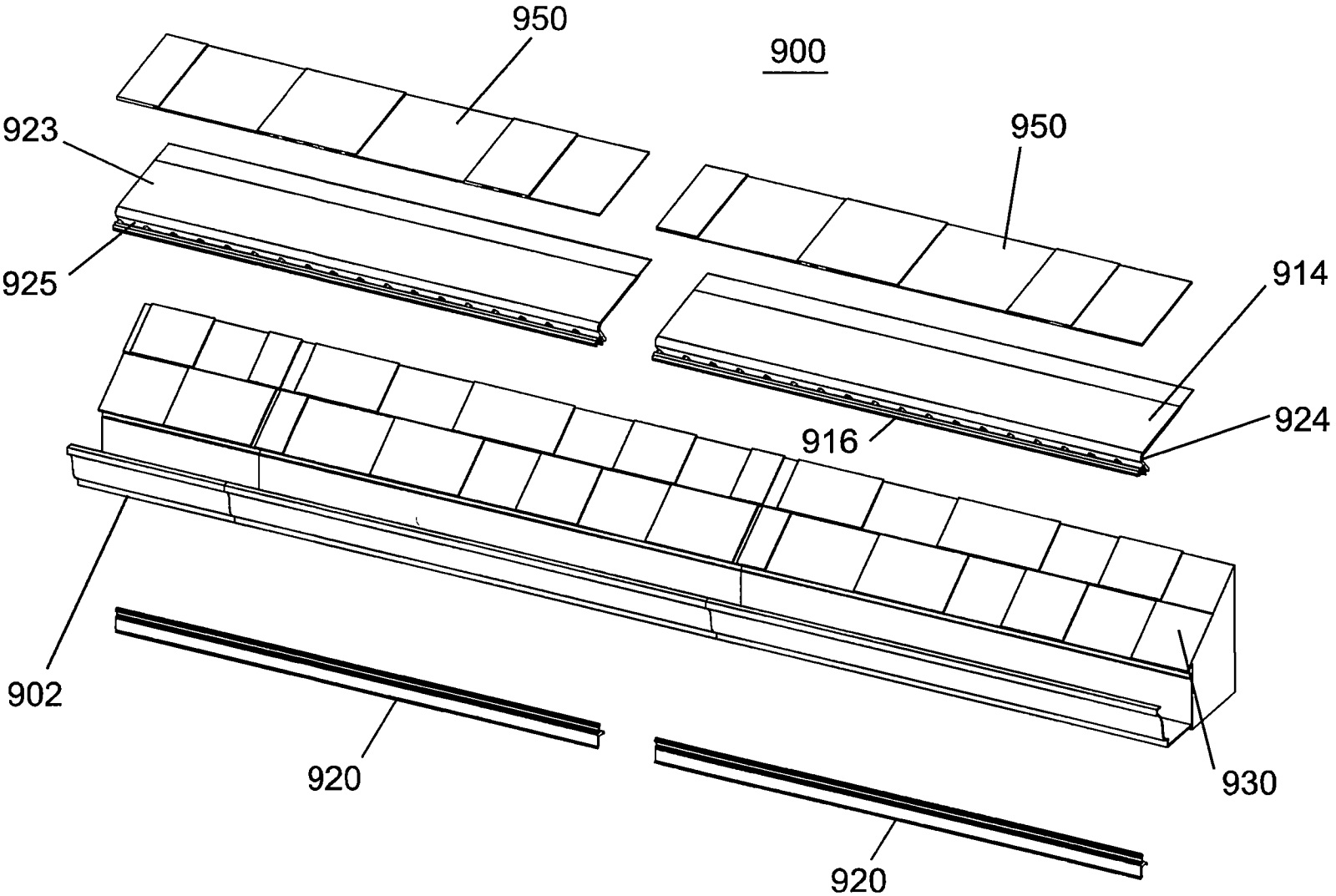
FIG. 30 is an exploded view of a debris ejector of the disclosed technology.
Figure 31:
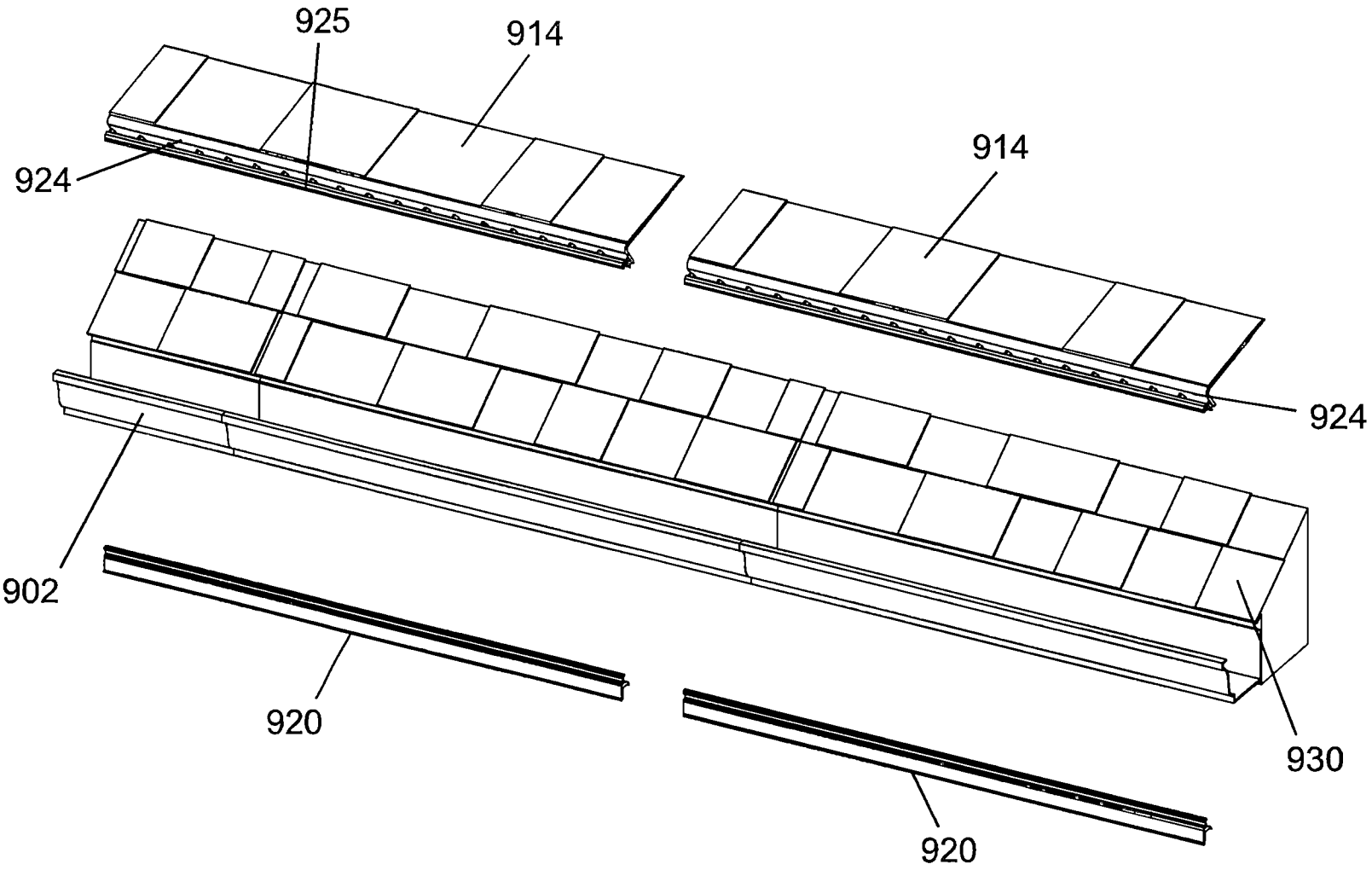
FIG. 31 is an exploded view of a debris ejector of the disclosed technology.
Figure 32:
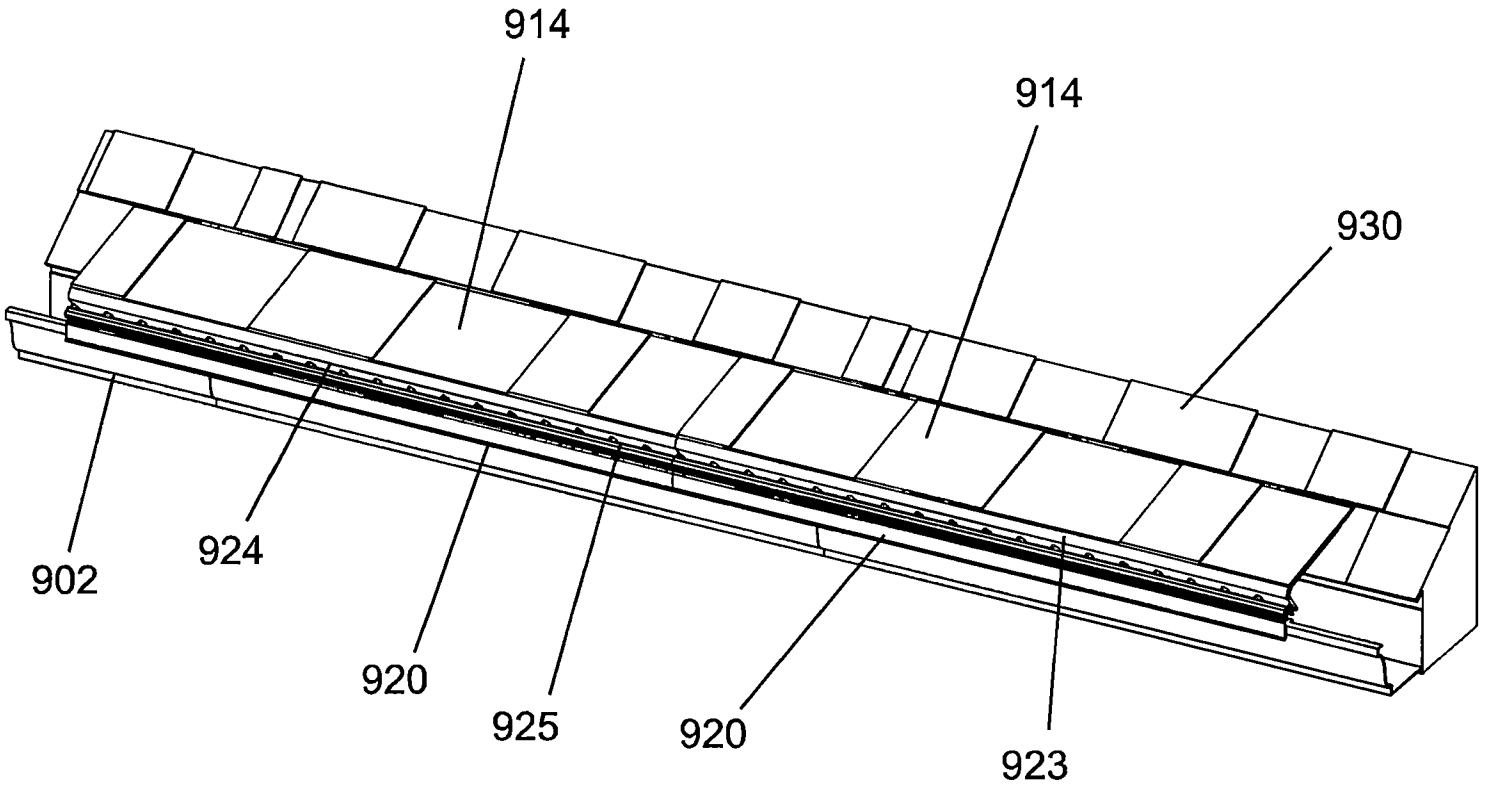
FIG. 32 is a perspective view of a debris ejector of the disclosed technology in a closed position.
Figure 33:
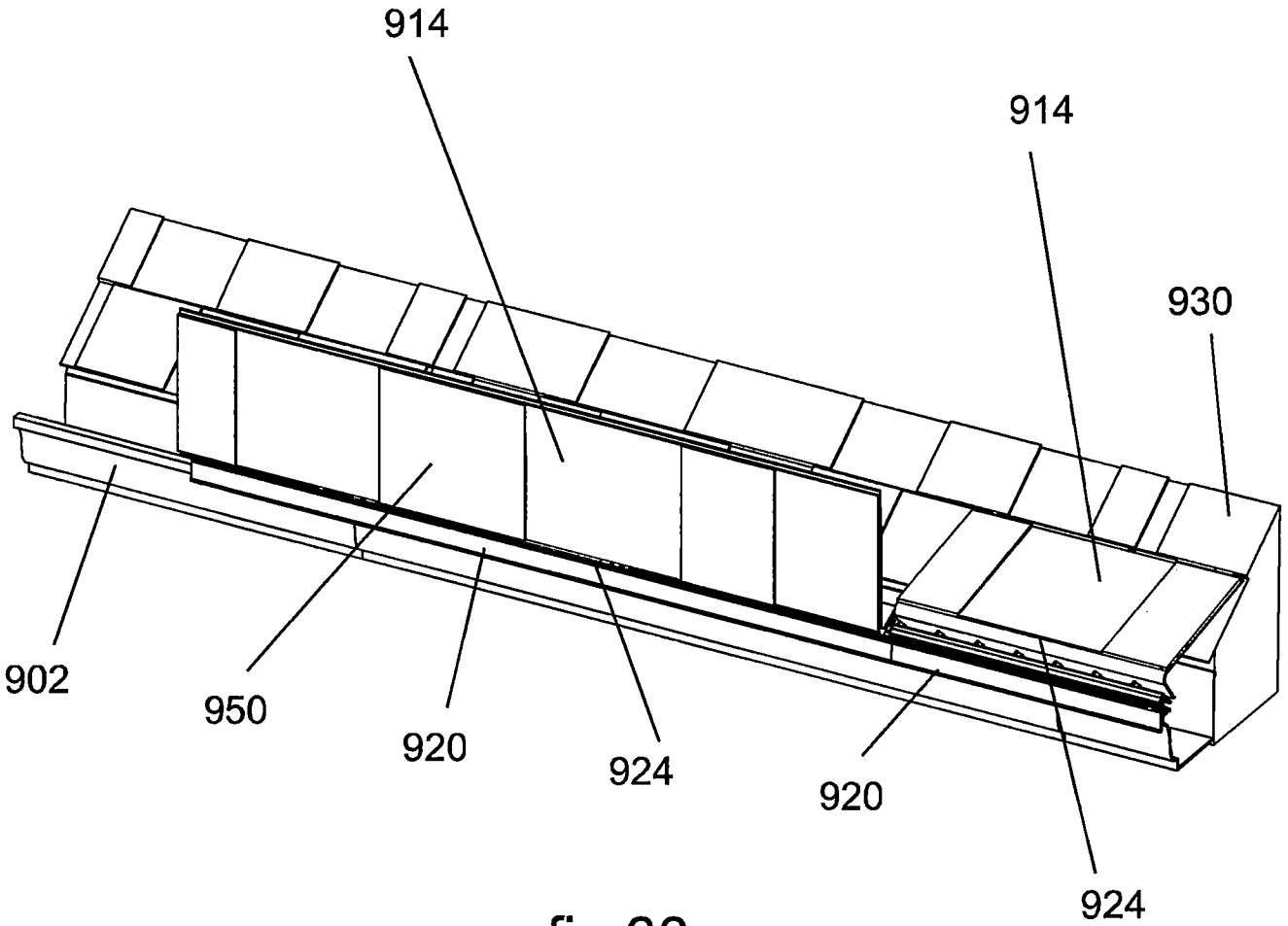
FIGS. 33-34 area perspective views of a debris ejector of the disclosed technology in an open position.
Figure 34:
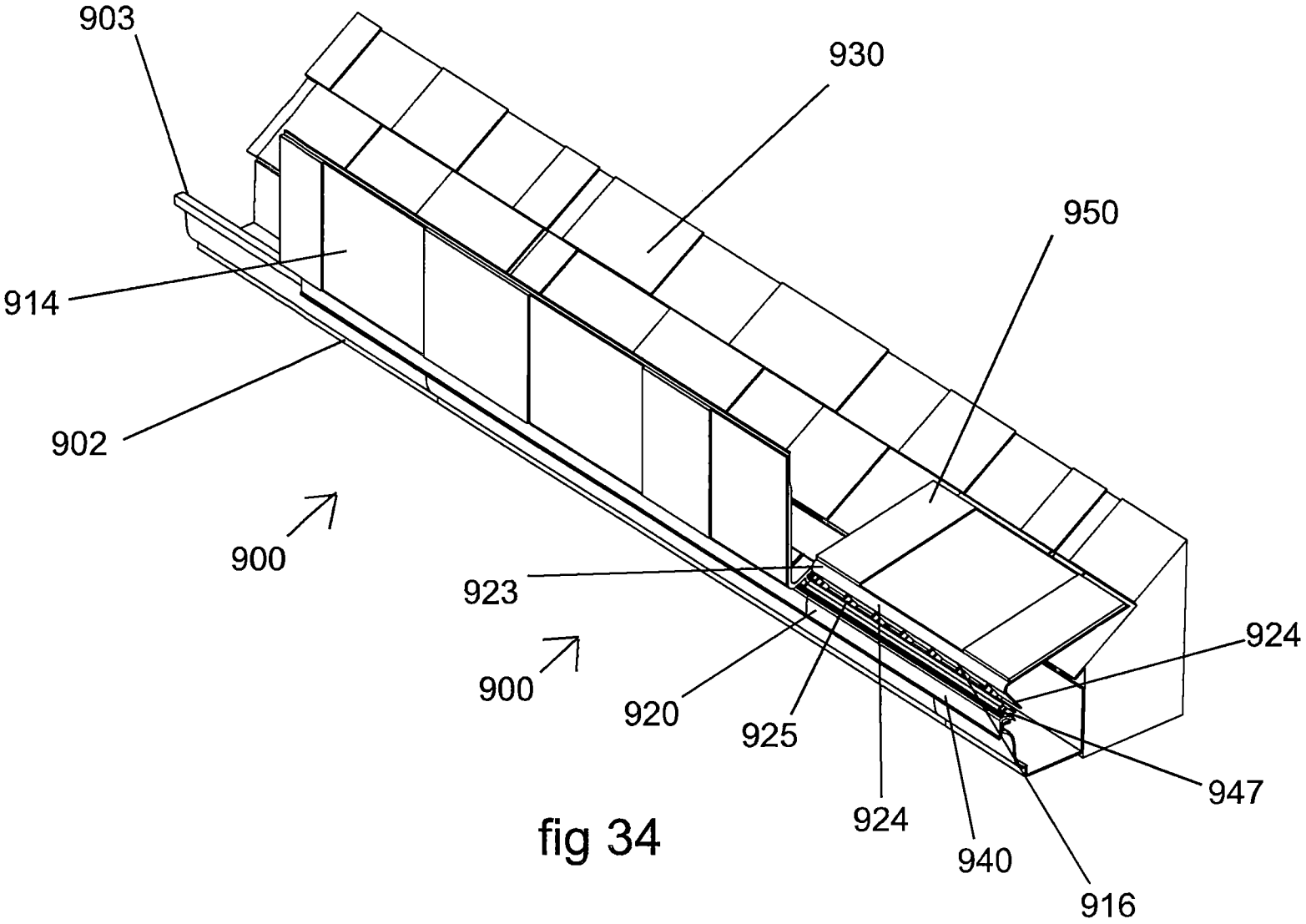

As shown in FIG. 29, a debris ejector 800 can include a finger section 812, a flat section 814, a nose section 816 and a mounting section 840.

In some implementations, the finger section 812 can include a plurality of self-adjusting fingers 813*a-l* are capable of resting on or in close proximity to the roof 804. In use, the self-adjusting fingers 813*a-l* allow water and debris to flow from a roof surface to the filter section 814. The self-adjusting fingers 812 can also have gaps 817 between each of the adjacent fingers so as to act as a prefilter.

In some implementations, the nose section 816 can be formed as a flat surface 822 that extends from the filter section 814. The flat surface 816 can be used to increase water flow speed and propel debris from the ejector assembly 800. The nose section further includes a large surface tension bullnose 823 that transitions the flat surface to a bull-nose wall 824 of a water funnel 825 that will be described, more fully below.

The mounting assembly 820 of the debris ejector 800 can include a gutter-mounting section 850. The gutter-mounting section 850 can be a snap-on mount for attaching to a gutter rail 803 of the gutter 802. The gutter-mounting section 850 can securely retain the debris ejector 800 to the gutter 802. e.g., snap-on, but other attachment mechanisms are contemplated.

In some implementations, a mount wall 847 of the mounting assembly and the bull-nose wall 824 of the nose section 816 can be connected by chamfered cross-members 827 allowing space between the mount wall 847 and the bull-nose wall 824 so as to form a water funnel 825. The water funnel is capable of receiving water flow flowing over the bullnose 823 of the nose section 816. The water funnel 825 can be angled backwards so that water flowing over the nose section 816 can be directed into the gutter 802 and any debris from the water flow can be directed to the ground.

As shown in FIGS. 30-34, a debris ejector 900 can include a flat section 914, a nose section 916 and a mounting section 940.

In some implementations, the flat section 914 can be used to increase a speed of a water flow from a peaked or slanted roof surface thereby propelling any debris caught in the water flow the ejector assembly 900. In some implementations, the flat section 914 can be used to adhere roofing shingles 950 to the flat surface 914 so as to match a color or texture of the roof's shingles 930.

In some implementations, the flat section 914 can transition into the nose section 916. The nose section 916 further includes a large surface tension bullnose 923 that transitions the flat surface to a bull-nose wall 924 of a water funnel 925 that will be described more fully below.

The mounting assembly 920 of the debris ejector 900 can include a gutter-mounting section 950, as described above. For example, the gutter-mounting section 950 can be a snap-on mount for attaching to a gutter rail 903 of the gutter 902. The gutter-mounting section 950 can securely retain the debris ejector 900 to the gutter 902, e.g., snap-on. Or, the gutter-mounting section 950 can include a hinge, as described above, allowing for an open position and a closed position. Other attachment mechanisms are contemplated.

In some implementations, a mount wall 947 of the mounting assembly and the bull-nose wall 924 of the nose section 916 can be connected by chamfered cross-members 927 allowing space between the mount wall 947 and the bull-nose wall 924 so as to form a water funnel 925. The water funnel is capable of receiving water flow flowing over the bullnose 923 of the nose section 916. The water funnel 925 can be angled backwards so that water flowing over the nose section 916 can be directed into the gutter 902 and any debris from the water flow can be directed to the ground.

Figure 35:
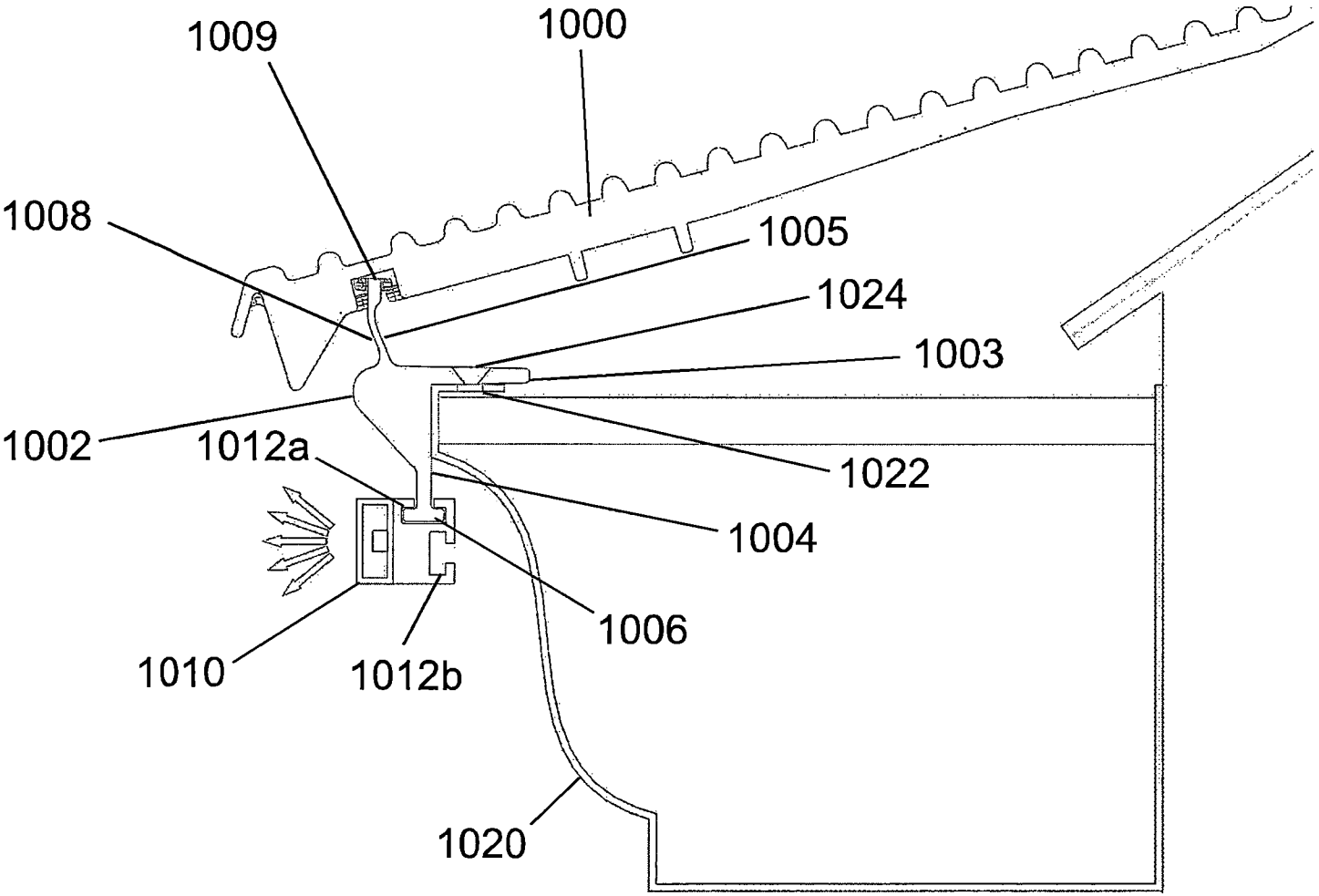
FIG. 35 is a side view of a debris ejector and lighting fixture of the disclosed technology.
Figure 36:
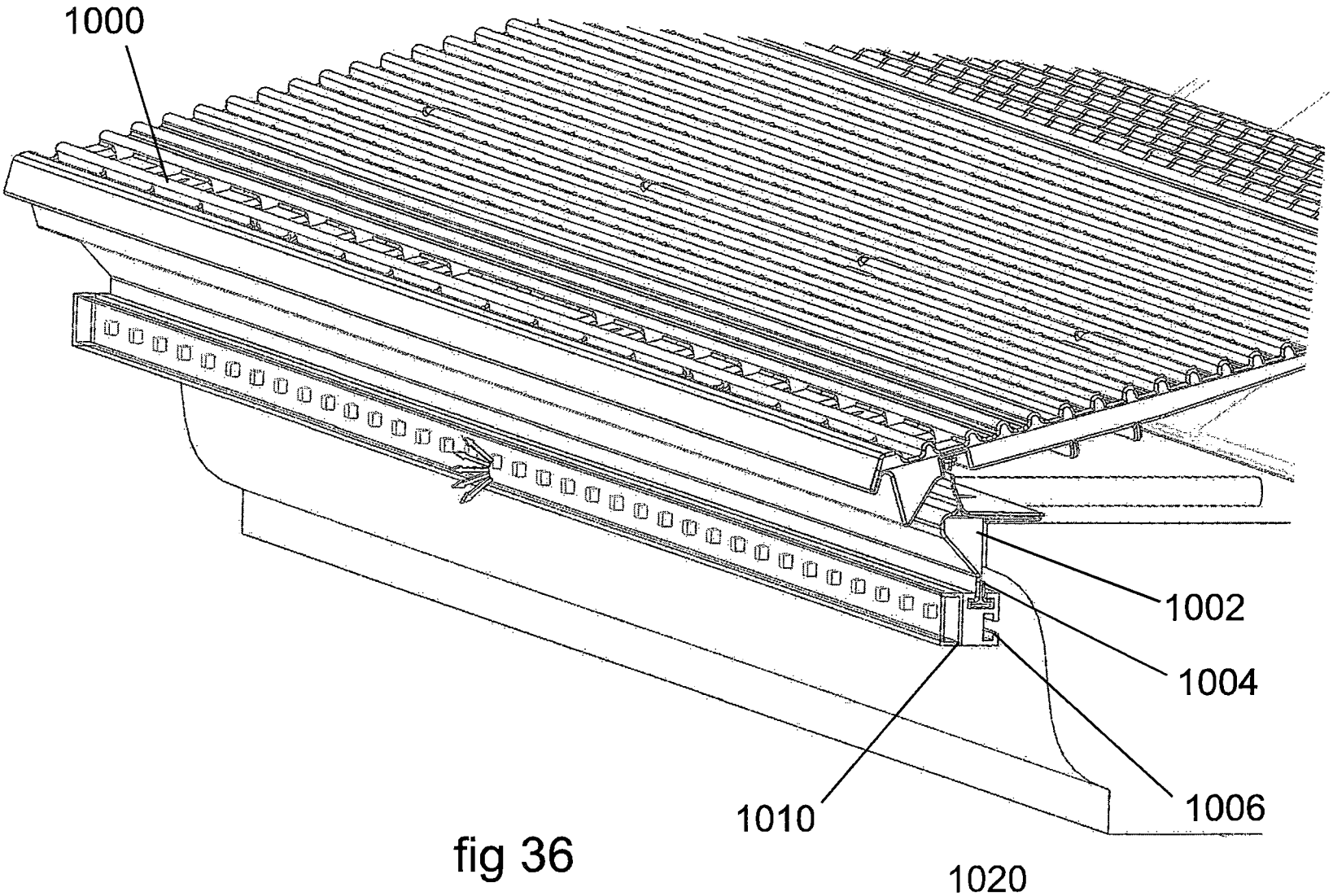
FIG. 36 is a perspective view of a debris ejector and lighting fixture of the disclosed technology.
Figure 37:
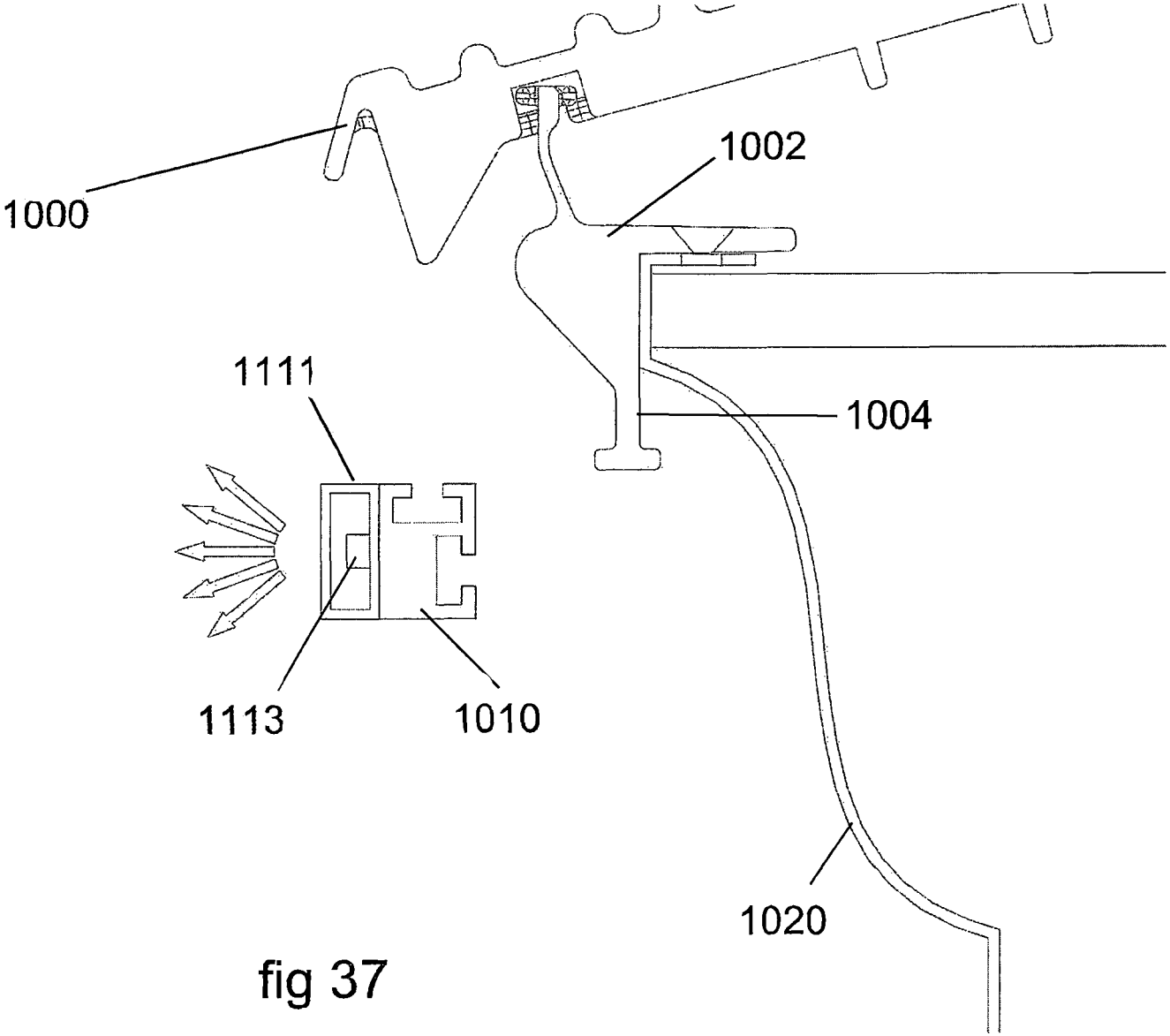
FIG. 37 is a close-up, side view of a debris ejector and lighting fixture of the disclosed technology.

In some implementations, as shown in FIGS. 35-37, a gutter guard 1000, as described above, can include a mounting assembly 1002. The mounting assembly 1002 of the gutter guard 1000 can include a gutter-mounting section 1003 and a hinge-mounting section 1005. The gutter-mounting section 1003 can be an L-shaped mount for attaching to a gutter rail 1022 of the gutter 1020. The gutter-mounting section 1003 can securely retain the gutter guard 1000 to the gutter 1020. e.g., with screws 1024 positioned in screw location ribs, but other attachment mechanisms are contemplated, e.g., snap-on components. The hinge-mounting section 1005 can project from the gutter-mounting section 1003 at one end and can be fixedly attached to the hinge 1008 at the other end.

The hinge 1008 can include a tee section 1009. The hinge 1008 can be constructed from a flexible material, e.g., a thermoplastic elastomer/rubber while the tee section 1009 can be constructed from a solid material e.g., polymers, thermoplastics, thermosets and/or elastomers.

Figure 38:
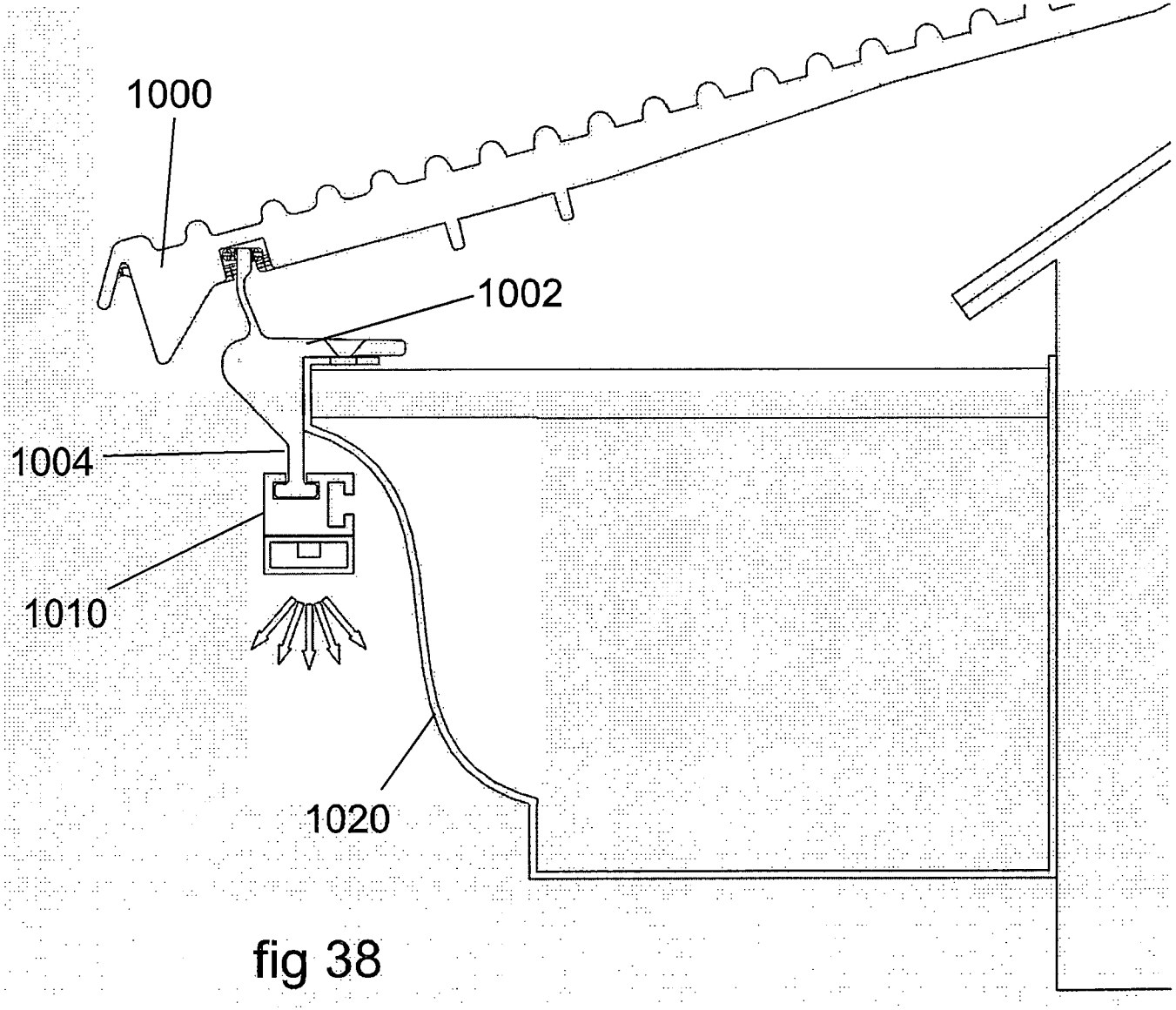
FIG. 38 is a side view of a debris ejector and lighting fixture of the disclosed technology.
Figure 39:
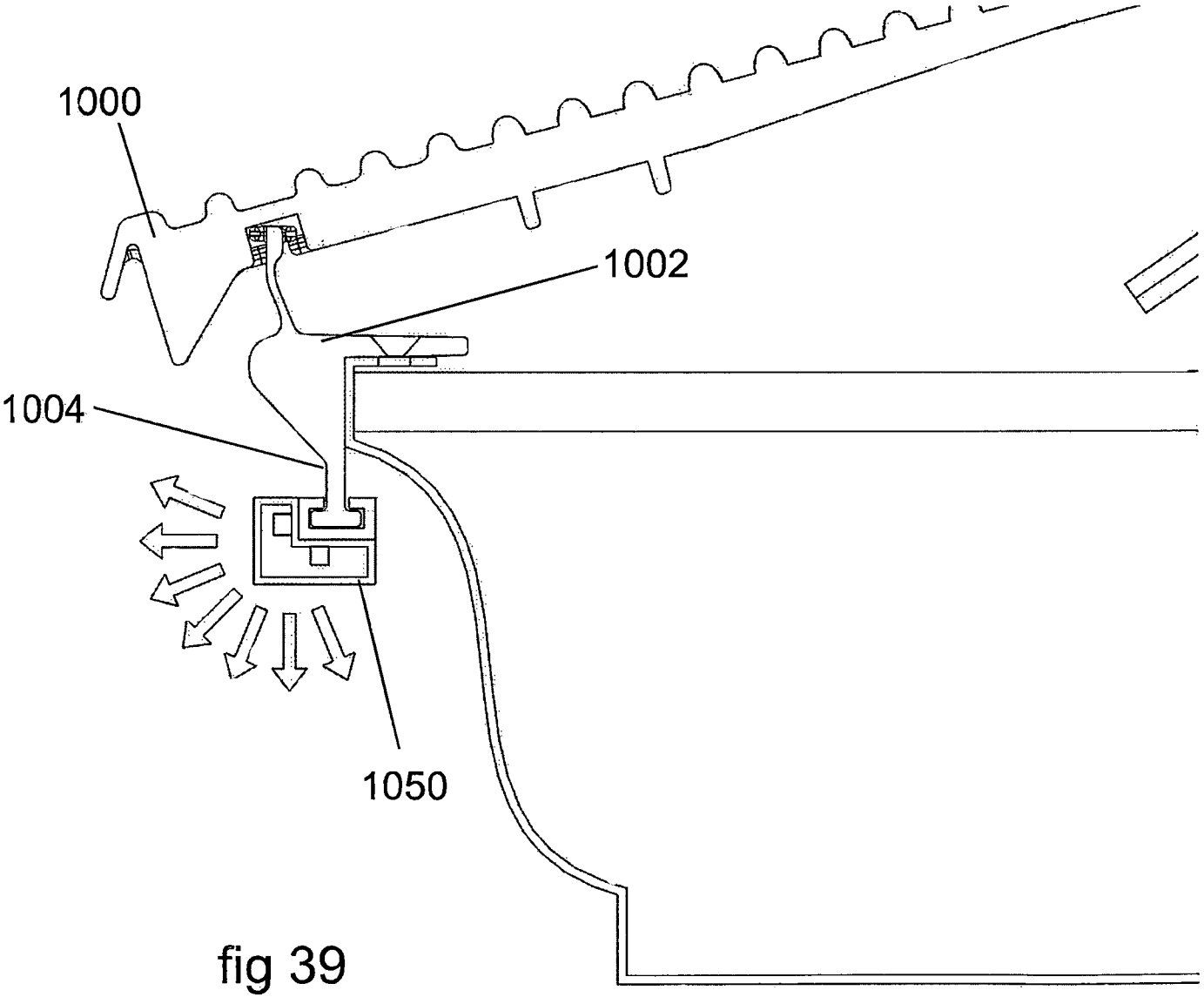
FIG. 39 is a side view of a debris ejector and lighting fixture of the disclosed technology.

The mounting assembly 1002 can further include a lighting mount 1004. The lighting mount 1004 can include a tee section 1006 which can be married to a tee receiver guide 1012*a* or 1002*b* of a lighting fixture 1010. The tee receiver guide 1012*a*, 1012*b* can comprise fingers for slidably receiving the tee section 1012*a* or 1012*b* of the lighting mount 1004 depending on light direction needs. As shown in FIGS. 35-37, the direction of the light will project forward from the light fixture 1010. As shown in FIG. 38, the direction of the light will project downward from the light fixture 1010. In another implementation, as shown in FIG. 39, the direction of the light can project forward and downward from a light fixture 1050.

In some implementations, the gutter-mounting section 1003, the hinge-mounting section 1005, the hinge 1008, the hinge tee section 1009, the lighting mount 1004 and lighting mount tee section 1006 can be integrally connected to one another through a co-extrusion process. For example, the gutter-mounting section 1003, the hinge-mounting section 1005, the hinge tee section 1009, the lighting mount 1004 and the lighting mount tee section 1006 can be constructed from a solid material e.g., polymers, thermoplastics, thermosets, elastomers while the hinge 1008 can be constructed from a flexible material, e.g., a thermoplastic elastomer/rubber. Other manufacturing processes are contemplated.

To connect the lighting fixture 1010 to the lighting mount 1004, the lighting fixture 1010 can be slidably received by the lighting mount tee section 1006 and can be removed and replaced as needed.

Figure 40:
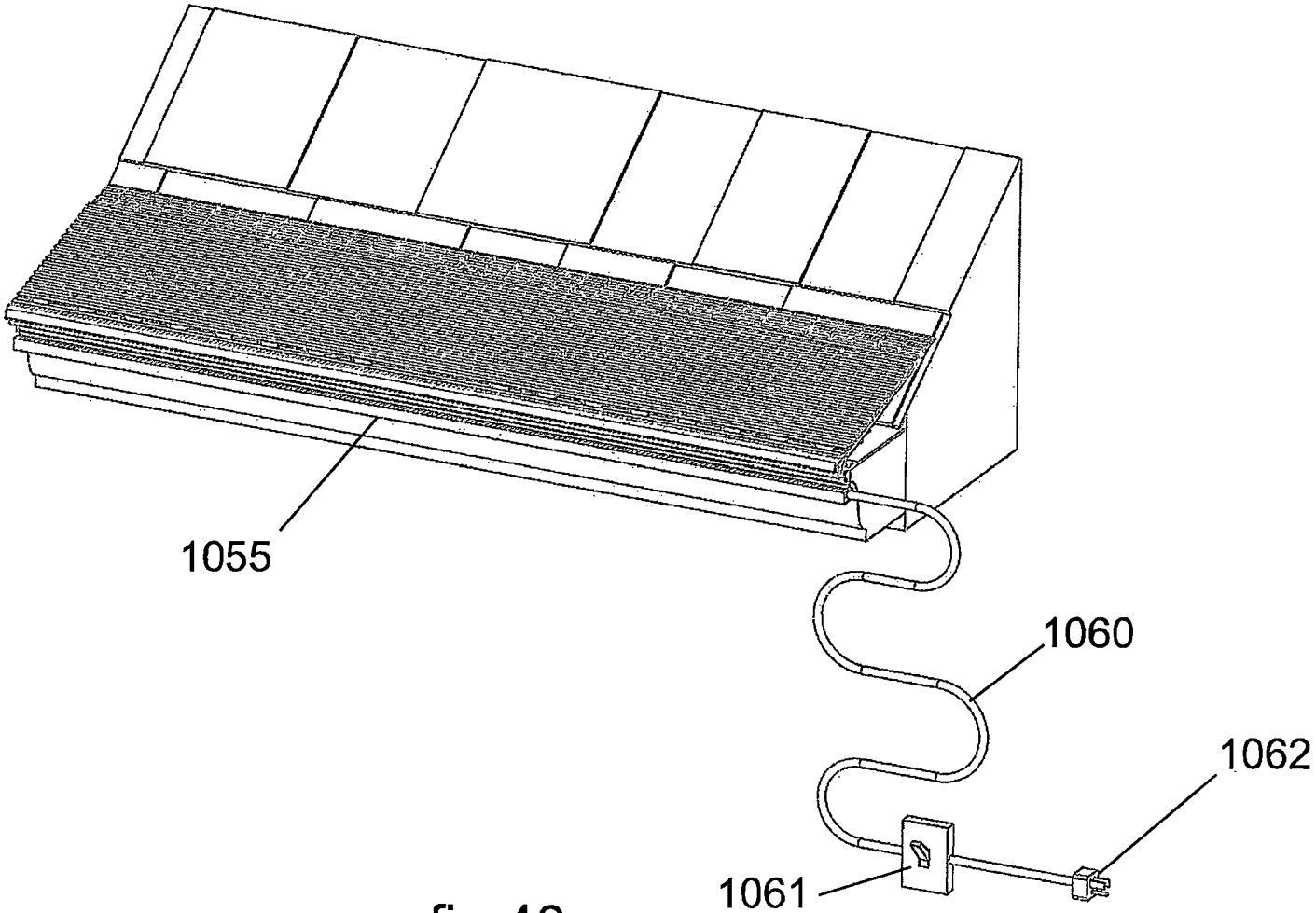
FIGS. 40-44 are perspective views of a debris ejector and lighting fixture of the disclosed technology using a variety of power sources.
Figure 41:
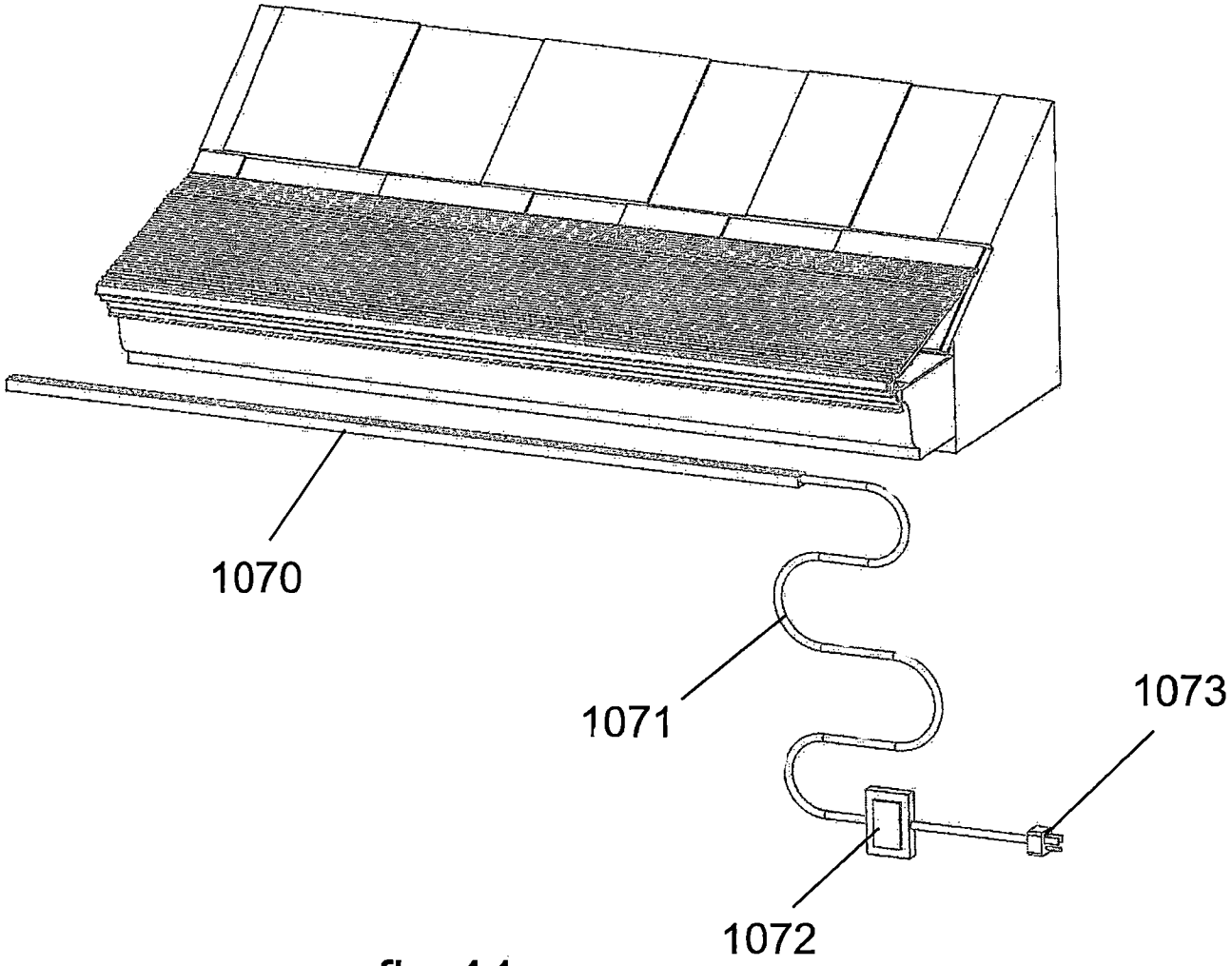
Figure 42:
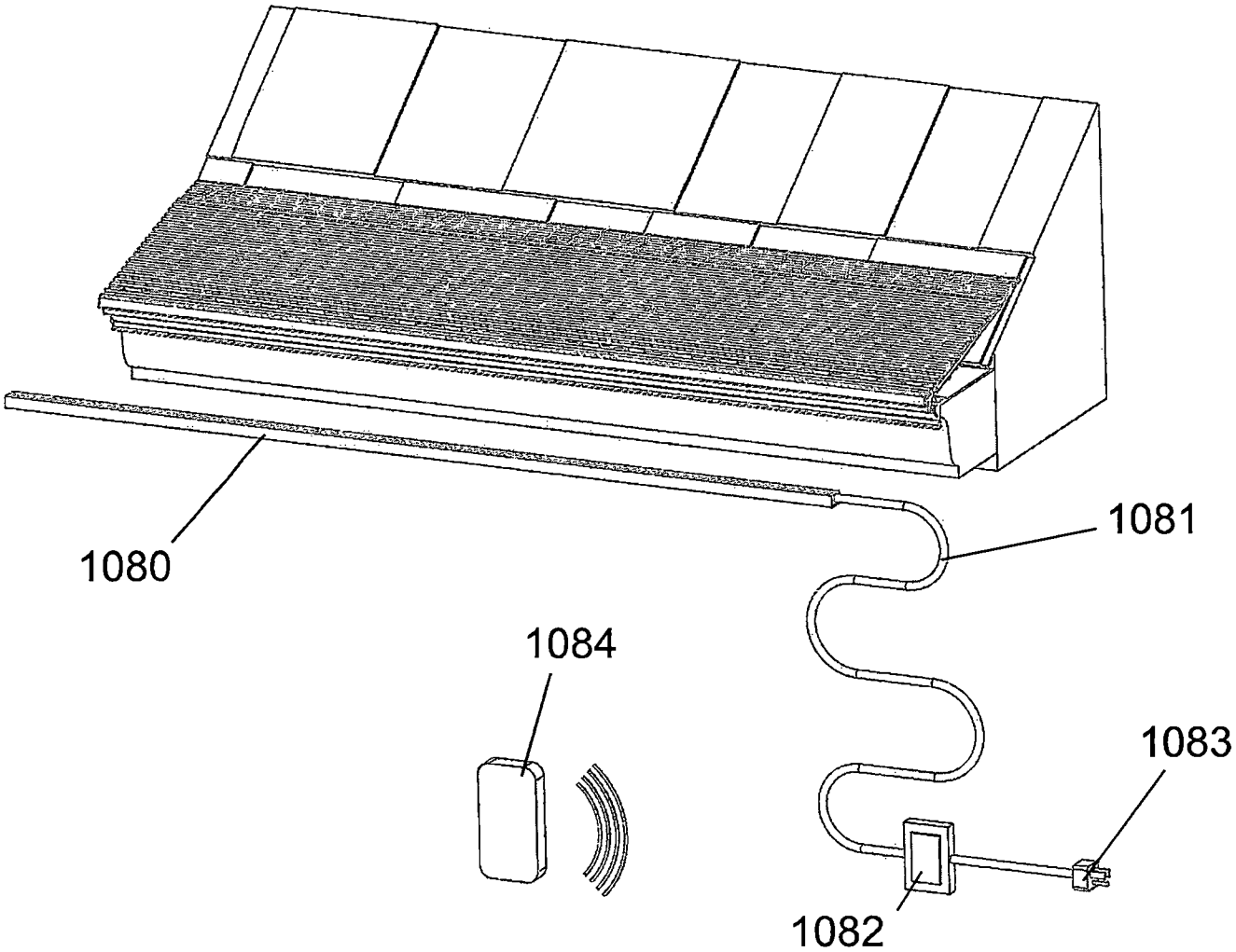
Figure 43:
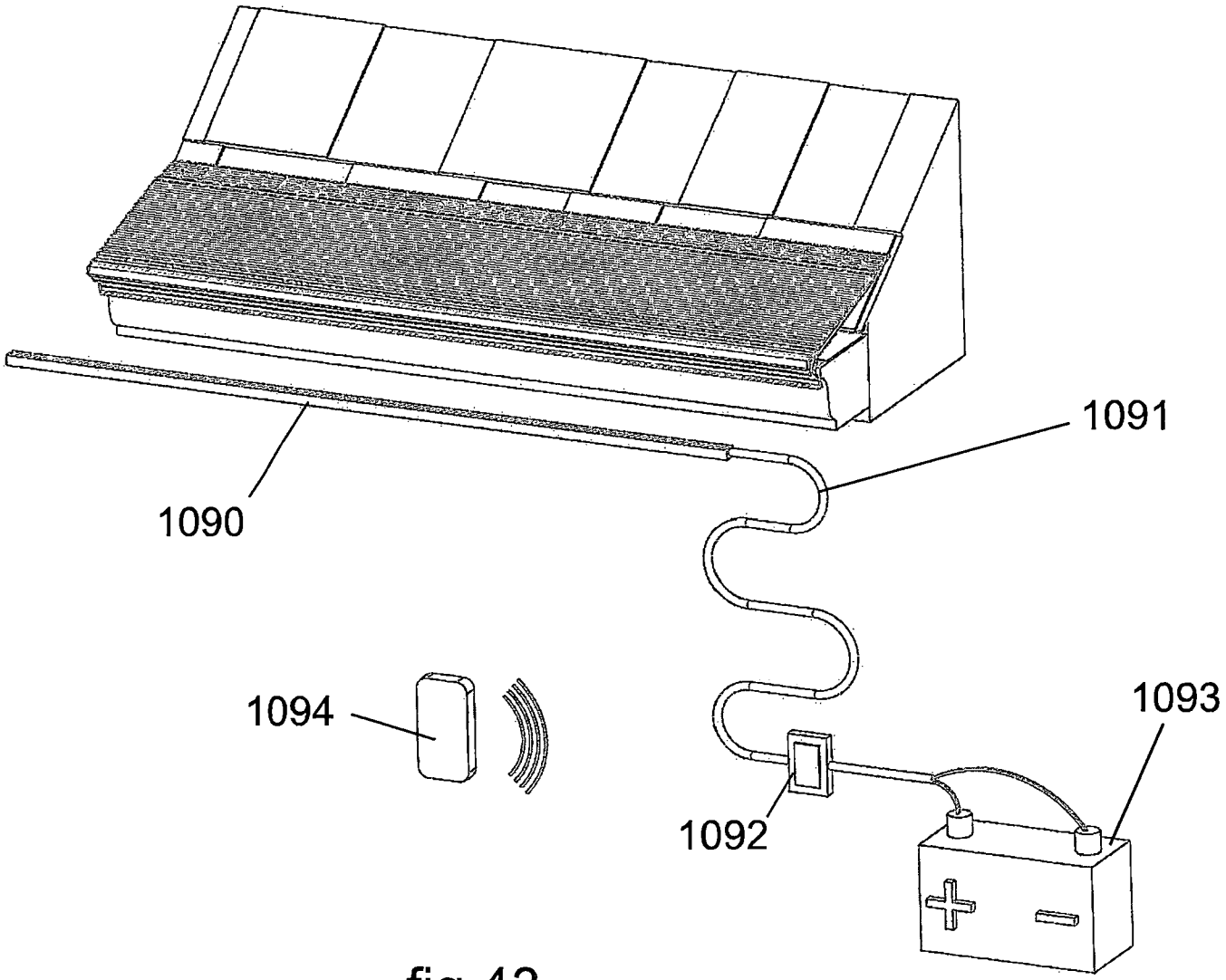
Figure 44:
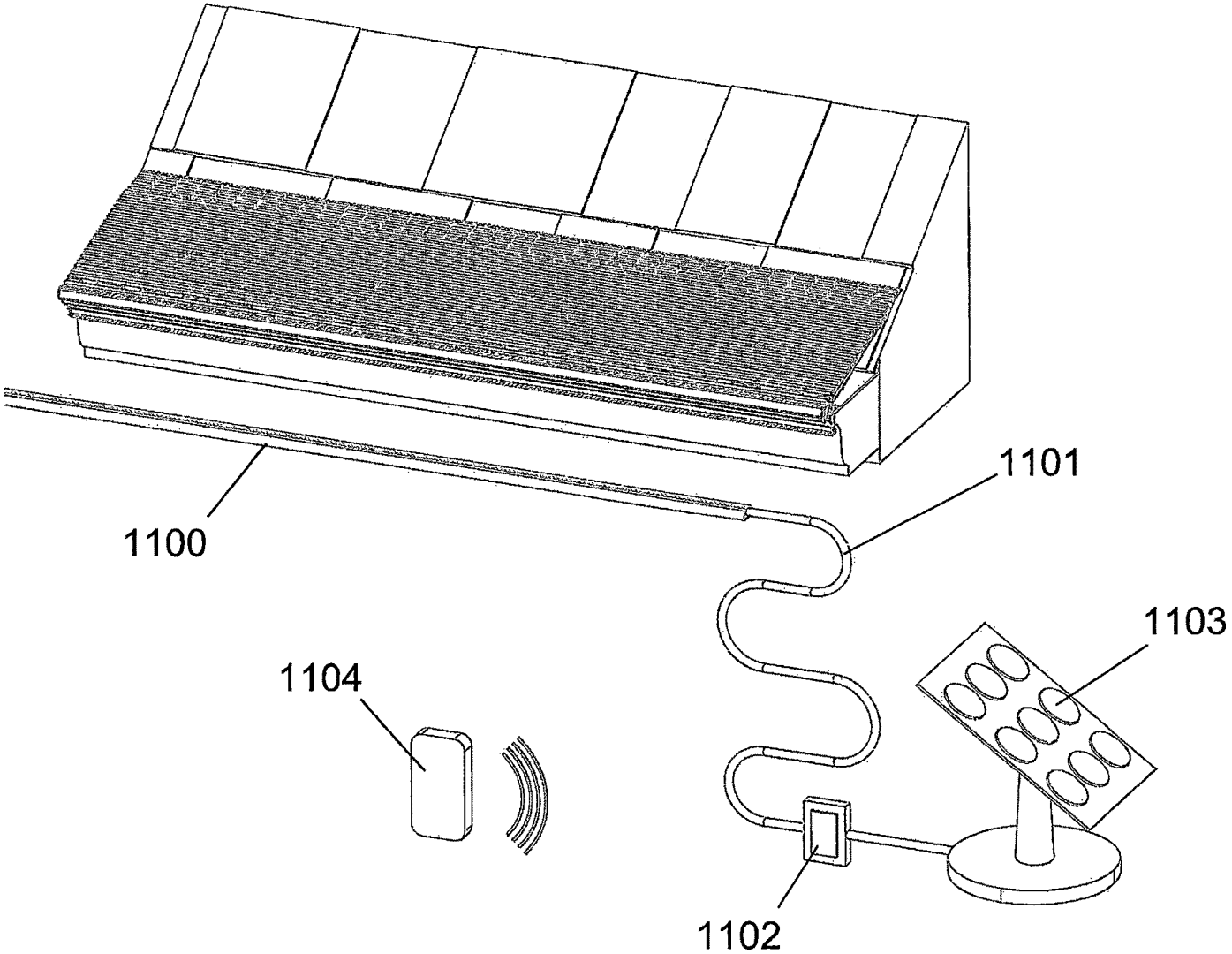

The lighting fixture 1010 can, e.g., be a light strip that can include a lens 1111 and LED lights 1113. The light strip can come in a variety of lengths, e.g., 1 ft, 3 ft or 10 ft. The lens can be clear or colored and the LED can be a white light or capable of changing colors. The lighting fixture can have one or more tee receivers for changing orientation of the LED fixture and light direction. As shown in FIG. 40, the light fixture 1055 can be powered using a power cord 1060, an AC plug 1062 and light switch 1061. As shown in FIG. 41, the light fixture 1070 can be powered using a power cord 1071, an AC plug 1073 and timer/photo-sensor 1072. As shown in FIG. 42, the light fixture 1080 can be powered using a power cord 1081, plug 1083, timer/photo-sensor/wireless sensor 1082 along with a cellphone app or wireless remote controller 1084. As shown in FIG. 43, the light fixture 1080 can be powered using a power cord 1091, a battery 1093, timer/photo-sensor/wireless sensor 1092 along with a cellphone app or wireless remote controller 1094. As shown in FIG. 44, the light fixture 1100 can be, powered using a power cord 1101, a solar panel 1103, timer/photo-sensor/wireless sensor 1102 along with a cellphone app or wireless remote controller 1104. In some implementations, the lights can also be actuated by the cellphone app or wireless remote controller 1084 to turn the lights on and off, change light sequences and change light colors.

Figure 45:
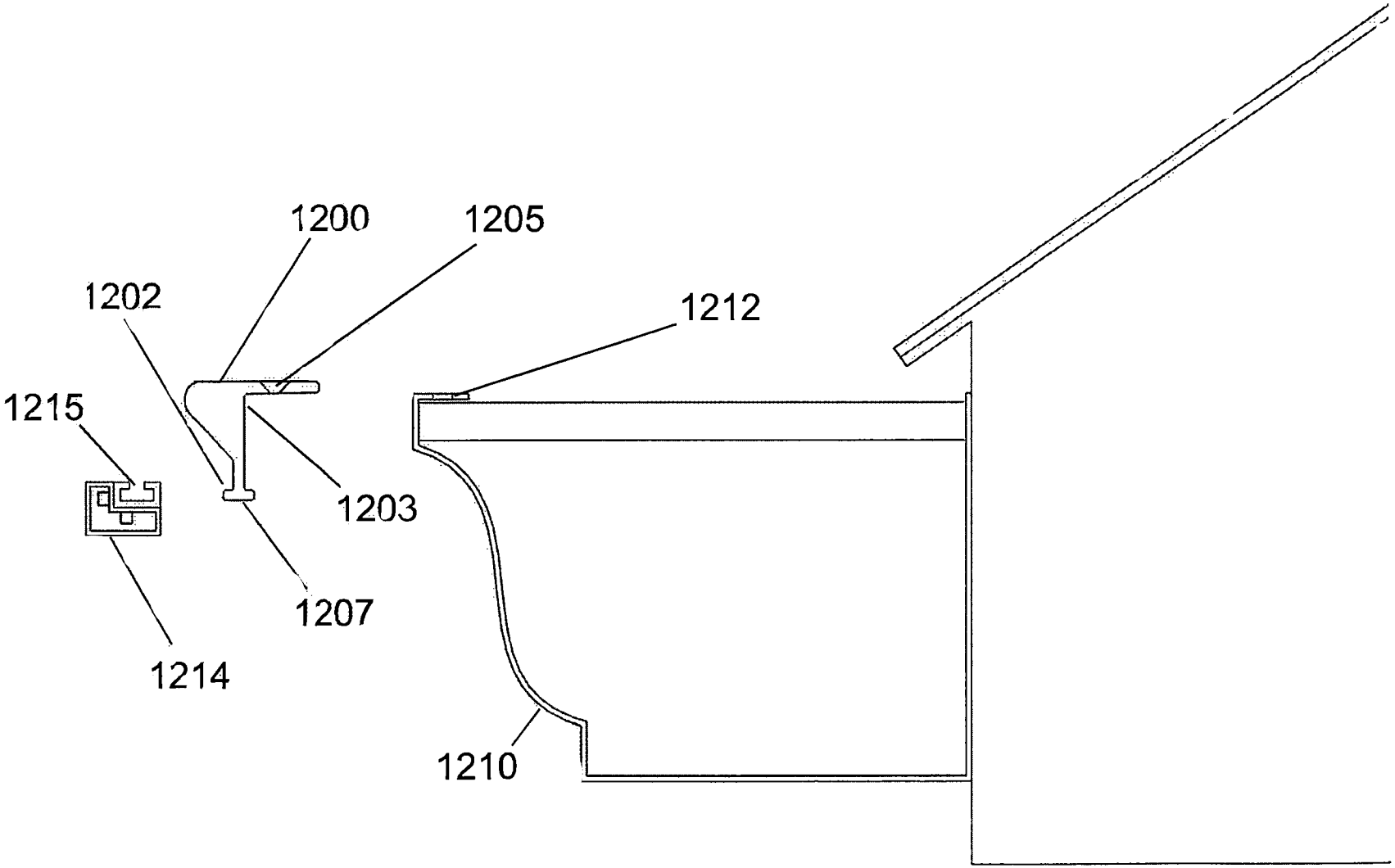
FIG. 45 is an exploded, side view of a debris ejector and lighting fixture of the disclosed technology.
Figure 46:
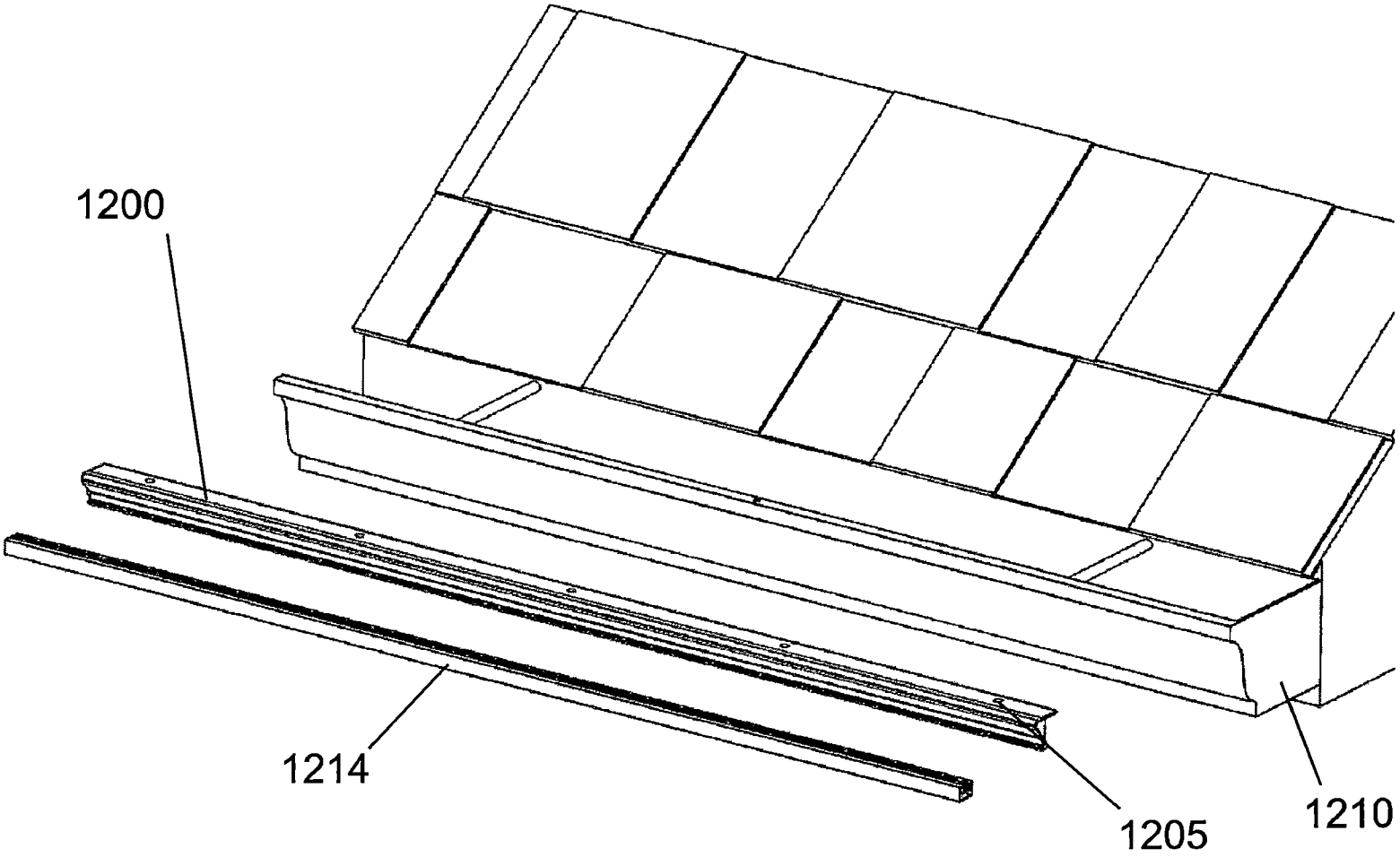
FIG. 46 is an exploded, perspective view of a debris ejector and lighting fixture of the disclosed technology.
Figure 47:
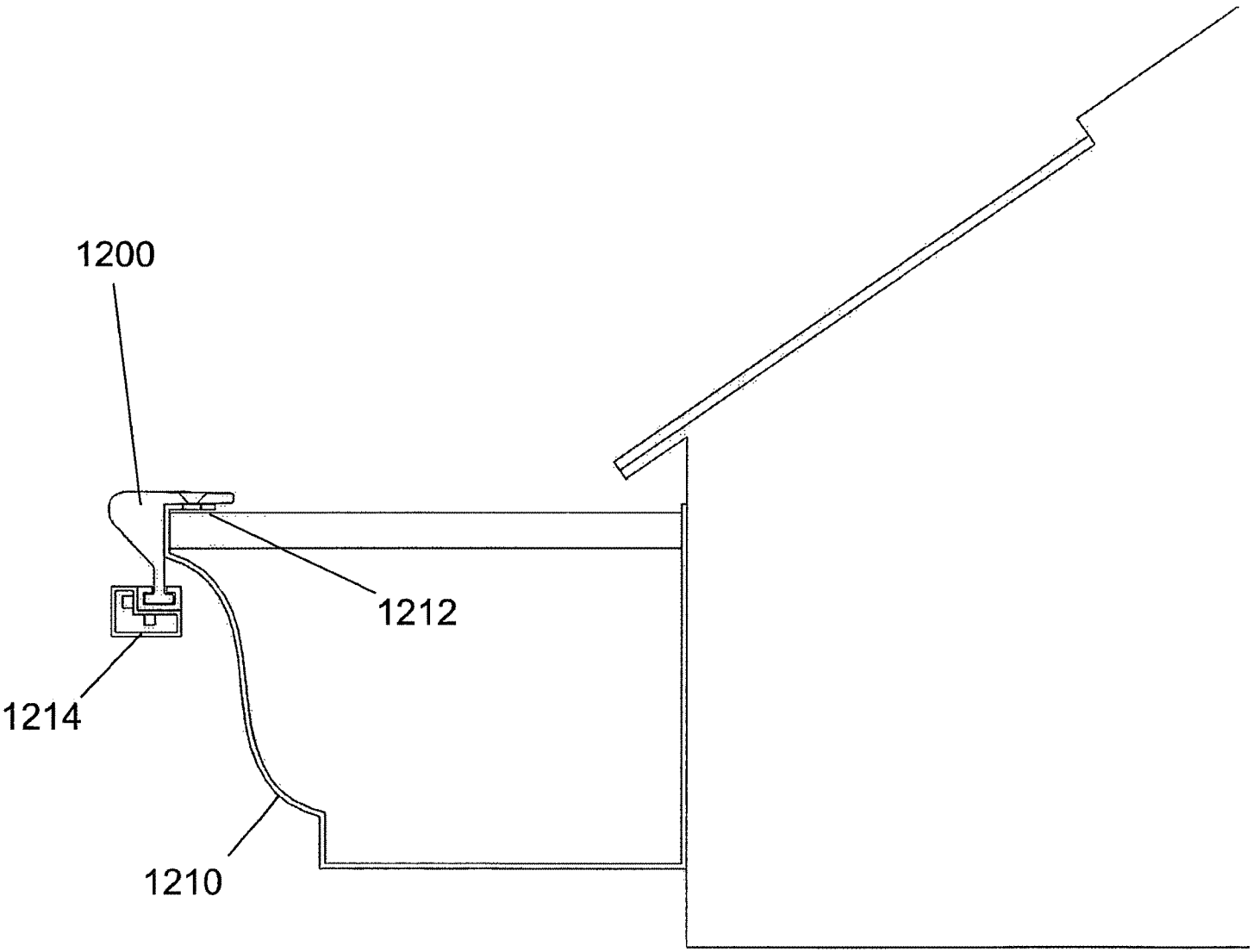
FIG. 47 is a side view of a debris ejector and lighting fixture of the disclosed technology.

In some implementations, as shown in FIGS. 45-47, a stand-alone mounting assembly 1200 can be attached to a gutter 1210 and include a fixture mount 1202. The stand-alone mounting assembly 1200 can be an L-shaped mount for attaching to a gutter rail 1212 of the gutter 1210. A mounting section 1203 can securely retain the stand-alone mounting assembly 1200 to the gutter 1210. e.g., with screws positioned in screw location ribs 1205, but other attachment mechanisms are contemplated, e.g., snap-on components.

The fixture mount 1202 can project downwards from the mounting assembly 1200 and include a tee section 1207. The mount 1202 can be constructed from a flexible material, e.g., a thermoplastic elastomer/rubber while the tee section 1207 can be constructed from a solid material e.g., polymers, thermoplastics, thermosets and/or elastomers. The fixture mount 1202 can be married to a tee receiver guide 1215 of a lighting fixture 1214. The lighting fixture can be any of the lighting fixtures described herein.

Figure 48:
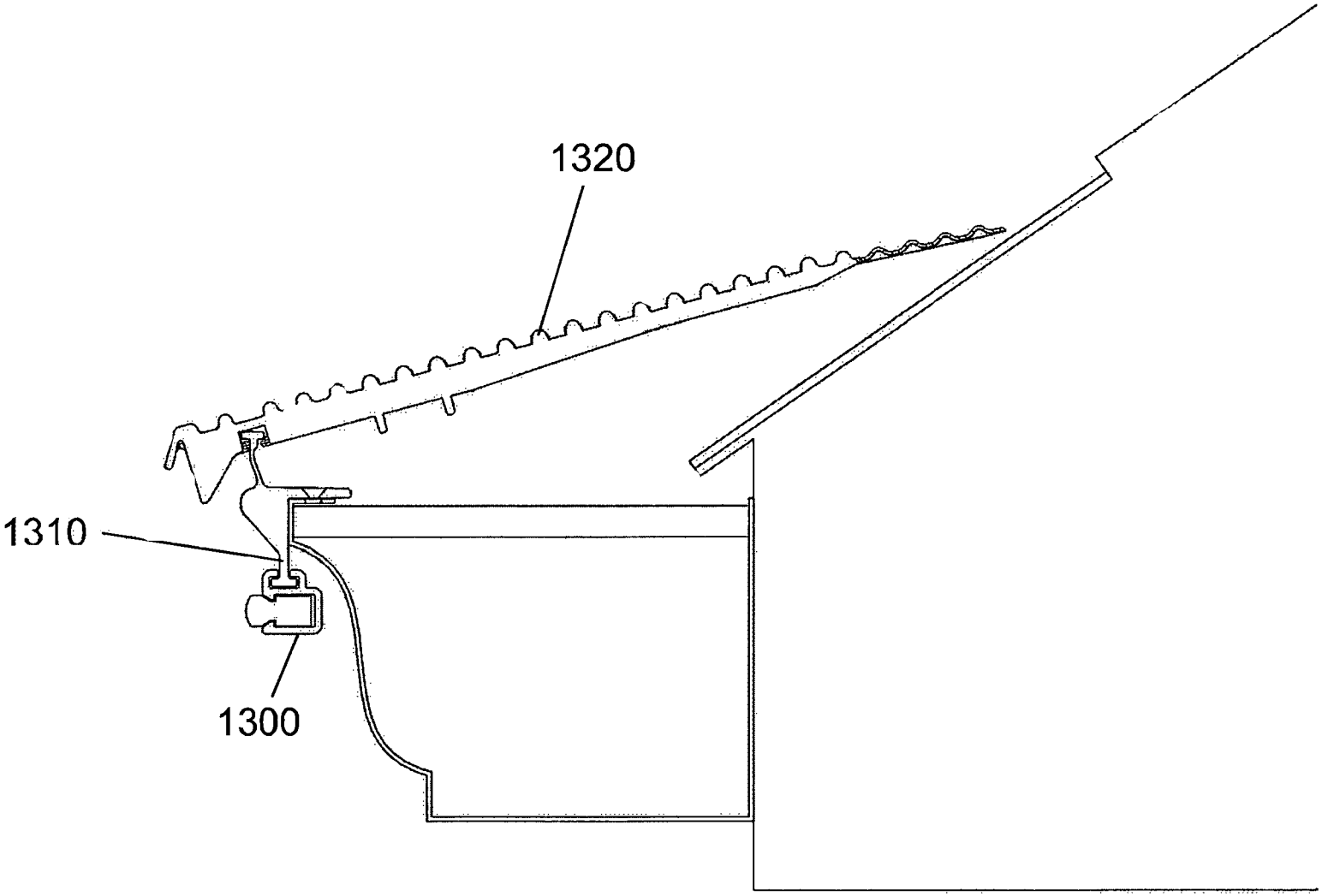
FIG. 48 is a side view of a debris ejector and lighting fixture of the disclosed technology.
Figure 49:
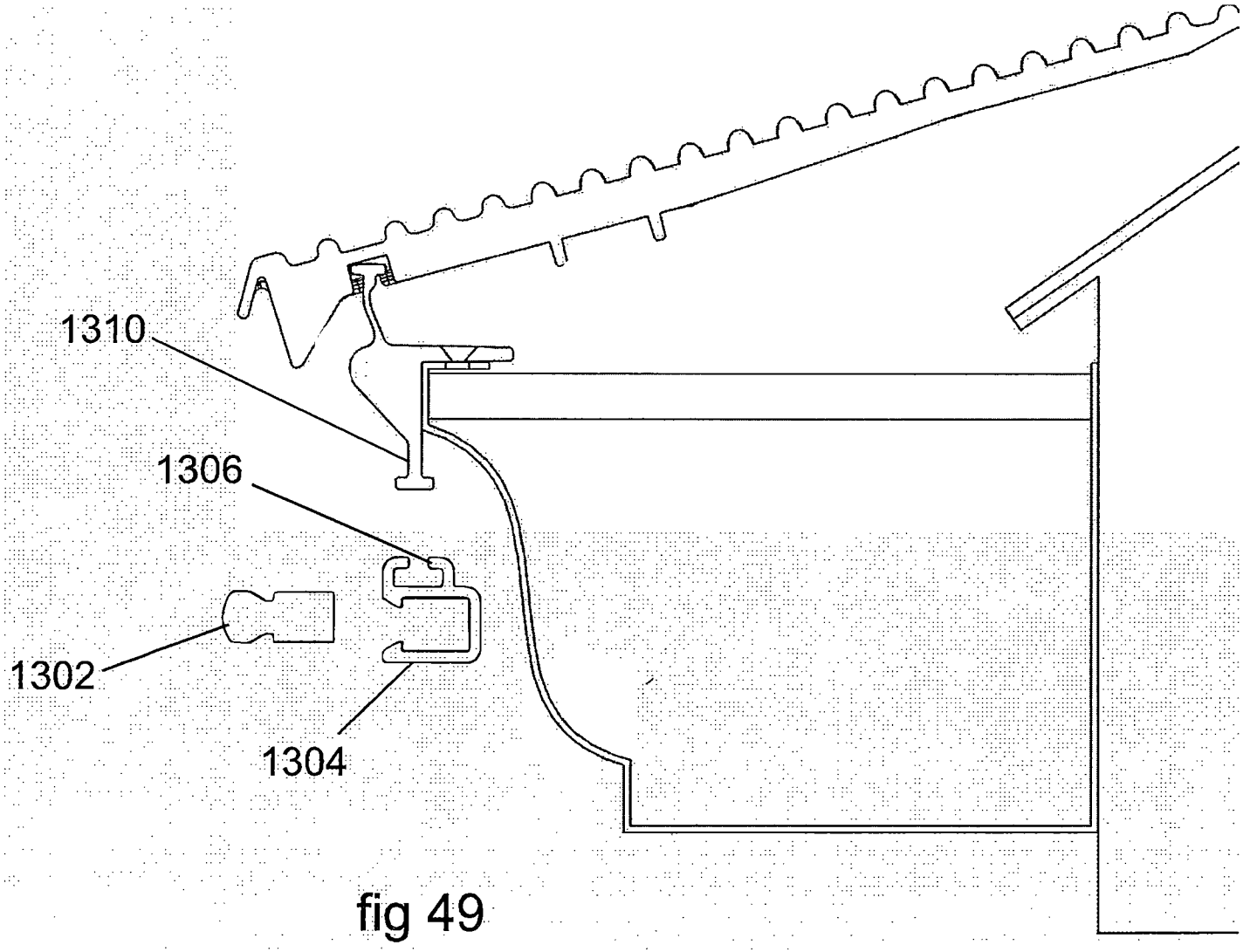
FIG. 49 is a side view of a debris ejector and lighting fixture of the disclosed technology.
Figure 50:
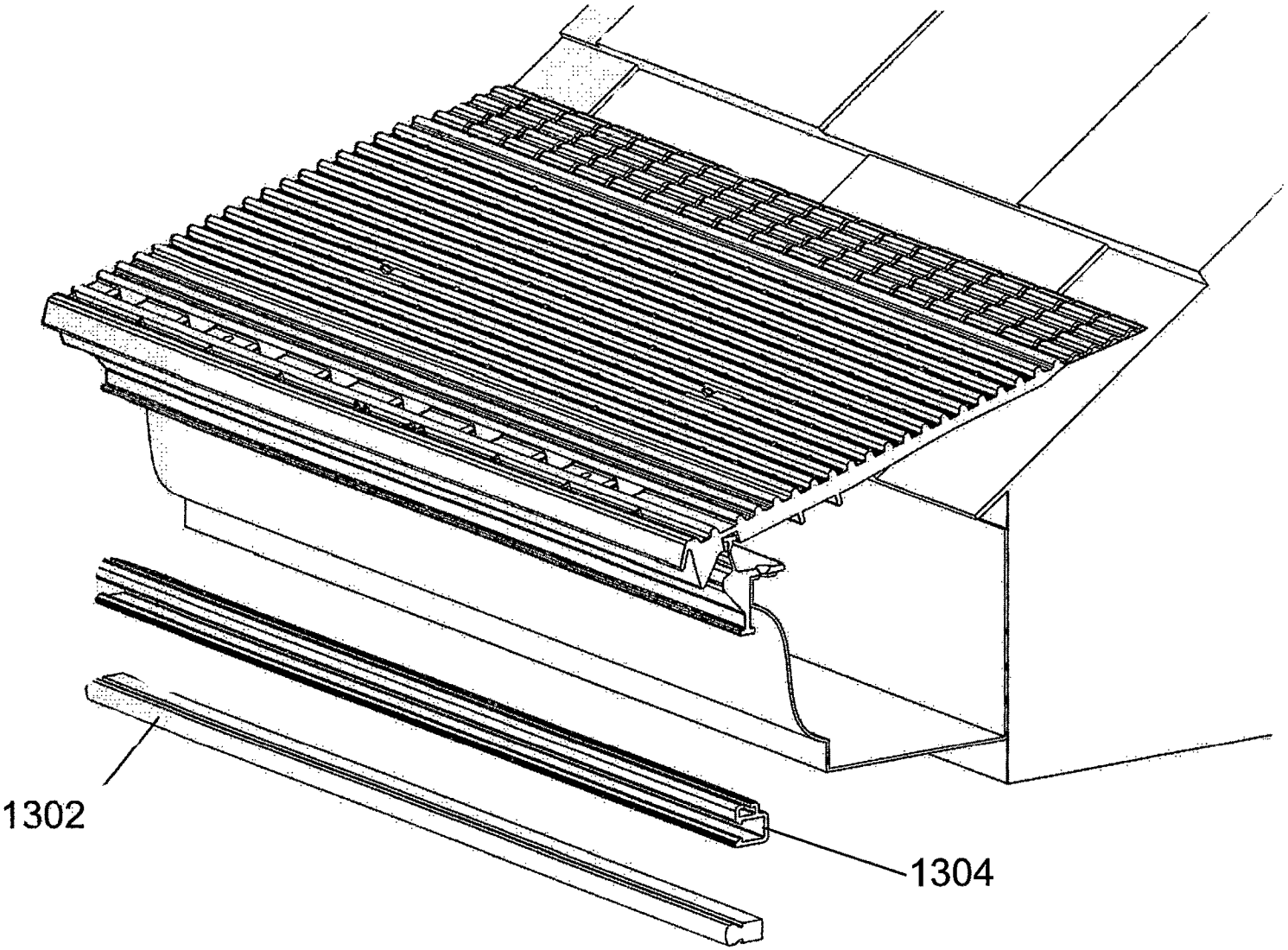
FIG. 50 is a perspective view of a debris ejector and lighting fixture of the disclosed technology.

In some implementations, as shown in FIGS. 48-50, a gutter guard 1320, as described above, can include a light fixture 1300 attached to mount 1310. The light fixture 1300 can include an LED strip 1302 and a LED sleeve 1304. The LED sleeve 1304 can further include a mount receiver 1306. In use, an LED strip 1302 can be inserted into the LED sleeve 1304 and attached to the mount 1310 for use.

Figure 51:
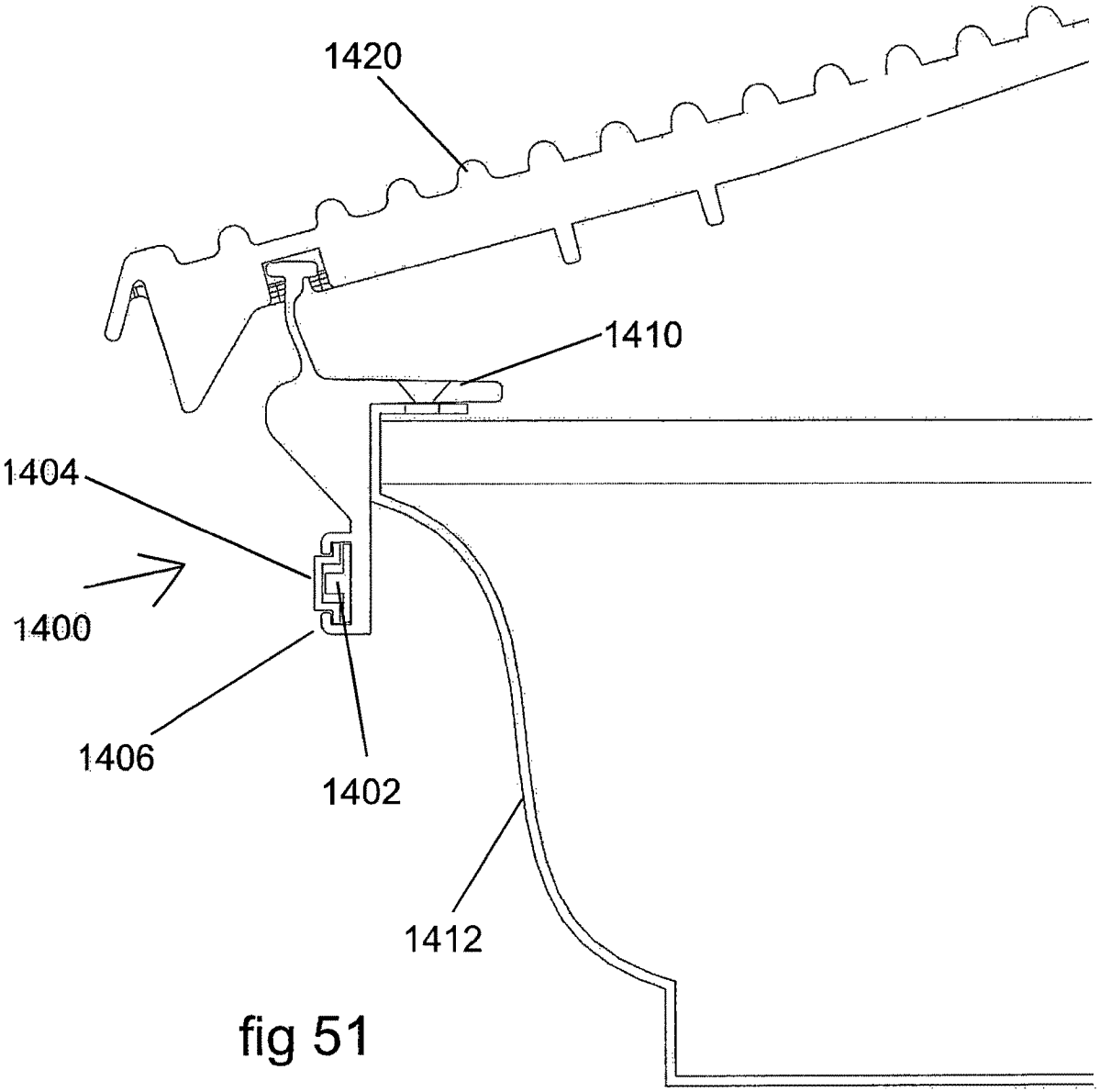
FIG. 51 is side view of a debris ejector and lighting fixture of the disclosed technology.
Figure 52:
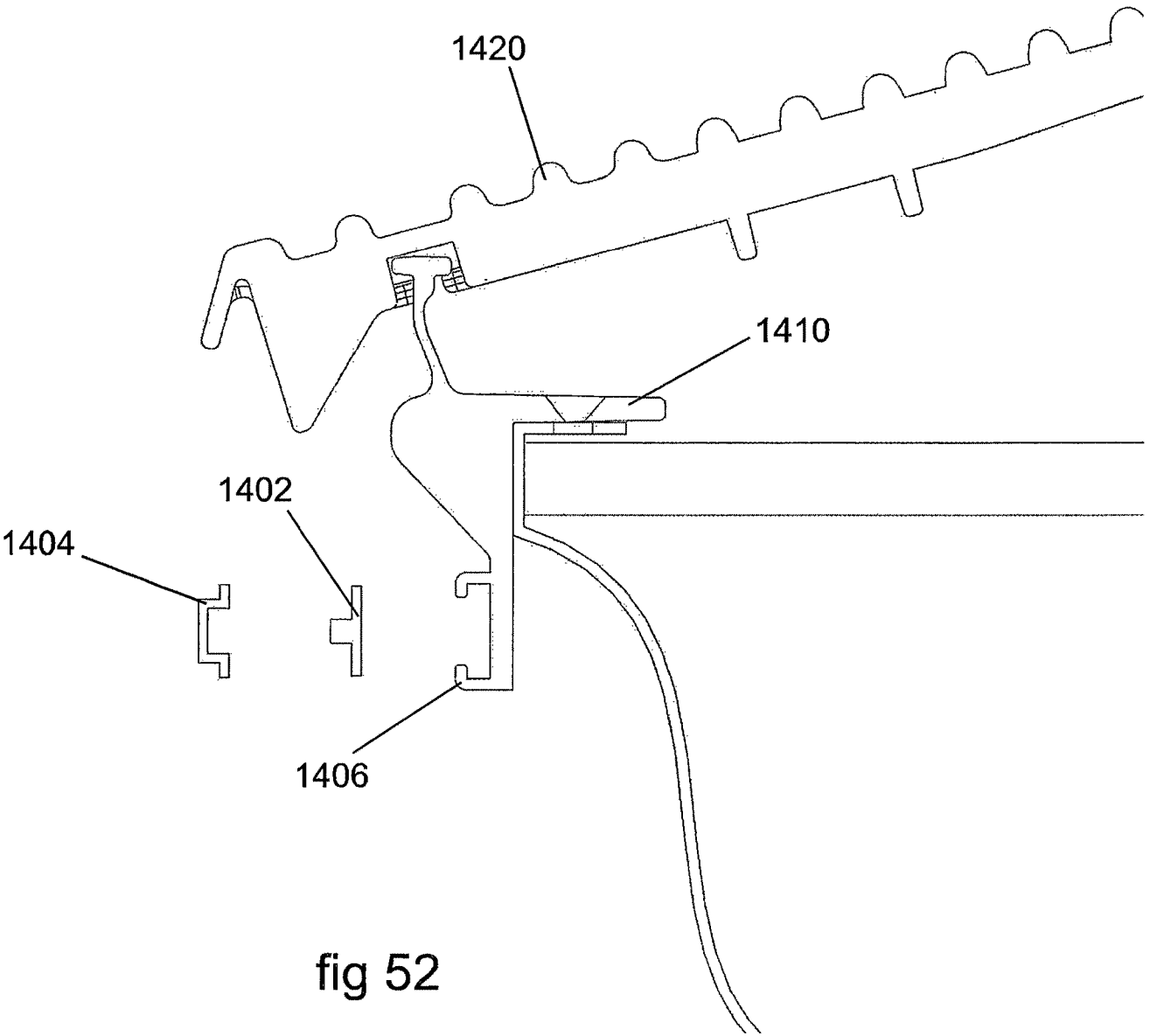
FIG. 52 is side view of a debris ejector and lighting fixture of the disclosed technology.
Figure 53:
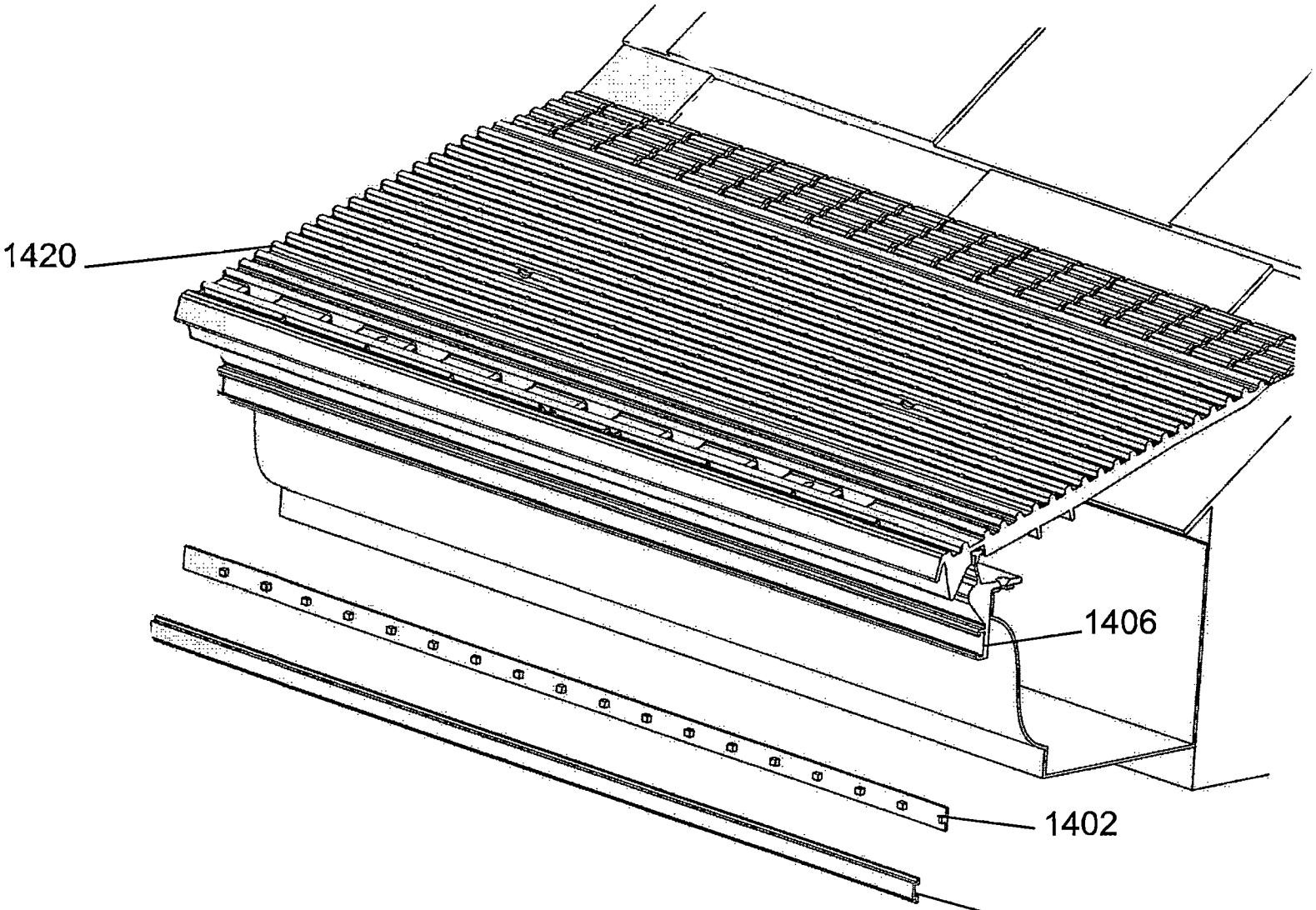
FIG. 53 is perspective view of a debris ejector and lighting fixture of the disclosed technology.

In some implementations, as shown in FIGS. 51-53, a gutter guard 1420, as described throughout this disclosure, can further include a light fixture 1400 attached to mount 1410. The light fixture 1400 can include an LED strip 1402 and a LED lens 1404. The LED lens 1404 can be a clear or translucent protective material for protecting the LED strip from the outdoor elements, e.g., rain, sunlight, snow, etc. The LED mount 1410 can further include a LED track 1406. In use, the LED strip 1402 and the LED lens 1404 can be inserted into the LED track 1406. In this implementation, the LED strip is positioned so that light is projected outward with respect to the gutter 1412.

Figure 54:
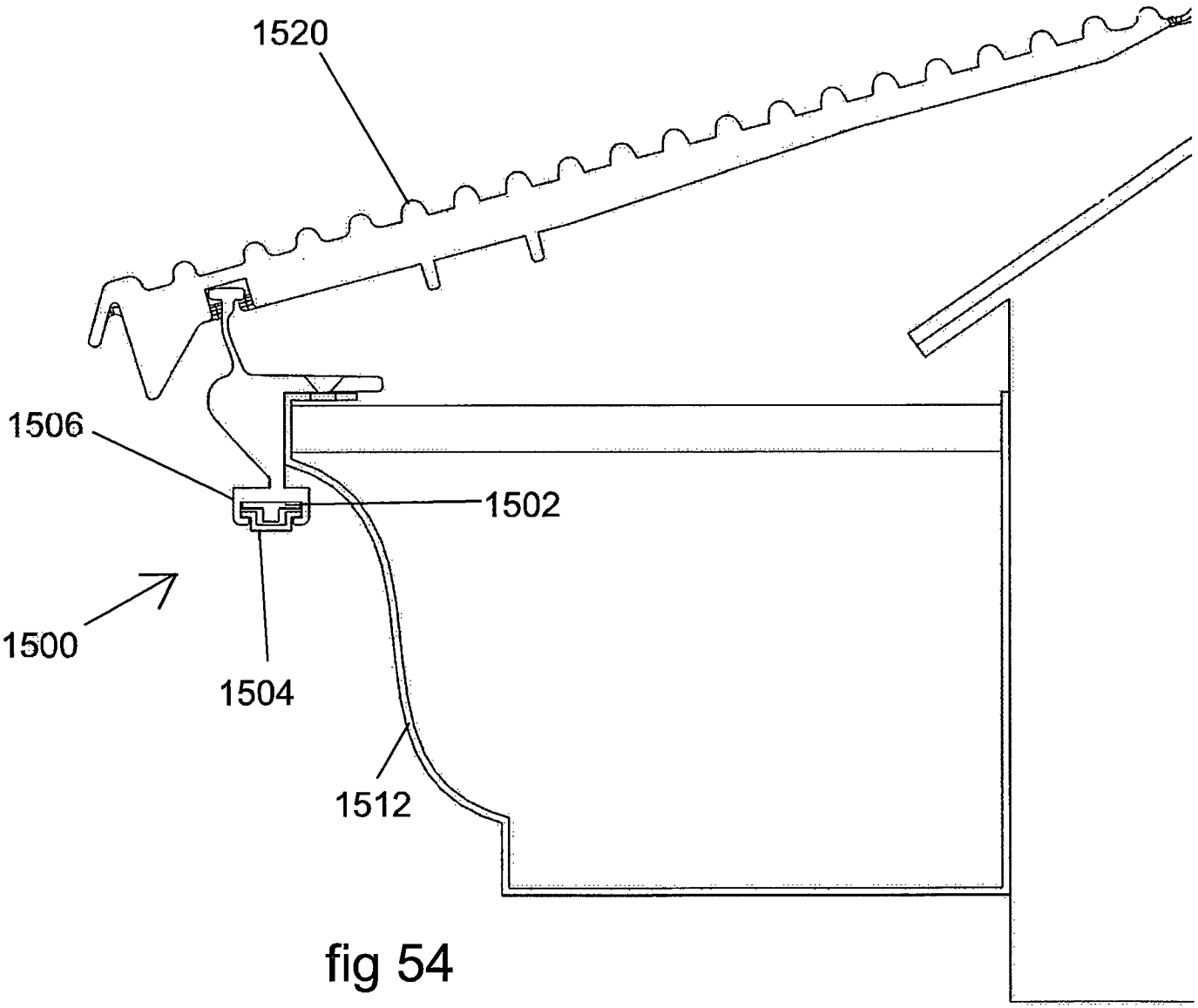
FIG. 54 is side view of a debris ejector and lighting fixture of the disclosed technology.
Figure 55:
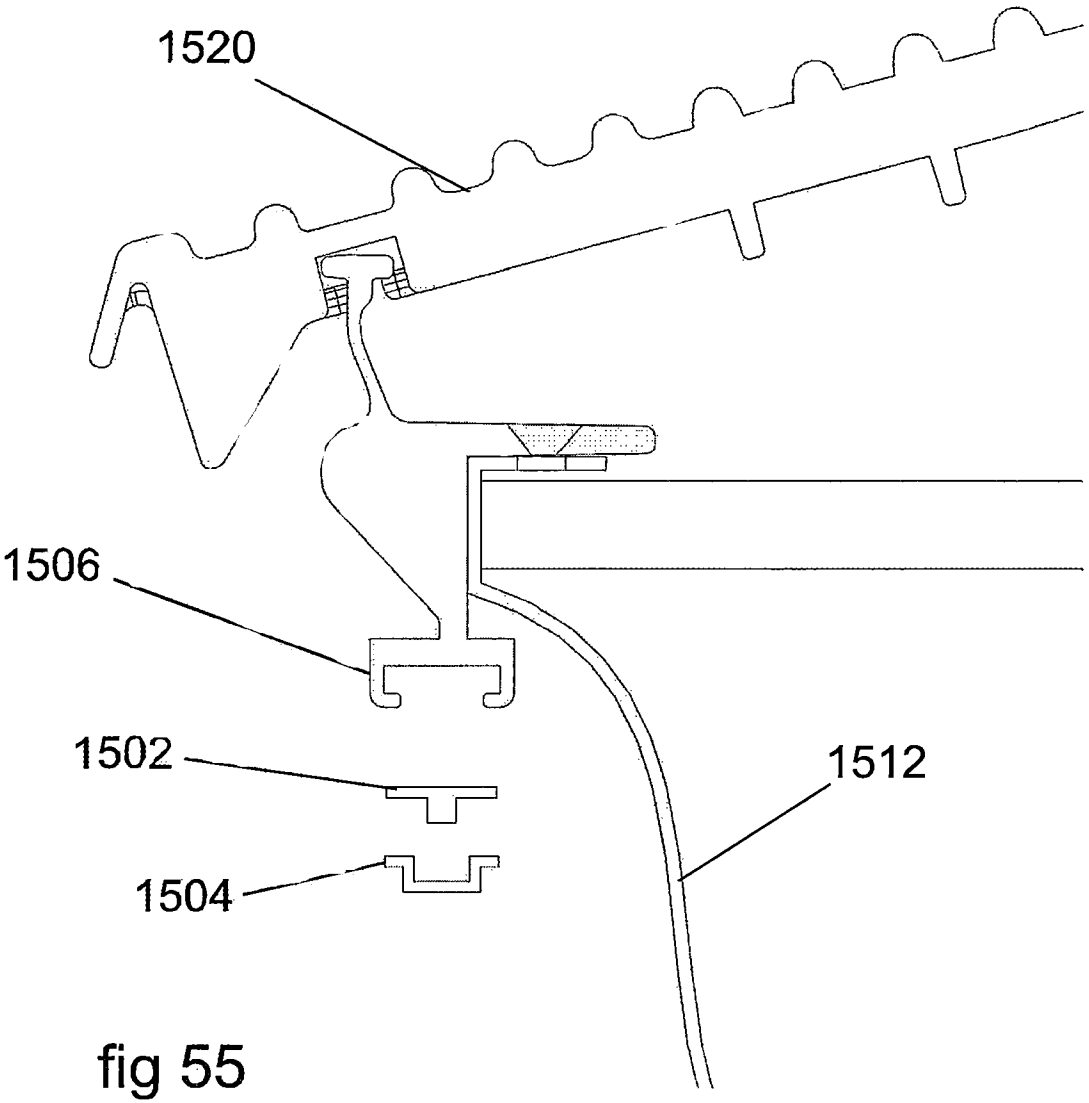
FIG. 55 is side view of a debris ejector and lighting fixture of the disclosed technology.
Figure 56:
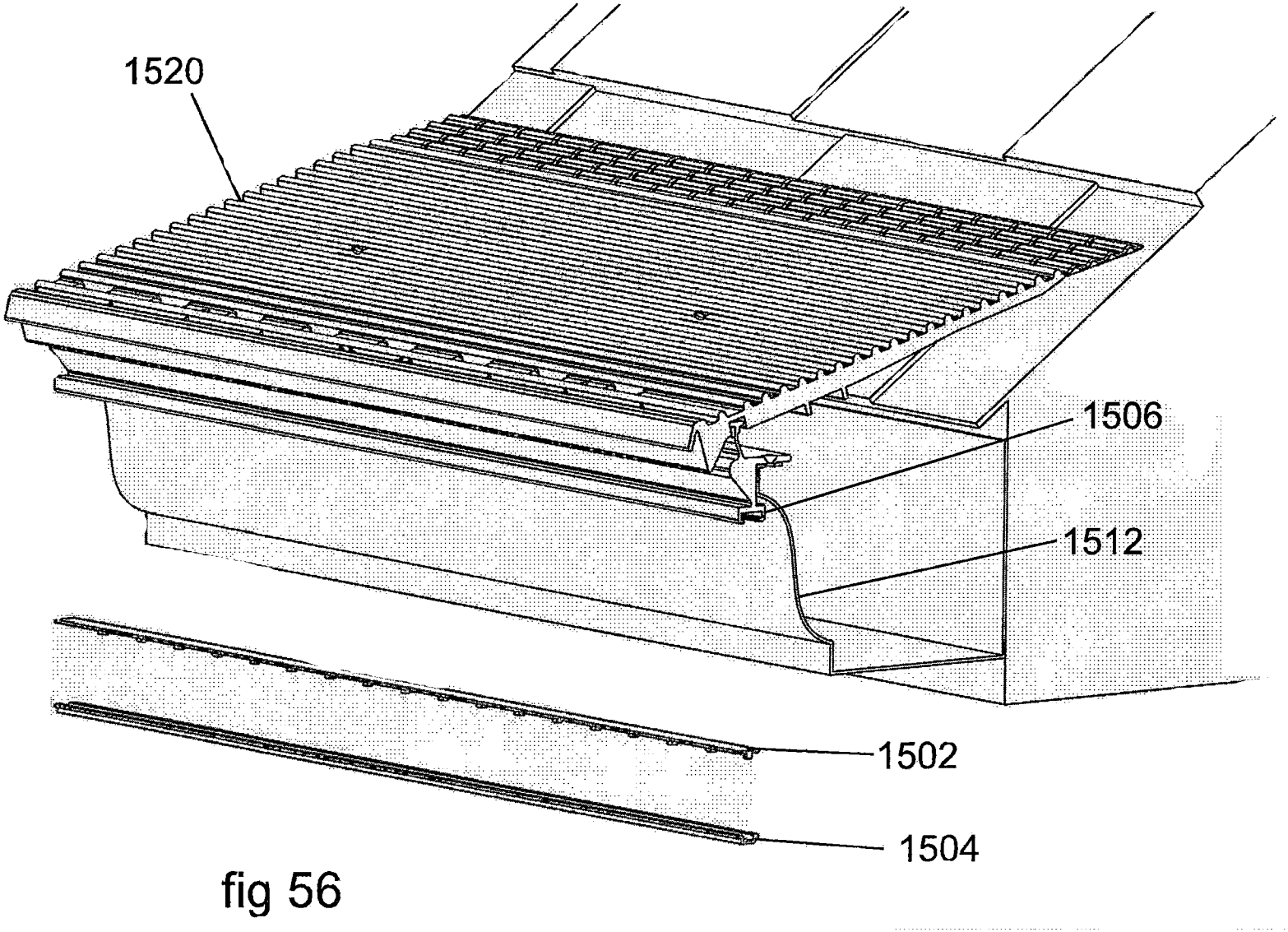
FIG. 56 is perspective view of a debris ejector and lighting fixture of the disclosed technology.

In some implementations, as shown in FIGS. 54-56, a gutter guard 1520, as described throughout this disclosure, can further include a light fixture 1500 attached to mount 1510. The light fixture 1500 can include an LED strip 1502 and a LED lens 1504. The LED lens 1504 can be a clear or translucent protective material for protecting the LED strip from the outdoor elements, e.g., rain, sunlight, snow, etc. The LED mount 1510 can further include a LED track 1506. In use, the LED strip 1502 and the LED lens 1504 can be inserted into the LED track 1506. In this implementation, the LED strip is positioned so that light is projected downward with respect to the gutter 1512.

Figure 57:
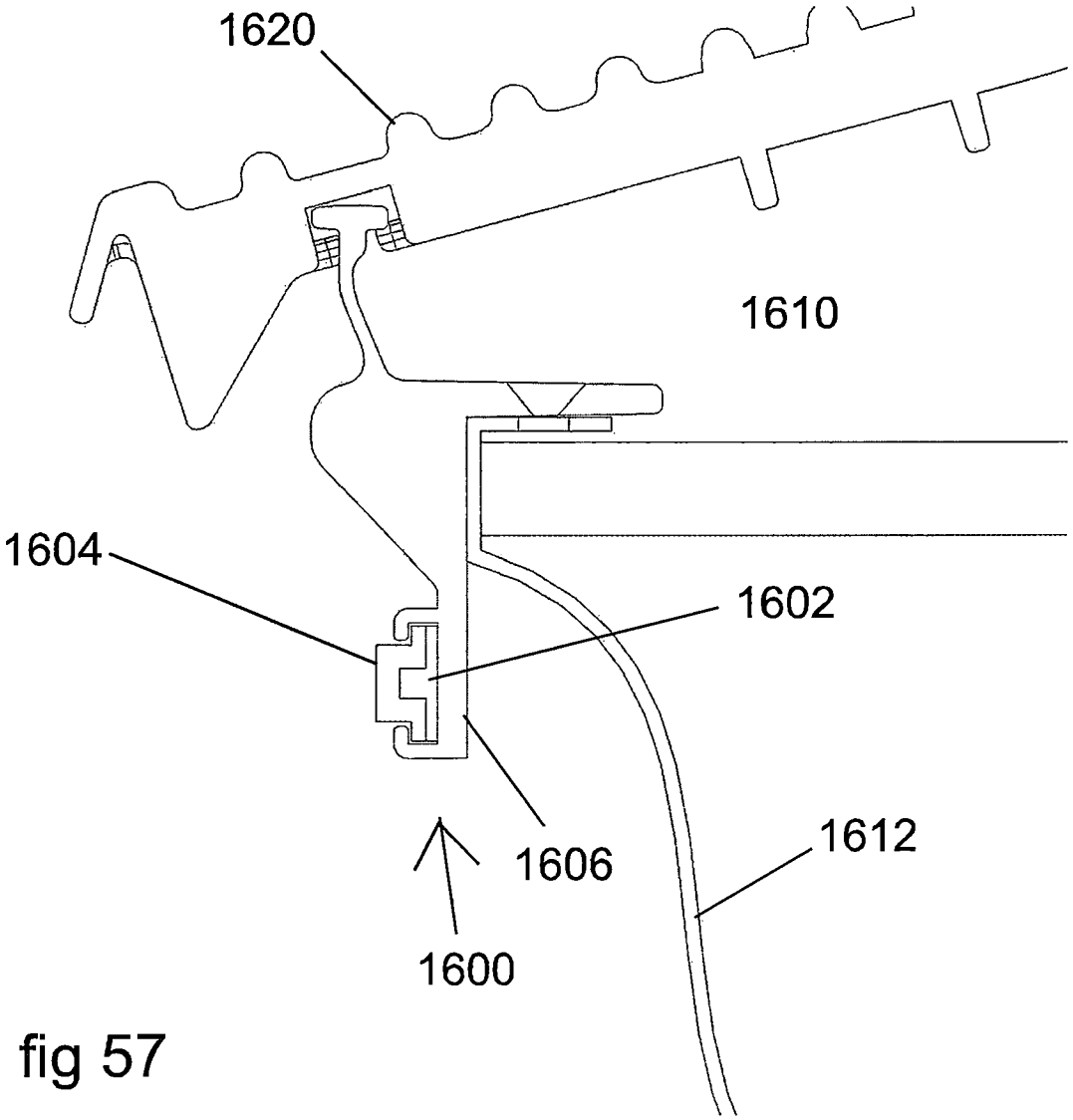
FIG. 57 is side view of a debris ejector and lighting fixture of the disclosed technology.
Figure 58:
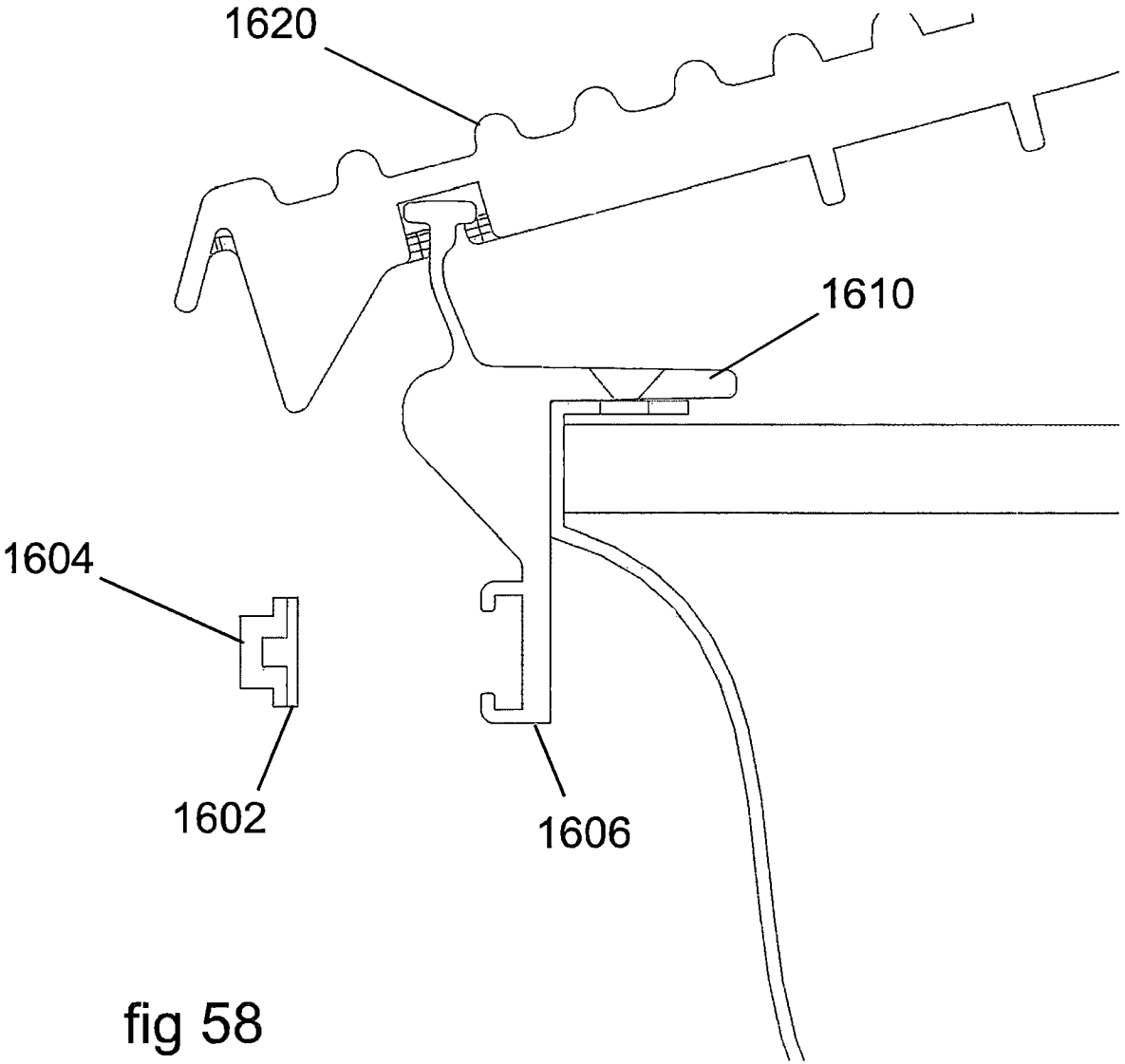
FIG. 58 is side view of a debris ejector and lighting fixture of the disclosed technology.

In some implementations, as shown in FIGS. 57-58, a gutter guard 1620, as described throughout this disclosure, can further include a light fixture 1600 attached to mount 1610. The light fixture 1600 can include an LED strip 1602 and a LED encasement 1604. The LED encasement 1604 can be a clear or translucent protective material that is integrally formed over the LED strip and protects the LED strip from the outdoor elements, e.g., rain, sunlight, snow, etc. The LED mount 1610 can further include a LED track 1606. In use, the LED strip 1602 and the LED lens 1604 can be inserted into the LED track 1606. In this implementation, the LED strip is positioned so that light is projected outward with respect to the gutter 1612.

While presently preferred embodiments have been described for purposes of the disclosure, numerous changes in the arrangement can be made by those skilled in the art. Such changes are encompassed within the spirit of the invention as defined by the appended claims.

The foregoing Detailed Description is to be understood as being in every respect illustrative and exemplary, but not restrictive, and the scope of the disclosed technology disclosed herein is not to be determined from the Detailed Description, but rather from the claims as interpreted according to the full breadth permitted by the patent laws. It is to be understood that the embodiments shown and described herein are only illustrative of the principles of the disclosed technology and that various modifications may be implemented by those skilled in the art without departing from the scope and spirit of the disclosed technology. Those skilled in the art could implement various other feature combinations without departing from the scope and spirit of the disclosed technology. Although the embodiments of the present disclosure have been described with specific examples, it is to be understood that the disclosure is not limited to those specific examples and that various other changes, combinations and modifications will be apparent to one of ordinary skill in the art without departing from the scope and spirit of the disclosed technology which is to be determined with reference to the following claims.

The invention claimed is:

1. An apparatus for attachment to a gutter system comprising:

an ejector assembly, the ejector assembly including (1) a plurality of self-adjusting fingers, the plurality of self-adjusting fingers capable of conforming to a surface of a roof, the plurality of self-adjusting fingers capable of receiving a water flow from the surface of the roof, and the plurality of self-adjusting fingers including speed bumps for slowing a speed of the water flow, (2) a filter, the filter capable of receiving the water flow from the plurality of self-adjusting fingers, (3) a front ledge, the front ledge capable of acting as a lever so as to move the ejector assembly from a first position to a second position, (4) a tee receiver guide, the tee receiver guide including tee slot fingers;

a mounting assembly, the mounting section is an L-shaped mount for attaching to a gutter rail of the gutter system, the mounting assembly including a hinge, the hinge having a tee section, the tee section capable of being received in the tee slot fingers of the tee receiver guide, the mounting assembly further including a light mount; and a light fixture, the light fixture capable of being received by the light mount.

2. The apparatus of claim 1 wherein the light mount includes a tee section and the light fixture includes a tee receiver guide, and the tee section is slidably received within the tee receiver guide.

3. The apparatus of claim 1 wherein the light fixture includes a light strip, the light strip including a lens and LED lights.

4. The apparatus of claim 3 wherein the lens is clear or colored and the LED is a white light or capable of changing colors.

5. The apparatus of claim 1 wherein the light fixture is powered and controlled using one or more of the following: an AC plug, a light switch, a timer/photo-sensor, a timer/photo-sensor/wireless sensor, a cellphone app, a wireless remote controller, a battery, and a solar panel.

6. The apparatus of claim 1 wherein the light fixture includes an LED strip and an LED sleeve wherein the LED strip is inserted into the LED sleeve and attached to the light mount.

7. The apparatus of claim 1 wherein the light mount includes a sleeve and the light fixture is slidably received within the sleeve.

* * * * *